US005487281A

United States Patent [19]

Frullini et al.

[11] Patent Number: 5,487,281

[45] Date of Patent: Jan. 30, 1996

[54] METHOD AND APPARATUS FOR JOINING TWO EDGES OF A KNITTED TUBULAR ARTICLE

[75] Inventors: Alberto Frullini; Paolo Frullini, both of Florence, Italy

[73] Assignees: Fabritex S.R.L.; Conti Florentia S.R.L., both of Firenza, Italy

[21] Appl. No.: 273,023

[22] Filed: Jul. 8, 1994

[30] Foreign Application Priority Data

Jul. 12, 1993 [IT] Italy ..... FI93A0128

[51] Int. Cl.[6] ..... D04B 9/56; D04B 9/18; D04B 35/00

[52] U.S. Cl. ..... 66/13; 66/8; 66/185

[58] Field of Search ..... 66/8, 13, 58, 48, 66/148

[56] References Cited

U.S. PATENT DOCUMENTS

| | | | |
|---|---|---|---|
| 472,874 | 4/1892 | Griswold | 66/148 |
| 1,308,828 | 7/1919 | Williams | 66/58 |
| 1,364,088 | 1/1921 | Fenn | 66/13 |
| 1,388,227 | 8/1921 | Williams | 66/148 X |
| 2,089,147 | 8/1937 | Lawson et al. | 66/58 X |
| 2,495,585 | 1/1950 | Kuehnel | 66/148 |
| 2,948,240 | 8/1960 | Burd et al. | 66/148 X |

FOREIGN PATENT DOCUMENTS

FI/92/A/194 10/1992 Italy .

*Primary Examiner*—John J. Calvert
*Attorney, Agent, or Firm*—McGlew and Tuttle

[57] ABSTRACT

Apparatus for joining two edges of a knitted tubular article, especially the toe of a stocking, comprising:—cam means (31,32) for operating the lifting and respectively the lowering of a predetermined number of needles (3,30) of a first and a second semirank of stitches (8,80);—means for removing the stitches (8) from said first semirank (x) and overturning them through 180° about a diametral axis (a—a) of the cylinder (1) of needles (3,30);—cam means (7) for operating the 180° overturning in both directions of the semicircular sector (4) about said axis (a—a) of the cylinder (1);—means for operating the transfer of the sector (4) from a knitting station (T) to a linking station (R), that is a station (R) in which the hook-up is formed;—means for keeping the sinkers housing (11) of the machine at a fixed and predetermined angular position;—a seamer-linker (130) to operate the seaming of the pairs of stitches (8,80) during the linking step;—means (95, 96, 97) for ultimately cutting the linking thread (F) and holding the end of the thread (F1) fed by a supply reel. (FIG. 1A).

33 Claims, 47 Drawing Sheets

METHOD AND APPARATUS FOR JOINING TWO EDGES OF A KNITTED TUBULAR ARTICLE

FIELD OF THE INVENTION

The present invention refers to a method and apparatus for operating the union of the two edges of a knitted tubular article, such as the linking of the sock toe upon completion of the knitting of the article.

BACKGROUND OF THE INVENTION

It is known that socks are manufactured with circular machines having one or two needle cylinders. The knitting starts from the elastic hem and finishes at the toe side which is left open to be closed afterwards by suitable seamer-linker machines. More specifically, it is known that after the formation of the necessary ranks, or knit courses, for the sock toe, a number of waste knit course of a so called "unthreading" edge is formed, usually of shaved knit one centimeter high, to avoid ladders during the seaming of the toe. Depending on the type of machine being used, the socks are produced:

a) one after the other. In this case, the last unthreading knit course of the toe is connected to the first knit course of the elastic hem of the next sock through a resistant, smooth and well visible thread which is worked with a feeding unit other than that for the elastic hem, and which is to be manually removed to separate one sock from the other prior to the seaming of the toe;

b) one separate from the other. This procedure is used mostly in the single- or two-cylinder circular machines which are provided with an automatic device for the separation of the manufactured socks.

Afterwards, each sock must be turned inside out to allow for the seaming on the reverse side thereof. Then, the toe is closed by removing the waste edge and sewing the stitches of the last semirank, or partial course, of the back of the foot together with the stitches of the last partial course of the sole.

However, seaming the toe of the socks outside the machine which make them brings about an increase in the time and cost of production, mainly as a consequence of the numerous intermediate operations to be carried out after the completion of the knitting and before the very seaming of the toe, intermediate operations which include, for example, the removal of the socks and the transfer thereof to the relevant stocking stores where they are selected according to their color and/or size.

All this implies, in fact, relying on skilled personnel who carry out and supervise these operations, and the provision of sufficiently large premises for sitting the machines and selectively storing the socks. Moreover, in case of large numbers of thus formed socks, the amount of yarn which is wasted in the manufacturing of the socks and the subsequent removal of the waste edge, results significantly high costs. Therefore, the relevant cost is economically ineffective and heavily detrimental to the yield of the traditional manufacturing plants.

The Italian patent application No. FI92A194 discloses a method for seaming two front edges of a knitted tubular article, especially a sock. The method comprising the step of manufacturing a knitted tubular article, by means of a one-cylinder circular machine, by starting from the elastic hem and finishing on the side of the toe which is left open. The method further comprises the following operating steps:—lifting a predetermined number of needles of a first partial course, together with the respective stitches, up to a predetermined level: the term partial course referring to a plurality of adjacent stitches belonging to an edge of the article toe;—lifting a predetermined number of needles of a second partial course, together with the respective stitches thereof, to the same level as those of the first partial course;— removing the stitches of the first partial course, lowering the corresponding needles and transferring the stitches, through a 180° overturning thereof about a horizontal diametral axis of the needles cylinder, so that each thus overturned stitch will fit the relevant needle of the second partial course;— releasing the stitches of the first partial course from the relevant transfer means and moving the thus superimposed pairs of stitches to a level suitable for the linking thereof;—rotating the needles cylinder intermittently to insert step-by-step a linking needle into a pair of thus disposed stitches by supplying it, without solution of continuity, with the thread used for knitting the article, and then removing it to form a hook-up plain-chain stitch.

The same document discloses an apparatus for carrying out the above method, which comprises:—cam means for vertically moving a predetermined number of needles of a first and second partial courses of stitches of the toe of the article in the course of formation, which means are in operating condition when the knitting cams of the circular machine are in inoperative condition, and vice versa;—means for removing the stitches of the first partial course and overturning them through 180° about a diametral horizontal axis of the needles cylinder, with a pair of spikes for each stitch and at least a corresponding opening and respectively closing peg, each of which is slidingly housed within a corresponding slots of a semicircular sector: the sector being mounted for a 180° displacement in both directions about a diametral horizontal axis of the needles cylinder, in a position above the sinkers of the machine;—means for making the semicircular sector solid to the needles cylinder, with a radial shutter sliding between two positions of locking and respectively releasing the sector with respect to the needles cylinder, but in a constant and preset spatial location;—fork means for locking the sinker housing during the horizontal rotation of the semicircular sector in conjunction with the needles cylinder, the fork means being activated by corresponding cam means solid to the support of the semicircular sector;—means for linking the paired and superimposed stitches being loaded on the needles of the second partial course by means of a linking bearded needle, with a crochet operatively associated to the needle and located on the opposite side thereof with respect to the stitches, and with a wheel or skid for pressing down the fabric and holding the stitches in linking attitude during the linking operation. The wheel or skid being located on the same side of the linking needle with respect to the knitting needles. The whole of the above means being disposed on top and sideways of the needles cylinder.

The above operating method, although making it possible to provide a finished product of good quality, implies the need of leaving the knitting needles inserted, the same needles supporting the; stitches of the article during the linking operation inside the tuck loops which constitute the seam stitches, so that the hook-up line joining the edges of the article are slightly expanded. The shed for sewing the edges are the same as the knitting one, instead of being smaller as necessary to achieve a closer and more elastic seaming and make, therefore, a better quality article. Besides, the apparatus for implementing the known method is of remarkable constructional complexity, especially in relation to the large number of elements disposed in correspondence of the knitting head of the circular machine. This implies, above all, the need of providing a strict procedure for the integration and coordination of the apparatus with the circular machine which makes the article. Also as a reduced level of modularity is caused, that is, a substantially reduced possibility of adding further elements able to improve the quality of the product as far as the knitting and/or final hook-up is concerned. Further this greatly limits the access to the individual components of the linking device. All this at the expense of simplicity and cost of intervention for assembling and/or up-keeping the circular machine and/or the same apparatus for the linking of the toe. Moreover, the circular machines for the knitting of the article must be properly suited, from the architectural, structural-mechanical and operational point of view, to the specific disposition of the means provided to carry out the above toe-closing method. In view of the numerous constructional and functional differences which differentiate the various circular machines known at present, this represents a drawback owing to the limitation of interchangeability degree of the apparatus which, accordingly, must be designed to meet the specific requirements of the knitting machine it is to make part of.

SUMMARY AND OBJECTS OF THE INVENTION

The main object of the present invention is to overcome the drawbacks derived from the traditional operating procedures and provide a method and an automatic apparatus, for joining the edges of a knitted tubular article, which make it possible to obtain a finished product of superior quality and, at the same time, a significant functional simplification as far as the construction and maintenance of the linking apparatus and knitting machine are concerned.

This result has been achieved, according to the invention, by adopting an operating method comprising the initial steps of manufacturing a knitted tubular article such as a sock, starting from the elastic hem and finishing on the side of the toe which is left open, by means of single-cylinder circular machine, and disposing the last-to-form stitches of a first partial course on the knitting needles of a second partial course of stitches through a 180° overturning thereof about a diametral axis of the needles cylinder, the latter being operated by corresponding stitches transferring means so that the pairs of stitches of the first and second partial courses will result retained on the needles of the second partial course, and which method, according to the invention, comprises the further operating steps:

lowering the needles of the second partial course, with the sinkers being open, so as to move the stitches of the first and second partial courses to a level beneath that of the sinkers nib of the machine;

lifting the needles of the second partial course, with the sinkers being closed, so that the corresponding pairs of stitches of the first and second partial courses will result retained by the sinkers at a predetermined position relative to the stem of the respective needles;

lifting farther the needles of the second partial course until all the corresponding pairs of stitches will reach the operating level of the transfer means of the first partial course, so as to have the stitches retained by the means;

lowering the needles of the second partial course so as to allow the article to have the stitches of the first and second partial courses removed from the transfer means, that is, to clear the article of the knitting needles;

transferring the article, with the thus retained stitches, so as to locate it at a predetermined distance form the knitting cylinder;

disposing the thus transferred stitches so as to have them angularly equidistant, with a circular pitch that can be varied, that is, selected according to the required degree of hook-up fineness;

linking the corresponding pairs of stitches thus disposed, by means of a linking needle, to form a chain and, upon completion of the hook-up, making one or more knots for closing the chain;

cutting the hook-up thread;

releasing the thus joined pairs of stitches of the first and second partial courses, to allow the article to be removed in its final, right-side out condition.

It may be useful to point out that a stitch is intended in its retained position when it is fitted on a latch needle and at a level between the needle beard hook and the free end of the latch, the latter being in its fully open condition.

Advantageously, according to the invention, provision is made for inserting the terminal length of the linking thread, that is the one for making the hook-up, inside the article, after having executed the knots for the closing of the chain. Moreover, the linking thread may be either the same as used for the knitting of the article, without solution of continuity, or a different thread as fed by a corresponding reel other than that supplying the knitting thread.

As far as the apparatus for implementing the method is concerned, it comprises:

cam means for operating the lifting and respectively the lowering of a predetermined number of needles of a first and second partial courses of stitches, which means are in operative condition when the knitting cams are inoperative, and vice versa;

means for removing the stitches of the first partial course and overturning them through 180° about a diametral axis of the needles cylinder and, besides, for removing the pairs of corresponding stitches from the needles of the second partial course, with a pair of spikes for each stitch, respectively pair of corresponding stitches, and at least a corresponding opening respectively closing peg, which pegs are slidingly received within corresponding slots of a semicircular sector: the sector being rotatively mounted to perform a 180° angular displacement thereof in both directions about a diametral axis of the needles cylinder at a position overlying the sinkers of the machine producing the article and supported by members allowing the transfer thereof from the knitting station to a station for linking the article toe;

cam means, located in correspondence of the knitting station, for driving the spikes and respectively pegs within the corresponding slots of the oscillating sector;

cam means for operating the 180° overturning in both directions of the semicircular sector about a diametral axis of the needles cylinder;

cam means for maintaining the sinker housing of the circular machine at a predetermined and constant angular position;

an actuation cylinder for operating the transfer of the member supporting the semicircular sector from the knitting station to the station for linking the article toe;

cam means, in correspondence of the knitting station, for driving the spikes and respectively pegs during the steps of presetting the stitches for the linking thereof and of expelling the finished product;

a seamer-linker to carry out the seaming-linking of pairs of corresponding stitches and making the knots to close the seaming-linking line;

means for finally cutting the seaming-linking thread;

means for holding the end of the linking thread after the cutting thereof.

Advantageously, according to the invention, means are provided for inserting the terminal end or tail of the linking thread, which results joined to the article, inside the latter.

The advantages obtainable from the present invention lie essentially in the fact that it is possible to perform the closing of the toe of a knitted tubular article, immediately downstream of the machine producing the article, and in a fully automatic way, thereby significantly reducing the time and cost of manufacturing; that some steps of the traditional process for closing the toe of the knitted tubular articles—such as the formation of the unthreading and relevant waste material, the transfer of the articles from the circular machine to the stocking stores or to the seamer-linker machines, the turning inside out thereof, the seaming of the toe and the subsequent turning right-side out thereof—are completely eliminated; that it is possible to automatically performing the linking of the article edges out of the knitting station and placing the linking means at a predetermined distance therefrom yet providing a single production unit; that it is possible to achieve a high degree of accessibility to the means of the knitting station and those of the linking station, as well as to the means for the transfer of the article from one to the other of the stations, which results particularly advantageous upon the assembly of the production unit and during the steps of maintenance and regulation of the various actuation means; that it is possible, during the linking of one article, to simultaneously operate the knitting of the next one, which brings about a remarkable reduction of the machine dwell times and an increase of the output thereof in terms of finished product; that it is possible to carry out the linking also using the stone thread as used for the knitting of the article, without solution of continuity, so as to avoid the cyclic "starting-up" of the hook-up, that is, the formation of the initial stitch of same hook-up, and the presence of the so-called tail of the linking thread; that it is possible to operate the linking with any stitch suited for making knitting articles, such as the "plain chain" stitch which exhibits an excellent elasticity and allows using most of the threads available on the market; that it is possible to perform the closing of the sock toe with seams of various types of contour, such as the "fish mouth" or shark mouth", in addition to those of traditional type; that it possible to carry out the linking on the side of either the back or sole of a sock by simply providing a pocket of fabric on one side or the other of the article with respect to its heel; that upon completion of the linking of the toe, the article results in its final right-side out; that the finished product if of the best quality, from both the aesthetical and functional point of view, since also the seam is knitted and joints the two edges of the toe without any increase in its thickness; that an apparatus according to the invention is of high reliability even after a prolonged use thereof; that any traditional circular machine can be provided with the apparatus without radically altering its basic functional and constructional structure.

BRIEF DESCRIPTION OF THE DRAWINGS

These and other advantages and characteristics of the invention will be best understood by anyone skilled in the art from a reading of the following description in conjunction with the attached drawings given as a practical exemplification of the invention, but not to be considered in a limitative sense, wherein.

DETAILED DESCRIPTION OF THE PREFERRED EMBODIMENT

Figure 1A:
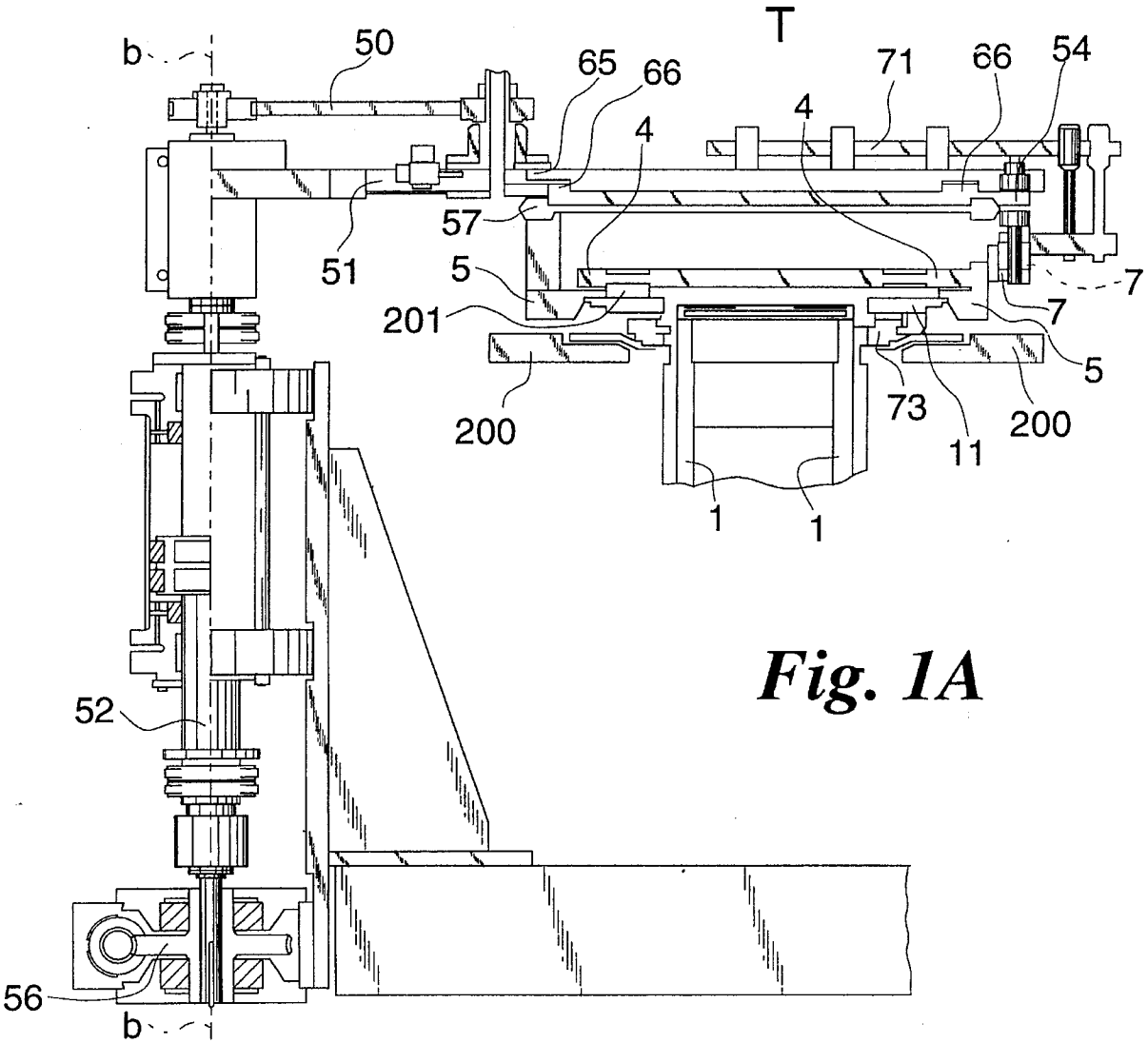
FIG. 1A is a schematical view in longitudinal section showing an apparatus, according to a first embodiment of the invention, upon the beginning of the cycle for the closing of the toe of the tubular article.
Figure 1B:
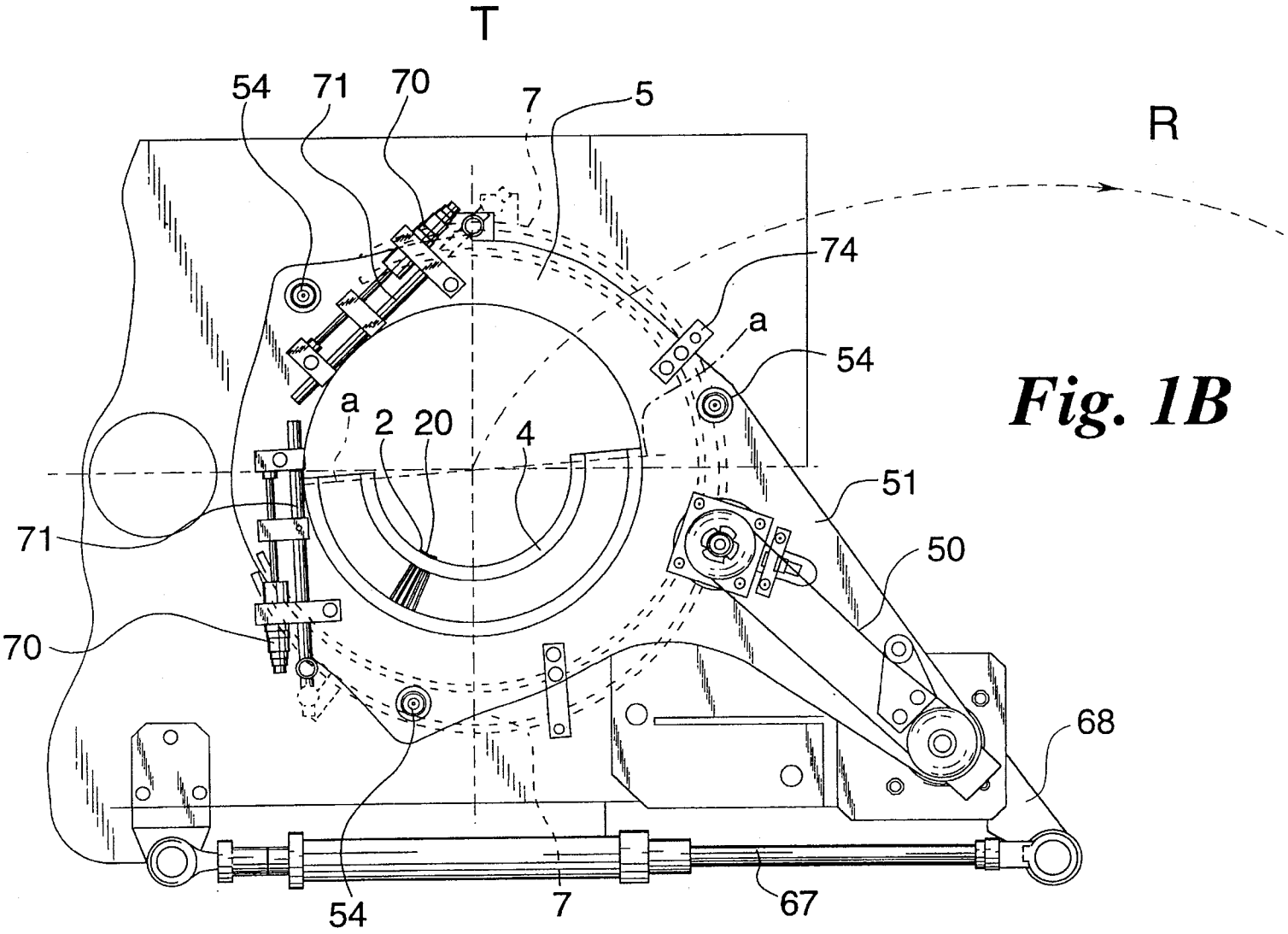
FIG. 1B is a plan view of the means for the transfer of the article from the knitting station to the linking station, in the apparatus of FIG. 1A.
Figures 1C, 1D:
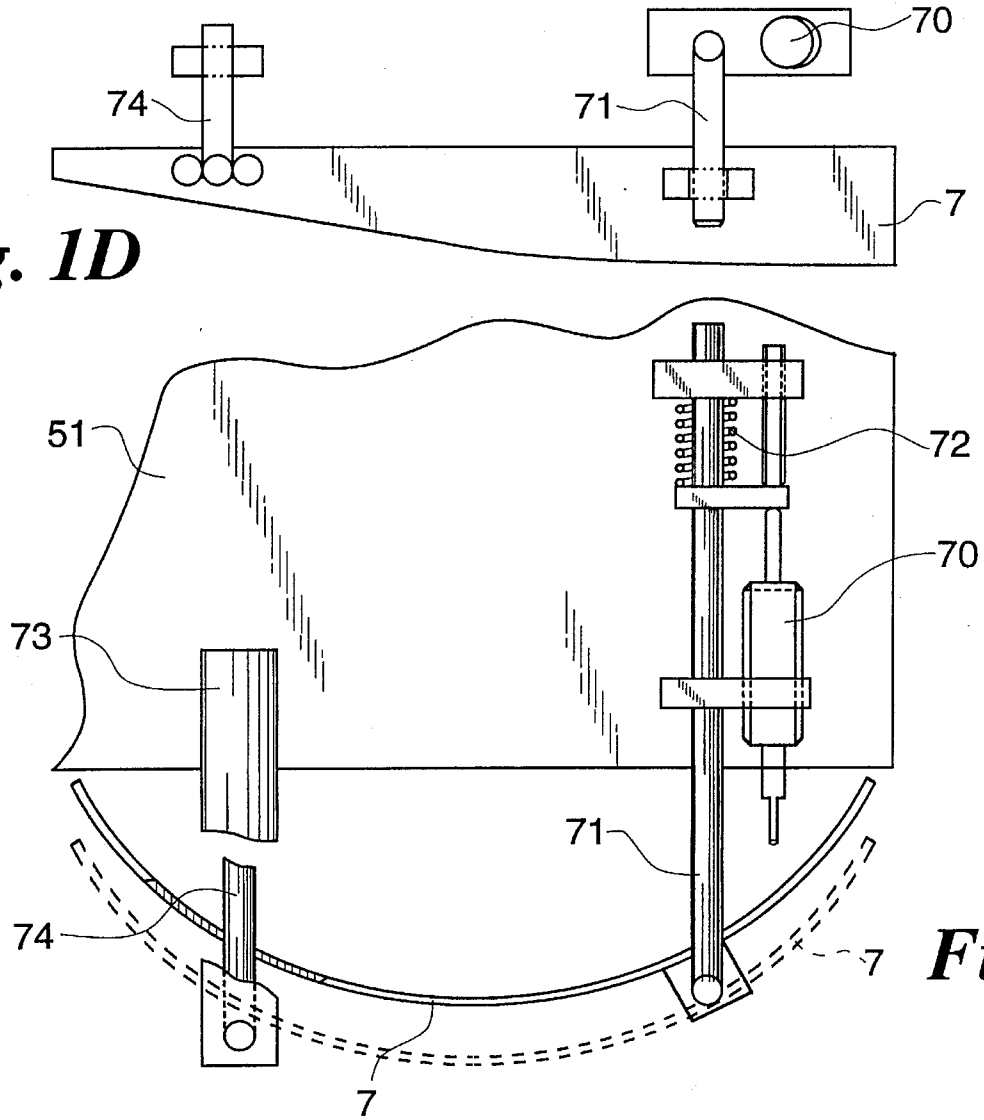
FIG. 1C shows in detail the cams and relevant drive means for operating the overturning of the semicircular sector of the apparatus of FIG. 1A.
FIG. 1D is a side view of the means of FIG. 1C.

Reduced to its basic structure and reference being made to the attached drawings, a method for joining the two edge, of a knitted tubular article, especially the closing of the toe of a sock, and comprising the step of manufacturing beforehand a knitted tubular article—starting from the elastic hem and finishing on the side of the toe which is left open—by means of a single-cylinder circular machine, includes afterwards the following operating steps:

lifting a predetermined number of a first set of needles 3 of a first partial course x of the last-to-form stitches, until the corresponding stitches 8 reach a level suitable for the subsequent removal thereof;

lifting a predetermined number of a second set of needles 30 of the second partial course y of the last-to-form stitches, until the corresponding stitches 80 reach a level slightly above that of the nib 60 of the sinkers 6;

removing the thus lifted stitches 8 of the first partial course x from the first set of needles, with the assistance of corresponding transfer means or device, and lowering the corresponding needles 3;

transferring the thus removed stitches 8 through a 180°-overturning of the cylinder 1 of the needles 3,30 about a diametral axis a—a of the tubular article as shown in FIG. 1B, so that each thus overturned stitch will fit the corresponding needle 30 of the second partial course y;

lifting the needles 30 together with the stitches 80 of the second partial course y so as to load thereon also the thus transferred stitches 8 of the first partial course x by releasing the latter from the relevant transfer means; and thereafter:

lowering the needles 30 of the second partial course y, with the sinkers 6 of the machine being open, so as to move the stitches 8,80 of the first and second partial courses, thus predisposed in retained position, to a level below that of the nib 60 of sinkers 6;

bringing the stitches 8-transferring means back to the respective initial position through a 180°-overturning thereof in a direction opposite to the previous one, about the axis a—a;

disposing the transfer means in correspondence of the needles 30 of the second partial course y through a 180° rotation with respect to the cylinder 1 about the longitudinal axis of the cylinder and tubular article;

lifting the needles 30 of the second partial course y, with the sinkers 6 being closed, so that the corresponding pairs of stitches 8,80 of the first and second partial courses will result retained by the sinkers 6 in a predetermined position with respect to the stem of the relevant needles 30;

lifting further the needles 30 of the second partial course y, with the sinkers 6 being open, until the pairs of stitches 8,80 reach the operative level or transfer position of the means for the removal and transfer of the stitches 8 of the first partial course x, so that the pairs of stitches 8,80 will result removable by the means;

lowering the needles 30 of the second partial course y, so as to allow the transfer means to remove the pairs of stitches 8,80 and the article to be therefore completely detached from the needles 30 of the second partial course;

transferring the article thus released from the knitting machine and with the stitches 8,80 thus retained, through a rotation of predetermined angular amplitude about a vertical axis b—b, so as to locate it at a preset distance from the needles cylinder 1 in a linking station R;

disposing the stitches 8,80 of the thus transferred article spaced apart of a constant angular distance and circular pitch, as established according to the required hook-up fineness, by moving the relevant removal and transfer means in centripetal direction with respect to the partial courses x,y of the article to be linked;

linking the corresponding pairs of stitches 8,80 thus disposed and retained by the removal and transfer means using a linking thread F to form a chain, and making one or more chain-closing knots;

cutting the linking thread F;

releasing the thus linked pairs of stitches 8,80 of the first and second partial courses and unloading the finished article.

Advantageously, according to the invention, at the end of the article transfer from the knitting T station to the linking R station, provision is made for positioning the stitches 8,80 with removal means at a level allowing them to be moved by corresponding driving means, so as to dispose the stitches 8,80 in the desired position and release them after the linking operation.

Moreover, advantageously, and according to the invention, provision is made for inserting the tail of the linking thread F inside the article, after the formation of the chain-closing knots and before releasing the finished product.

Figure 48:
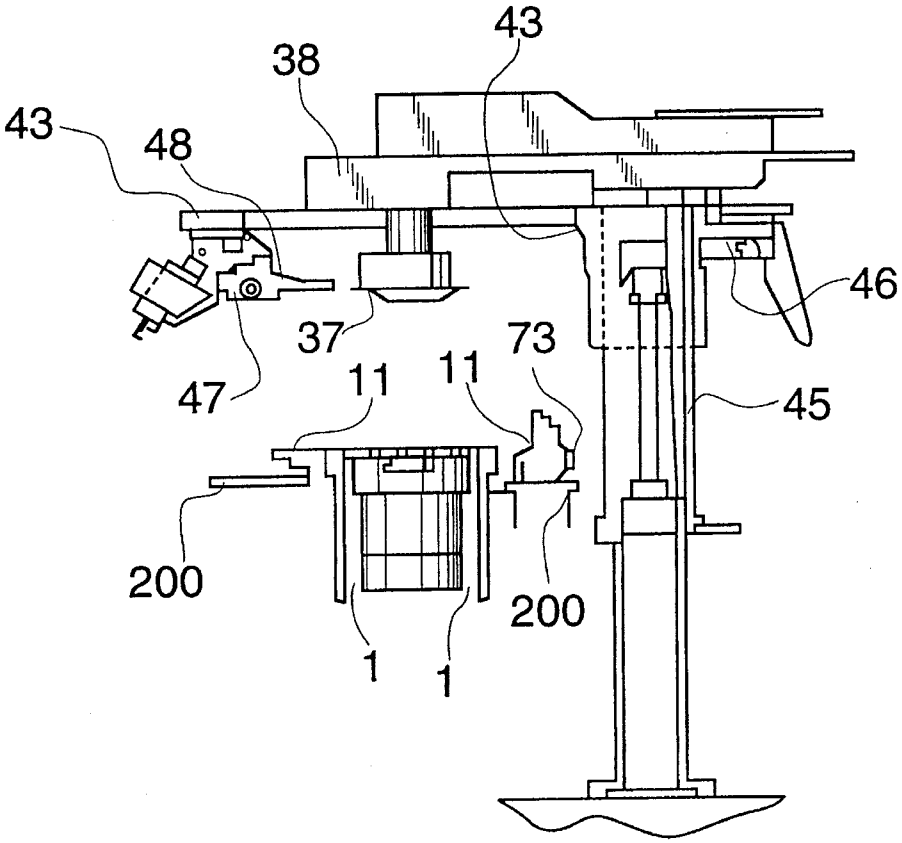
FIG. 48 shows the machine of FIG. 46 with the plate moved away from the needles cylinder.
Figure 47:
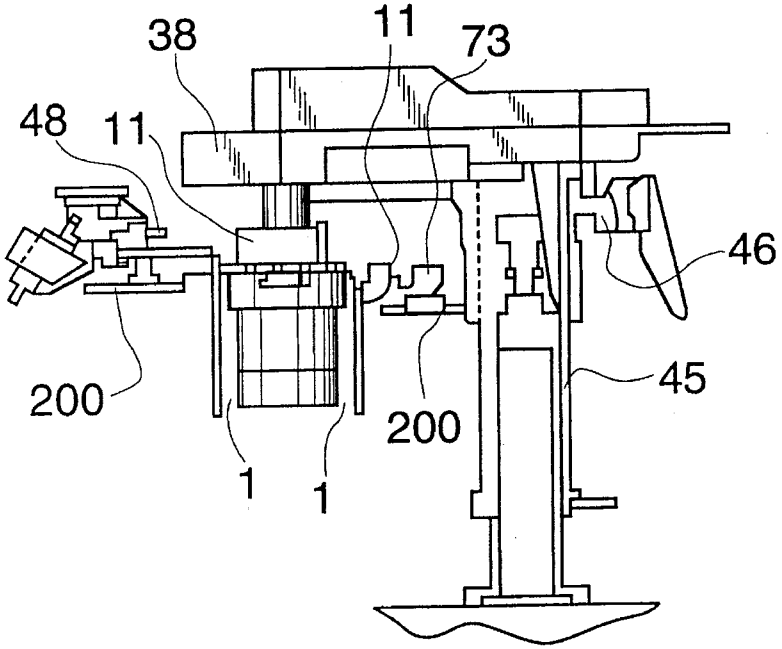
FIG. 47 shows a machine according to the invention in knitting attitude, with the plate in proximity of the needles cylinder.

With reference to FIGS. 47 and 48 of the attached drawings, upon completion of the knitting of the article, provision is made for advantageously moving the plate away from the knitting head of the machine.

Figure 2A:
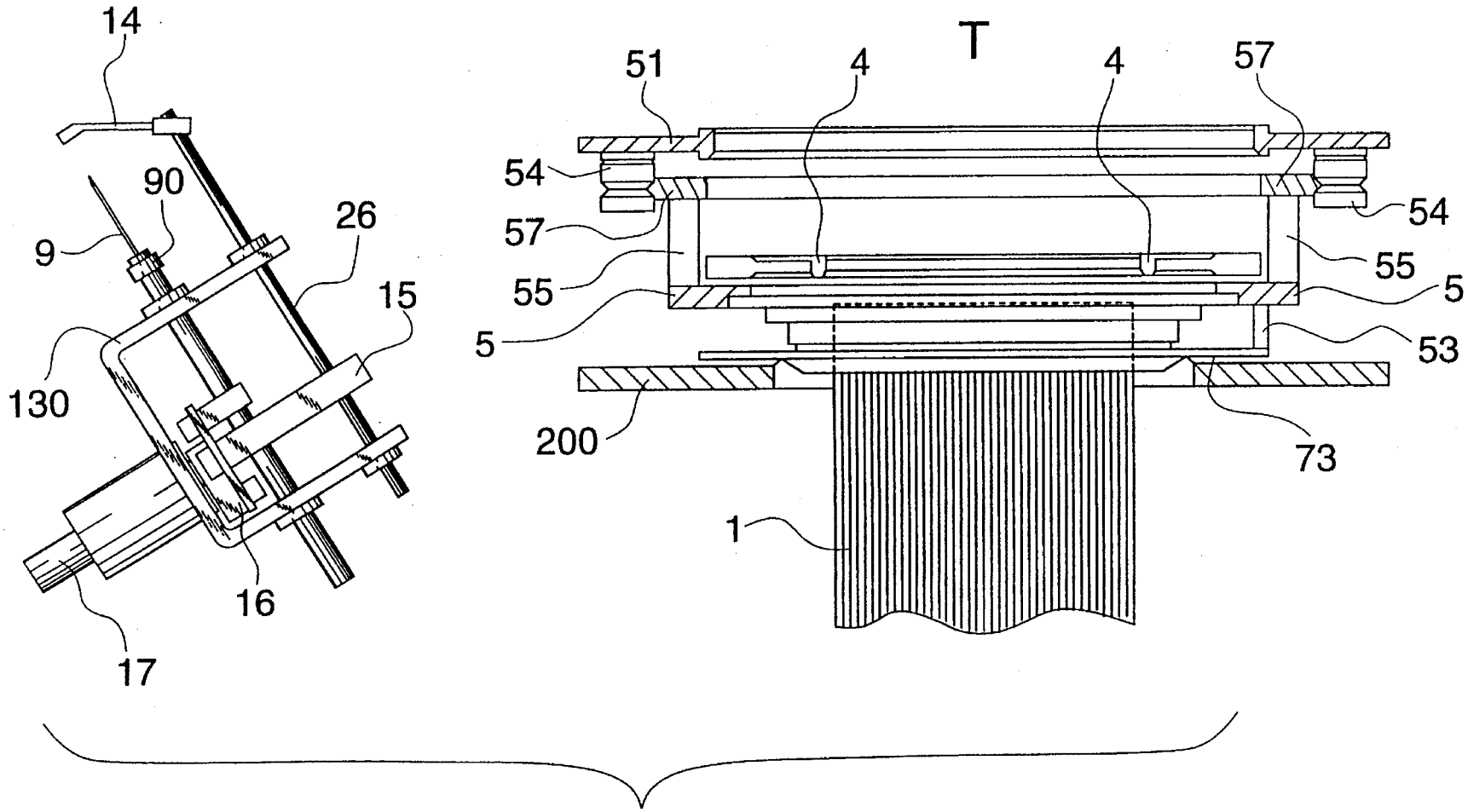
FIG. 2A shows schematically the means of FIG. 1B, with the linking means in stand-by condition.
Figure 2B:
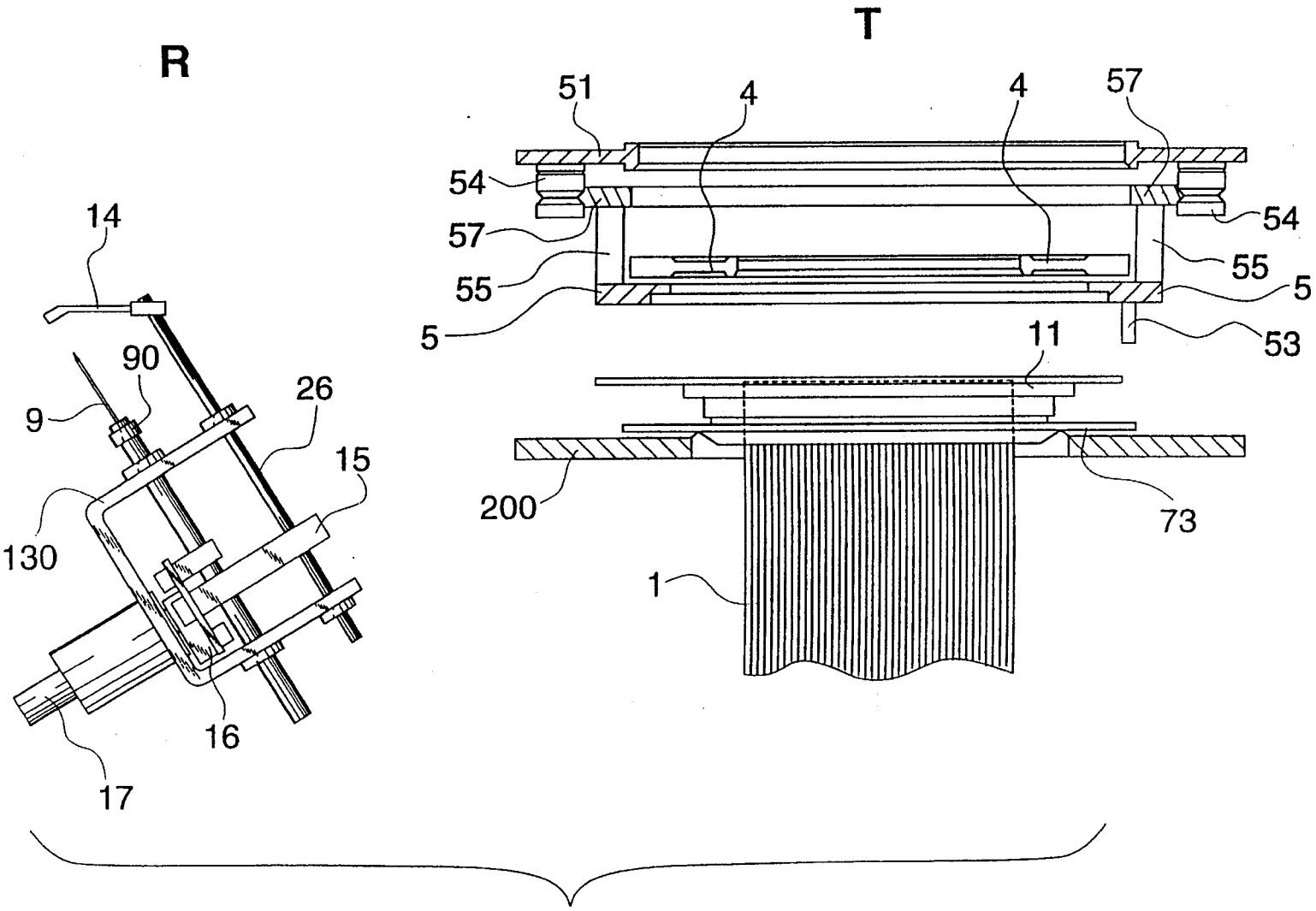
FIG. 2B shows the means of FIG. 1B as detached from the knitting head of the machine, with the linking means in stand-by condition.
Figure 2C:
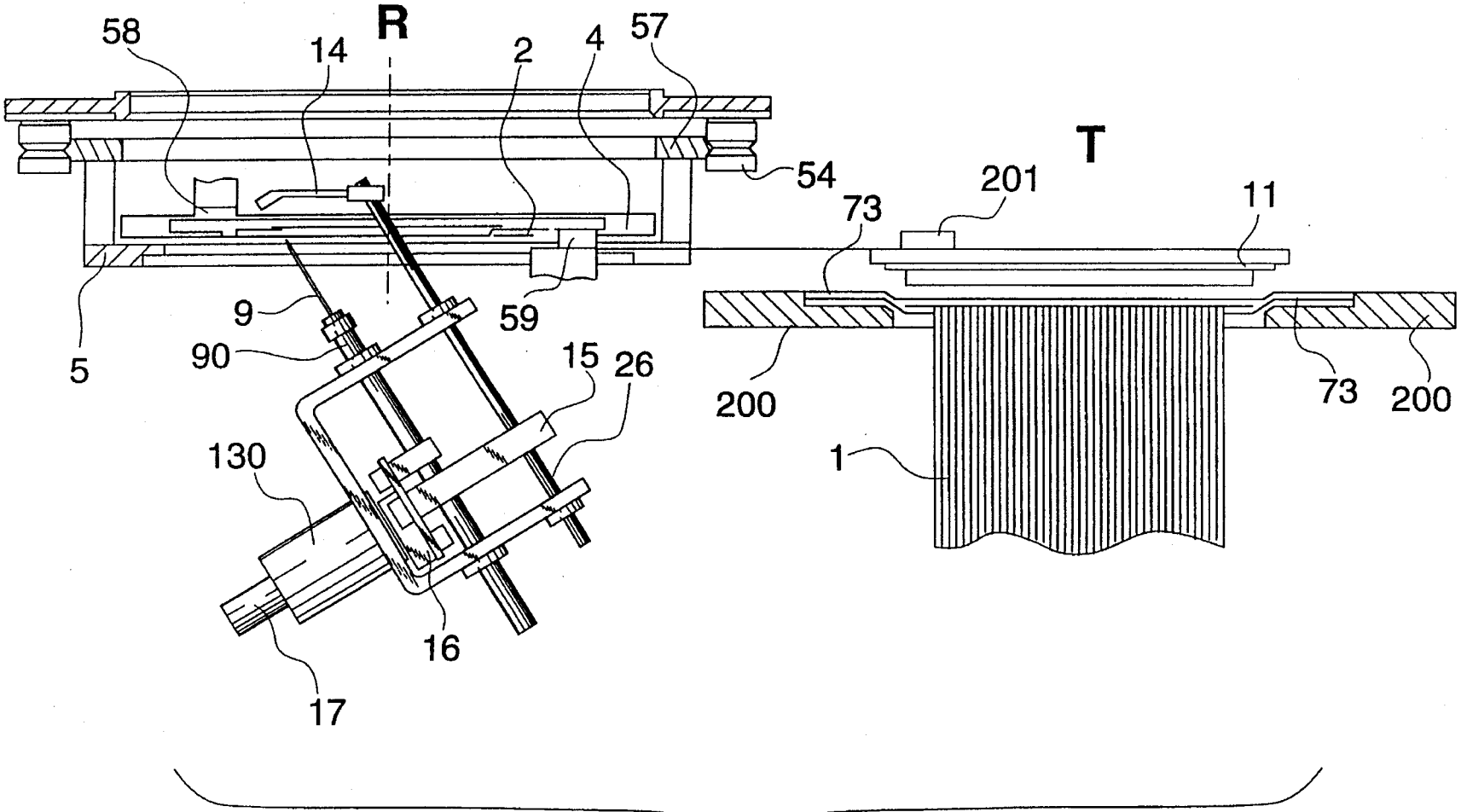
FIG. 2C shows the means of FIG. 1B during the linking of the article toe, with the linking means in active condition.
Figure 2D:
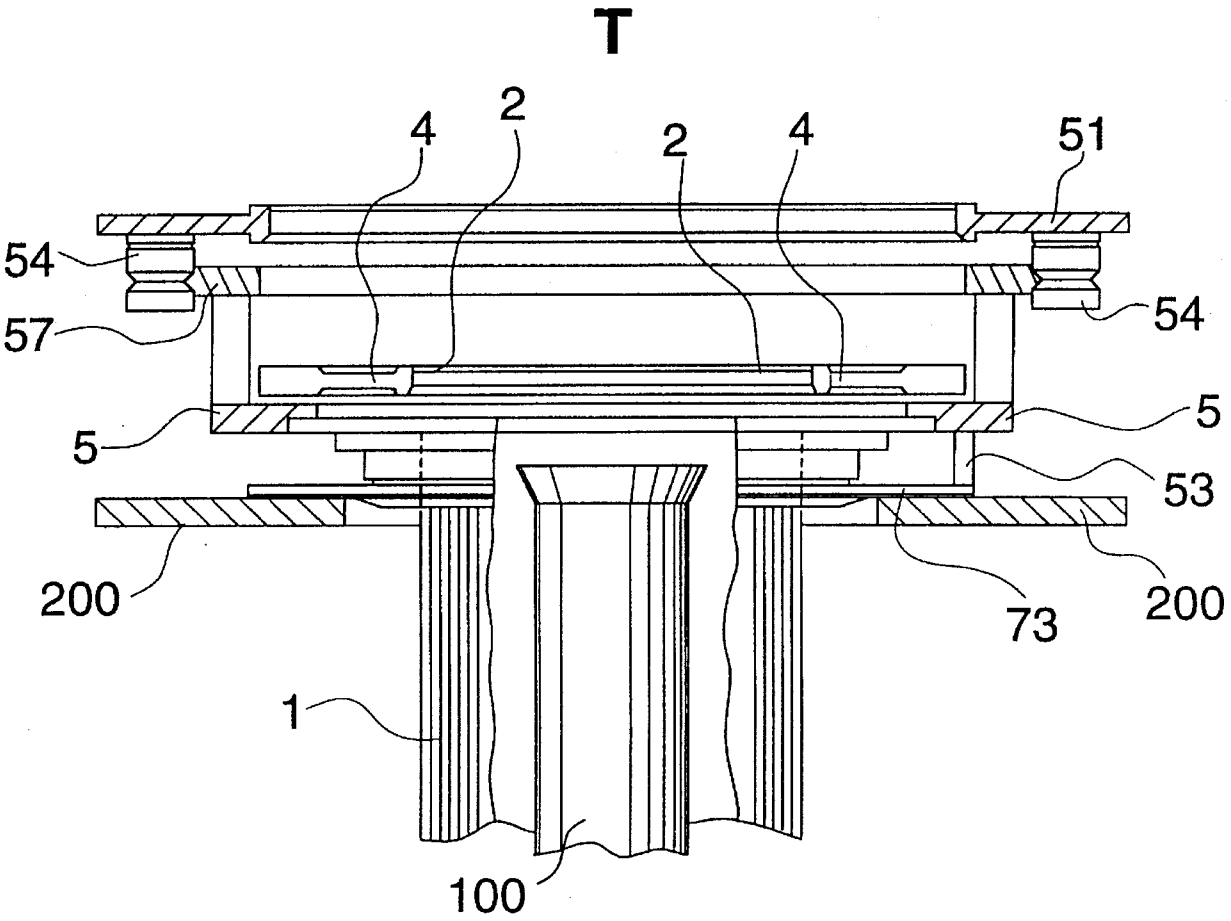
FIG. 2D shows schematically the step of FIG. 2A with the suction hose of the knitting machine in normal, that is, lowered position.
Figure 2E:
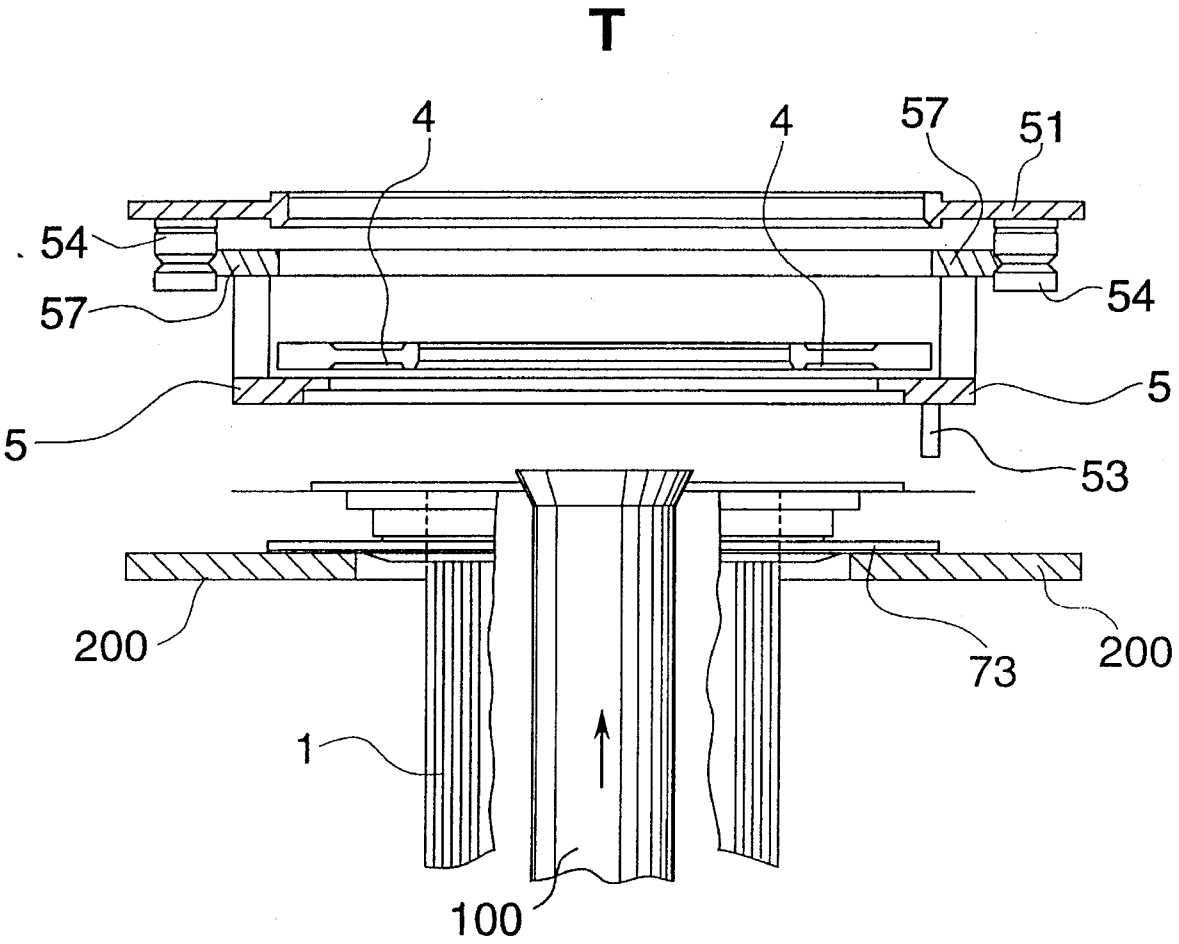
FIG. 2E shows the step of FIG. 2B with the suction hose in lifted position.

According to the invention, and with reference to FIGS. 2D and 2E of the attached drawings, provision is also made, during the step of transferring the article from the knitting station T to the linking station R, for advantageously breaking off the suction of the article, operated inside the needles cylinder upon the knitting, and lifting the corresponding suction hose 100 up to a predetermined level, so as to protect the article and prevent the engagement thereof with such members of the machine as the sinkers 6.

Figure 6A:
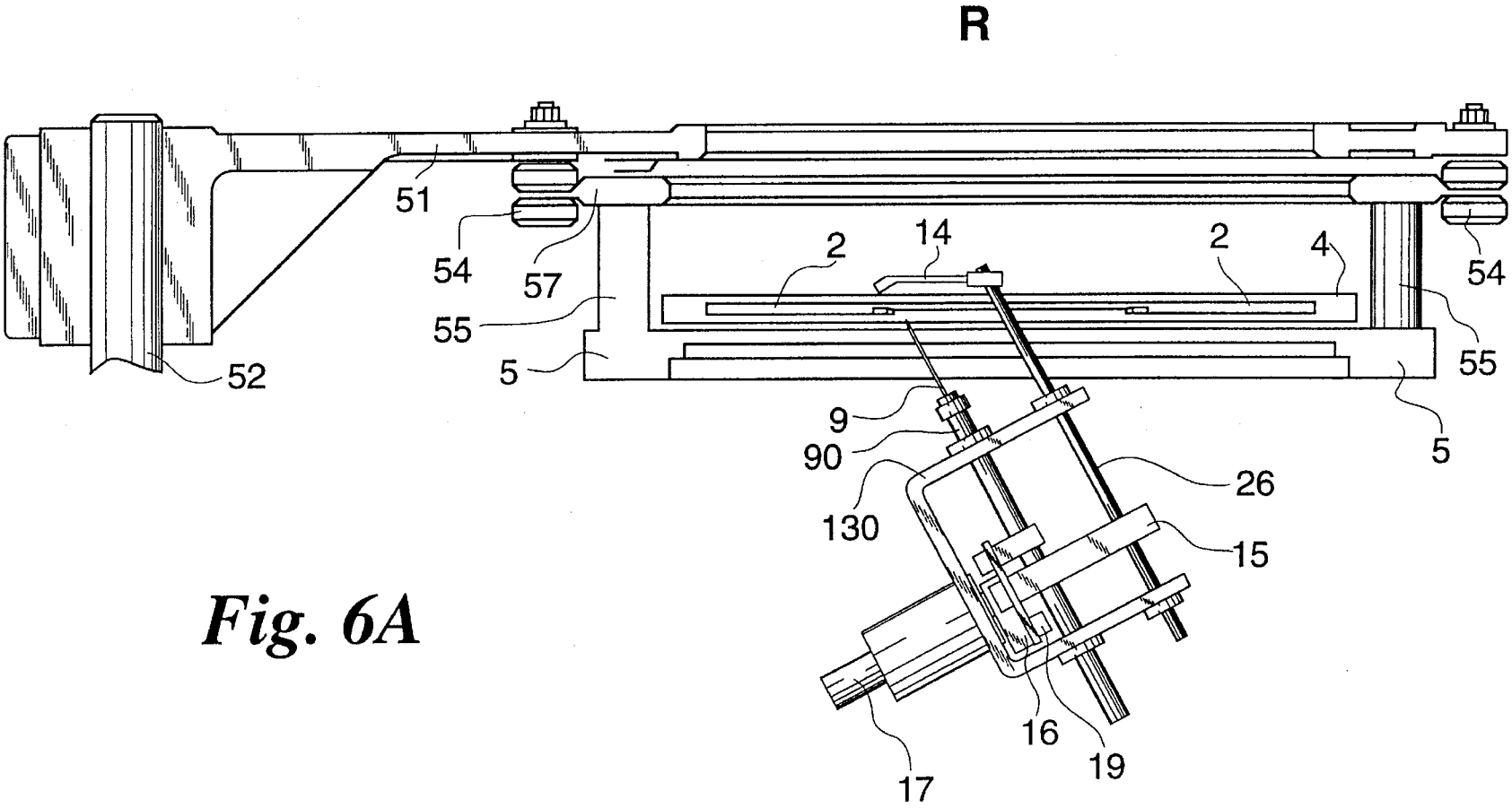
FIG. 6A is a view in partial longitudinal section showing the article toe-linking station with the means of FIG. 3C in linking attitude.
Figure 6B:
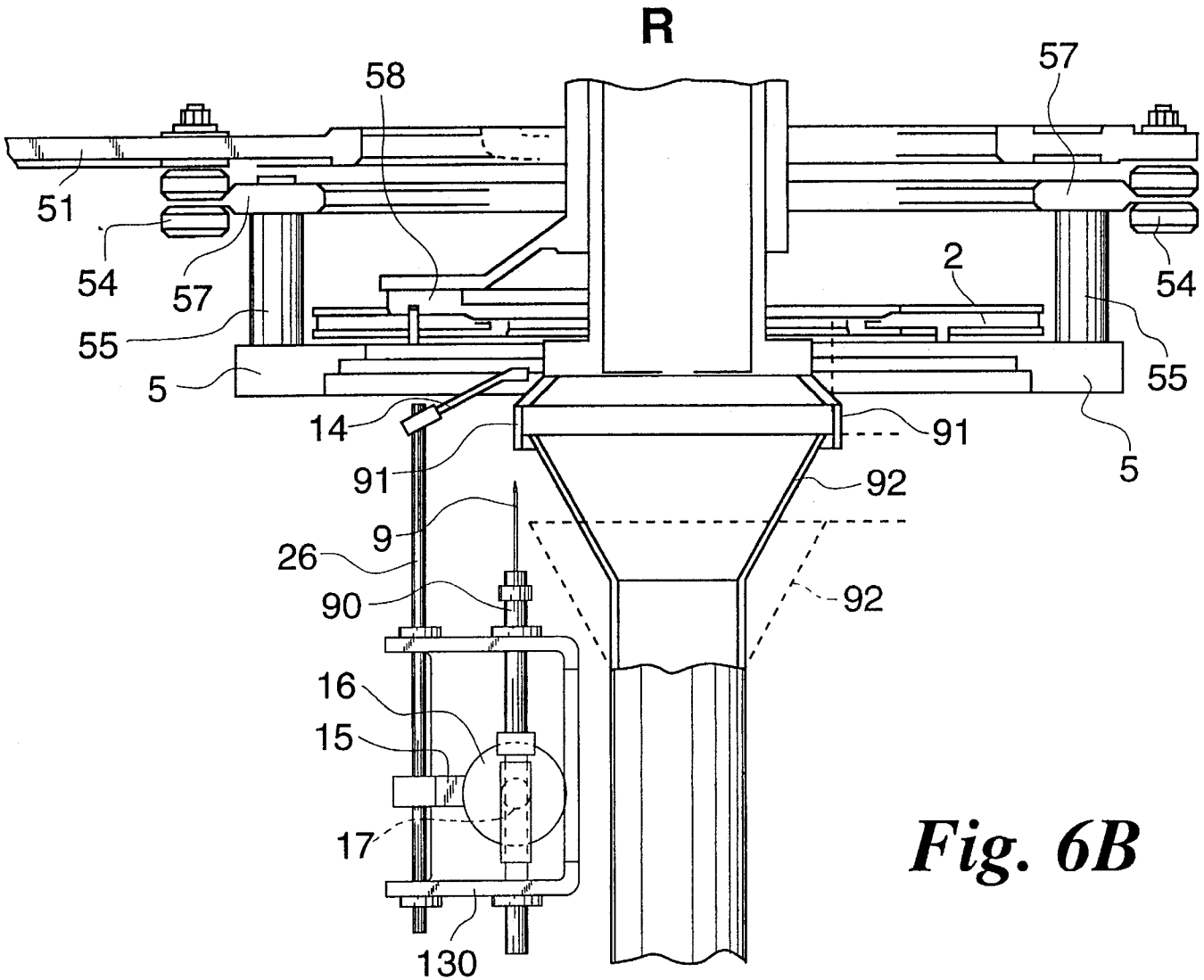
FIG. 6B is a view showing in detail the linking of the article toe according to an alternative embodiment.

Advantageously, according to the invention, during the linking, that is the formation of the hook-up of the article, provision is made for activating a downwardly directed suction of the air by a corresponding hose 92, as shown in FIG. 6B, coaxial to the article. This allows the stretching thereof during the linking.

Moreover, provision is made, during the linking step, to insert the needle 9 as shown in FIGS. 2A, 2B, 2C, 6A, 6B, etc.—into the individual pairs of stitches 8,80, as shown in FIGS. 4, and 14–33, to be united at an angle to the direction of the common axis of the two stitches 8,80. In this way, the positioning of a crochet 14, as shown in FIGS. 2B, 2C, 6A, 6B, etc., and a chain-guide 10 as shown in FIGS. 6C, 6D, 34–39, to cooperate with the needle 9 for the formation of the hook-up stitches and chain-closing knots is made easier.

Besides, the linking thread F, shown in FIGS. 34–39, is advantageously the same as used for the knitting of the article, without solution of continuity. Alternatively, the linking thread F may be fed by a reel other than that provided for the knitting.

Figure 6C:
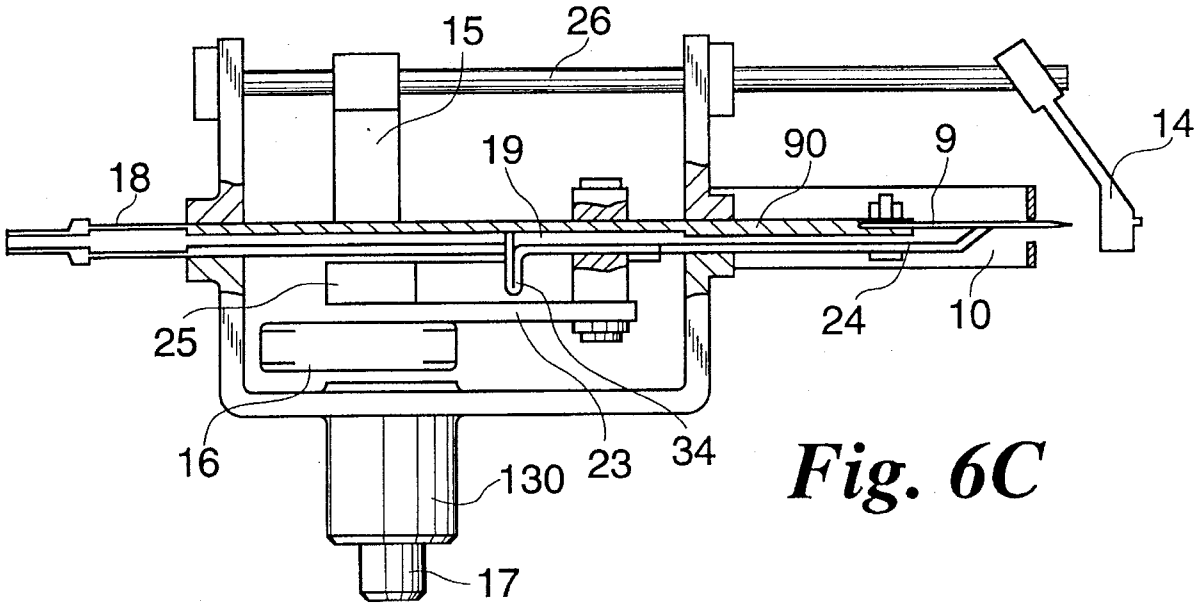
FIG. 6C shows in detail a seamer with a compound, that is skidded needle to carry out the linking operation.
Figure 6D:
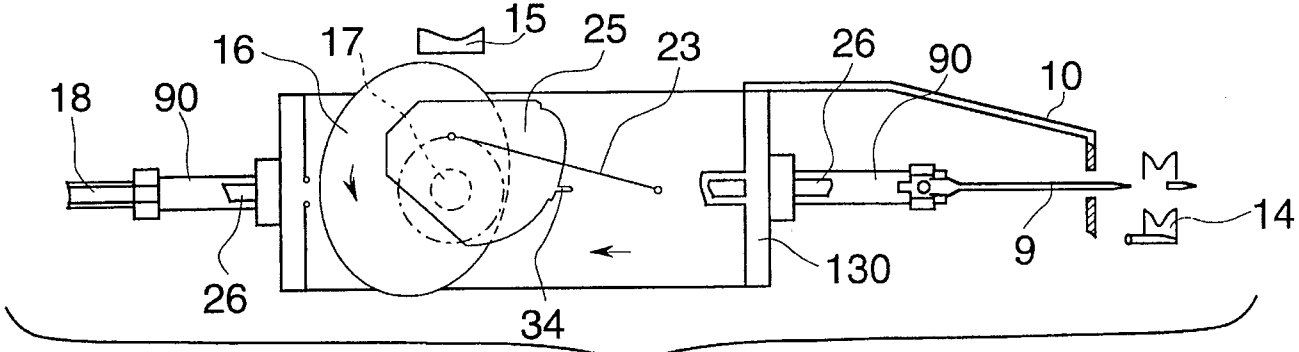
FIG. 6D is a plan view of the detail of FIG. 6C.
Figure 6F:
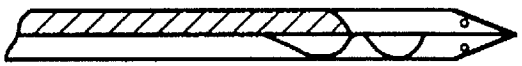
FIG. 6F shows in detail the linking needle, partially in section, with the closing skid of the respective beard hook.
Figure 6E:
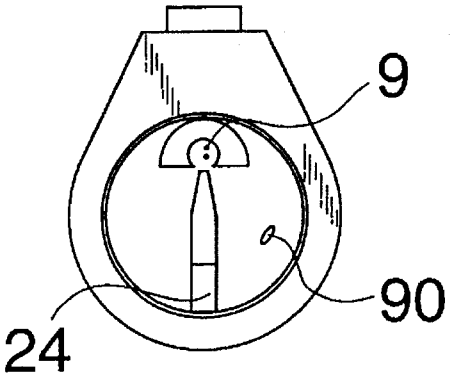
FIG. 6E is a front view of the needle bar, with relevant auxiliary members, of the seamer of FIG. 6C.
Figure 7A:
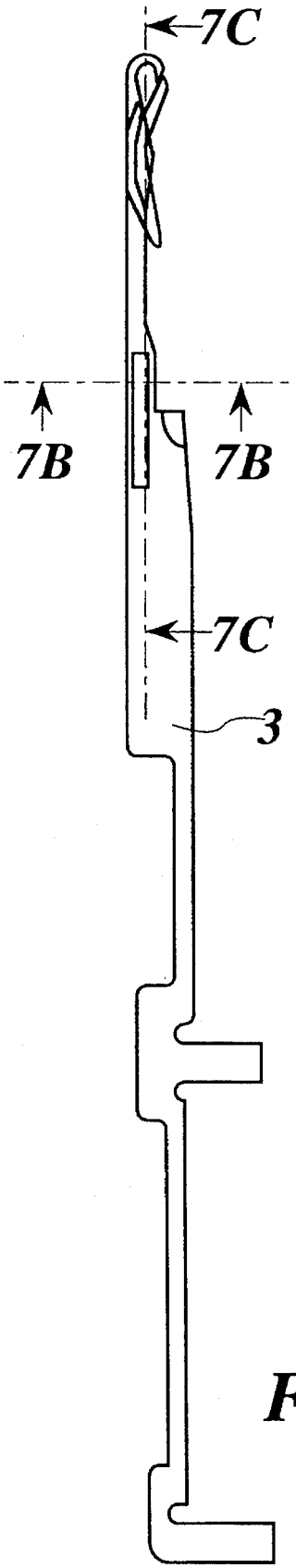
FIG. 7A is a side view of a needle of the knitting cylinder of the circular machine.
Figure 7C:
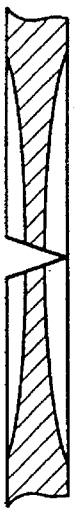
FIG. 7C is a section on line 7C—7C of FIG. 7A.
Figure 7B:
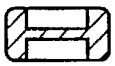
FIG. 7B is a section on line 7B—7B of FIG. 7A.
Figure 8A:
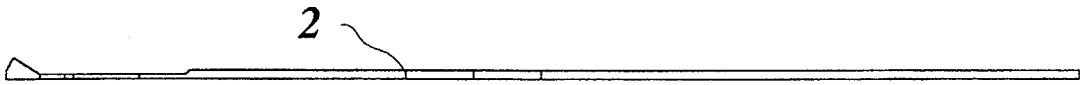
FIG. 8A is a plan view of a spike for the removal and overturning of the stitches, with its head turned to the right hand side.
Figure 8B:
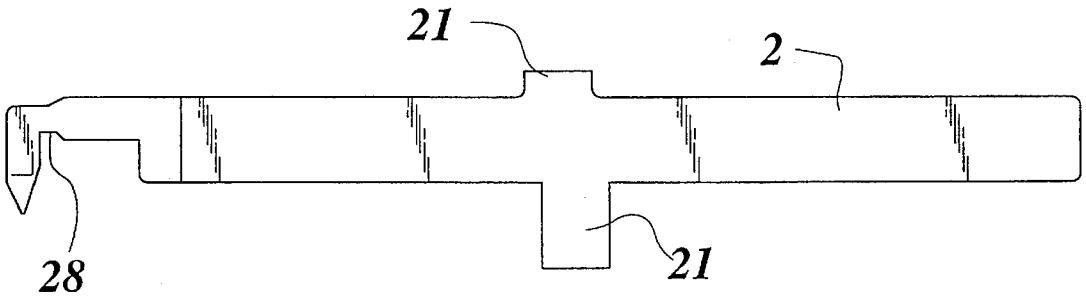
FIG. 8B is a side view of the spike of FIG. 8A.
Figure 9A:
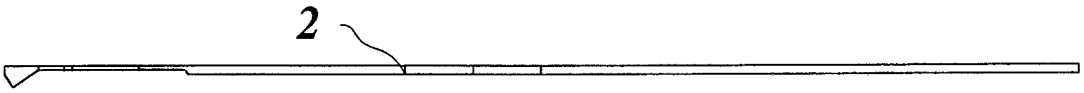
FIG. 9A is a plan view of the spike complemental to that of FIG. 8A, that is, with its head turned to the left hand side.
Figure 9B:
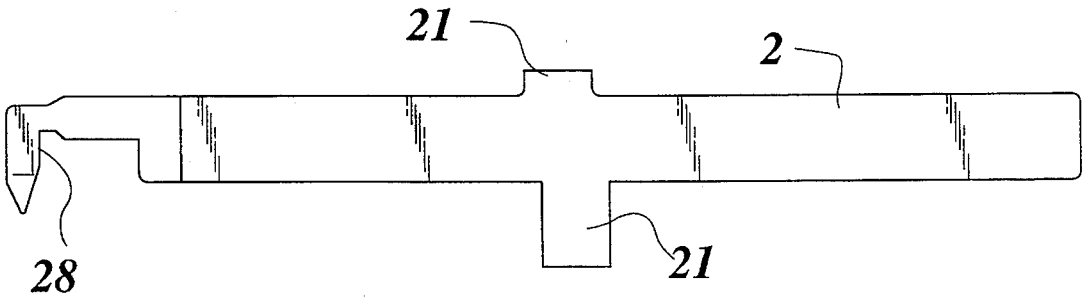
FIG. 9B is a side view of the spike of FIG. 9A.
Figure 10A:
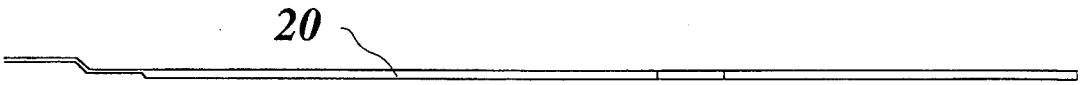
FIG. 10A is a plan view of the closing peg associated to the spike of FIG. 8A.
Figure 10B:
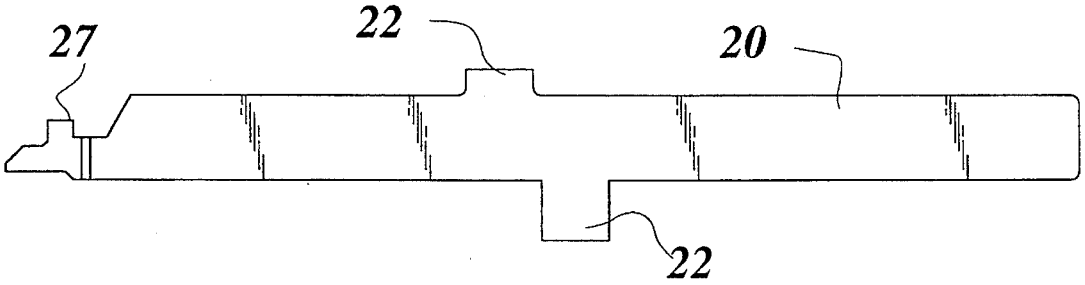
FIG. 10B is a side view of the peg of FIG. 10A.
Figure 11A:
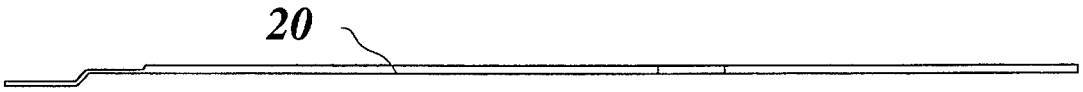
FIG. 11A is a plan view of the closing peg associated to the spike of FIG. 9A.
Figure 11B:
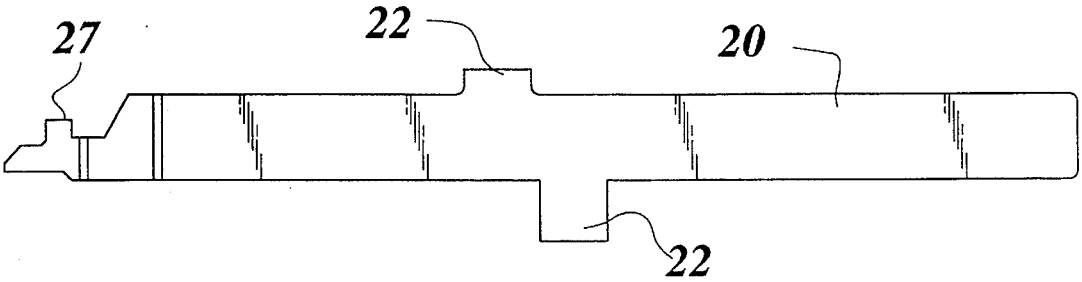
FIG. 11B is a side view of the peg of FIG. 11A.

An alternative embodiment of the invention is shown in FIGS. 6B and 6C of the attached drawings. The linking of the edges of the article is operated upon the removal of the stitches 8,80 to be united, by means of a semicircular front of hook-up spines 91 so as to load the stitches 8,80 thereon before operating the union of same stitches. The thus performed linking operation for the formation of the hook-up, ensures the same quality results as those obtained from the traditional method. During this step provision is made for lifting the suction hose 92, which ensures the stretching of the article during the linking, so as to allow the same article to take up the most suitable attitude and prevent an accidental unthreading of the stitches 8,80 from the front of spines 91. Upon completion of the hook-up, provision is made for lowering the hose 92 to unload the finished product.

Figure 3A:
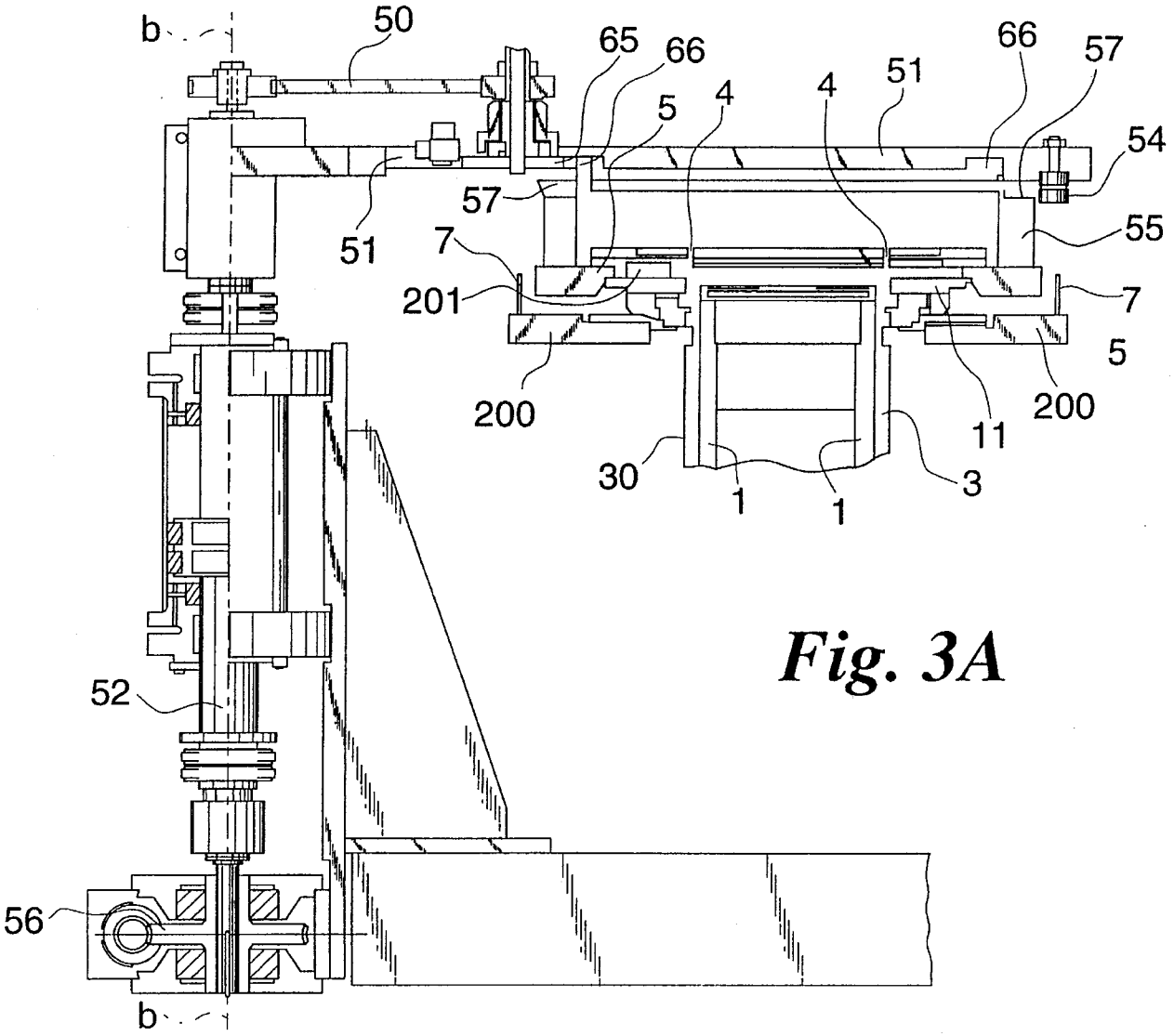
FIG. 3A is a side view of an apparatus as in FIG. 1A, according to an alternative embodiment.
Figure 3B:
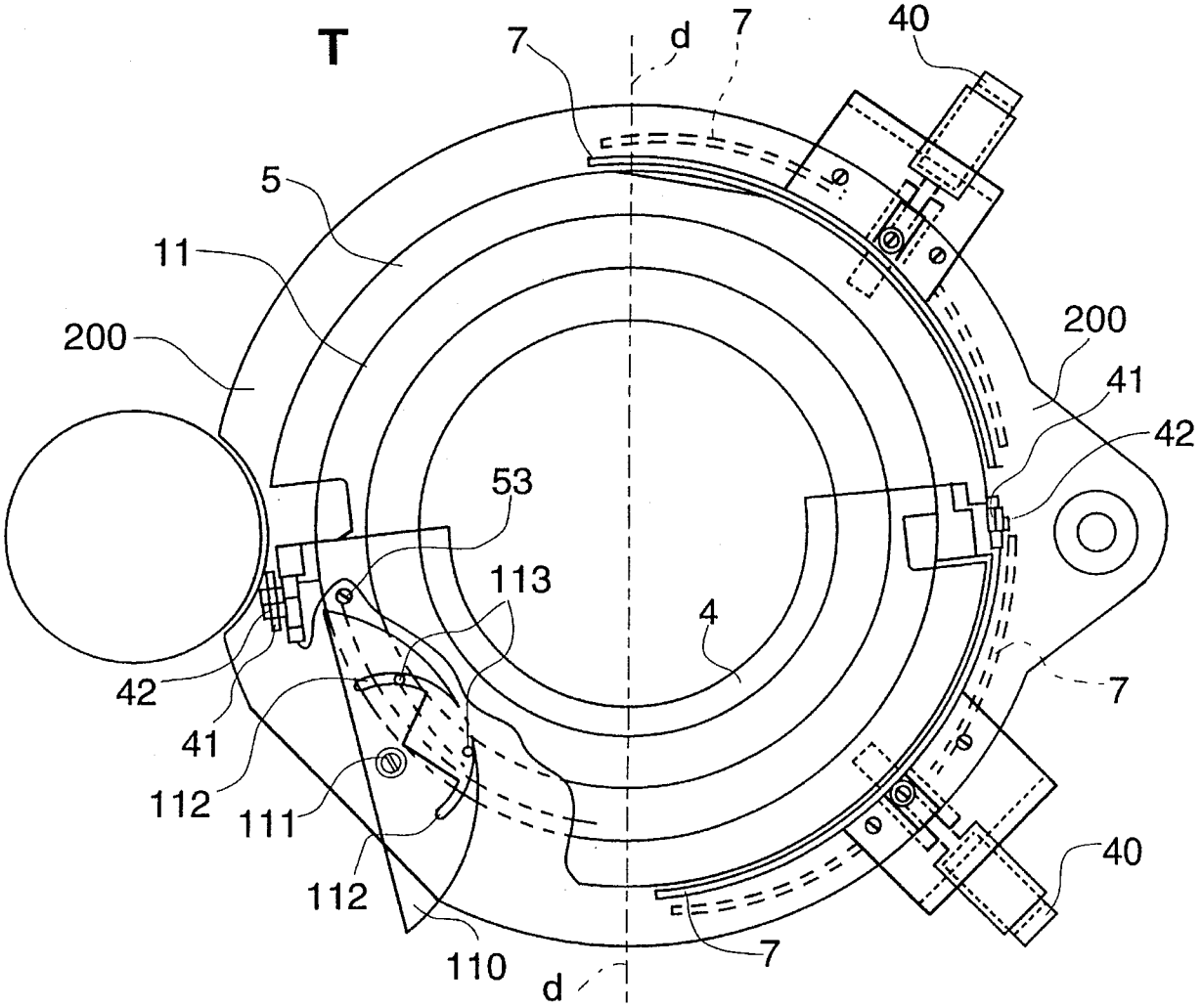
FIG. 3B is a plan view showing the oscillating semicircular sector, the relevant support member, the corresponding overturning means and the means for keeping the sinker housing in a fixed spatial position.
Figure 3C:
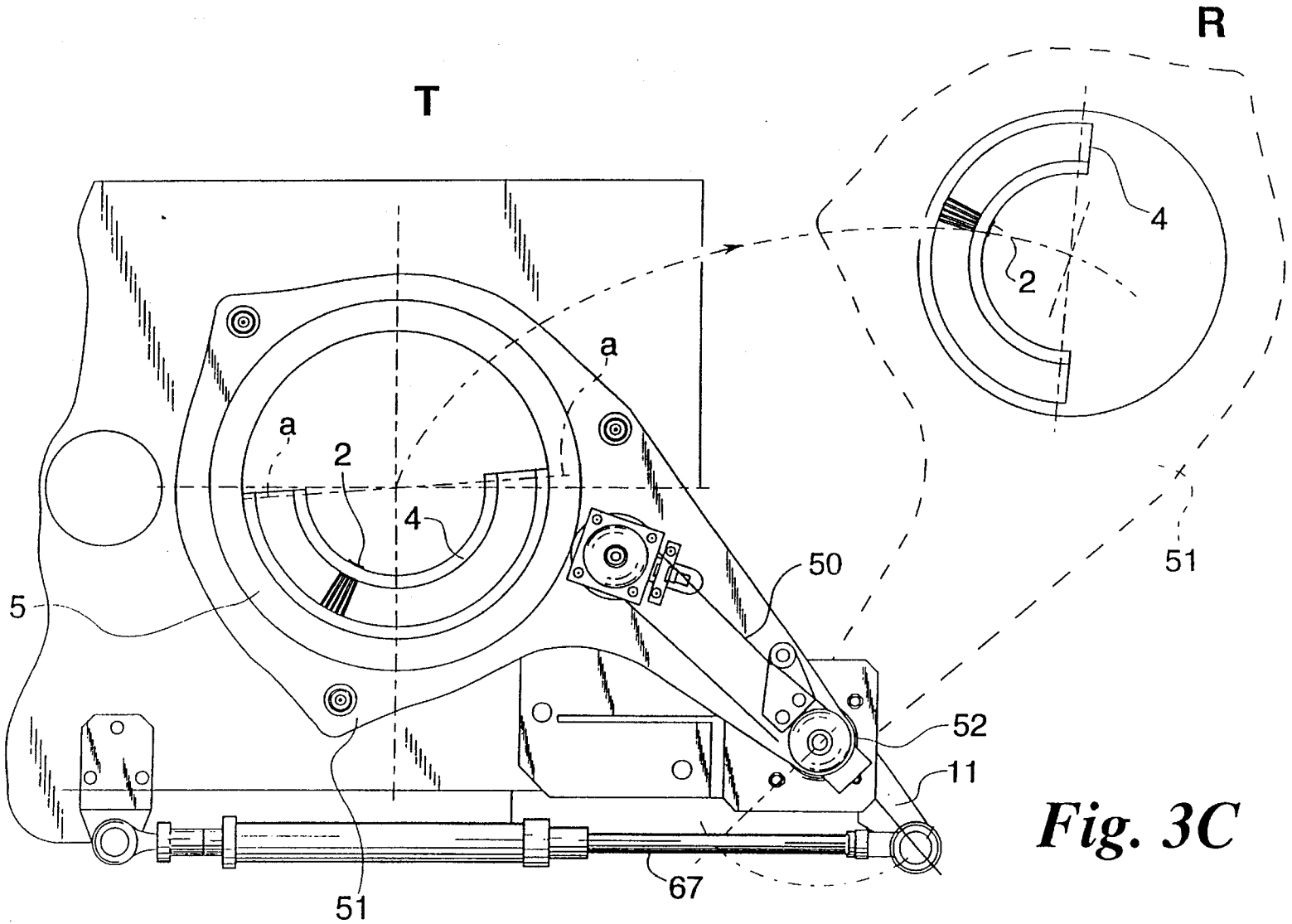
FIG. 3C is a plan view of the means for the transfer of the article from the knitting to the linking station in the apparatus of FIG. 3A.
Figure 3E:
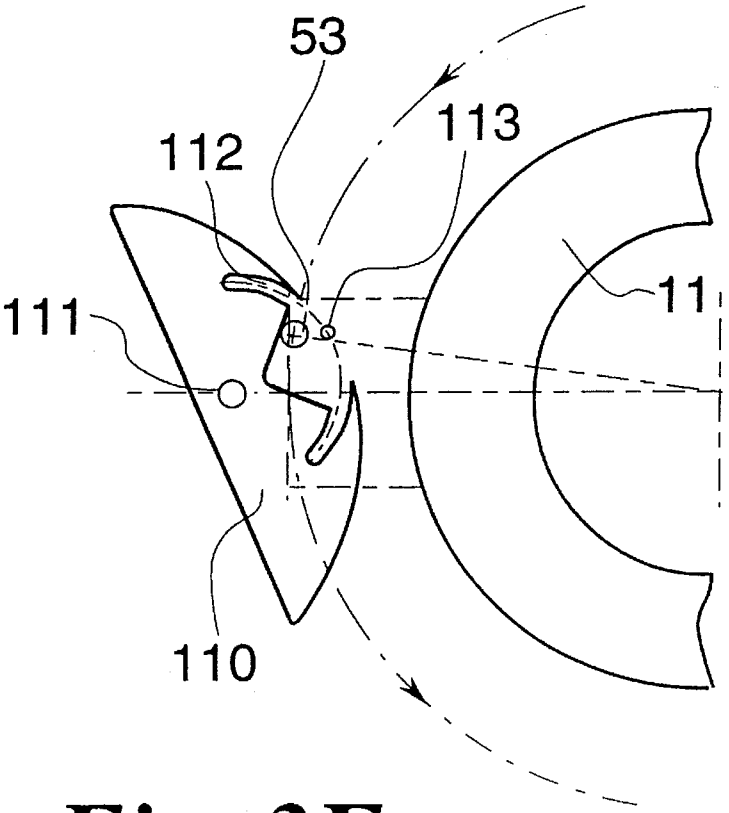
FIG. 3E shows in detail the means of FIG. 3D upon an intermediate step of their motion.
Figure 3D:
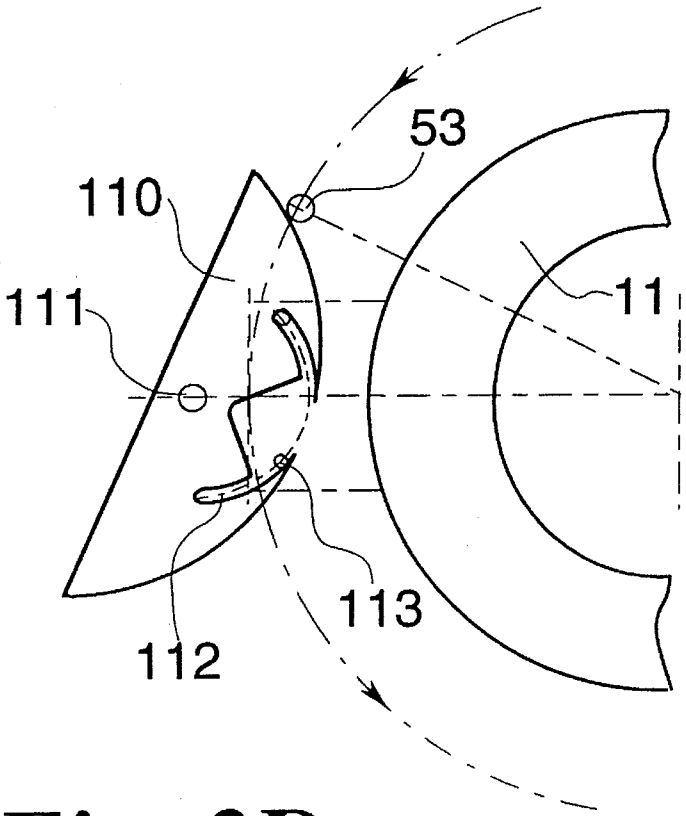
FIG. 3D is a view showing in detail the means for connecting the sinker housing with the machine, upon the initial step of their motion.
Figure 3F:
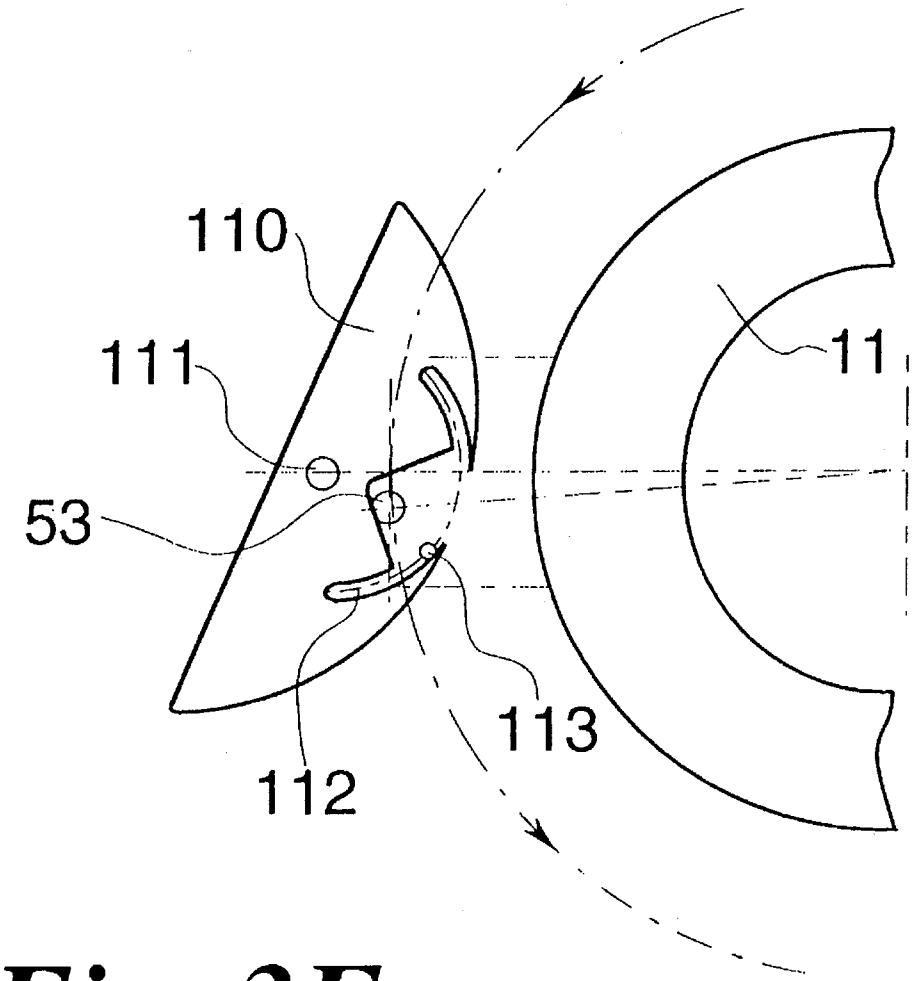
FIG. 3F is a view showing in detail the means of FIGS. 3D and 3E upon the final step of their motion, that is, of return to their initial position.
Figure 4:
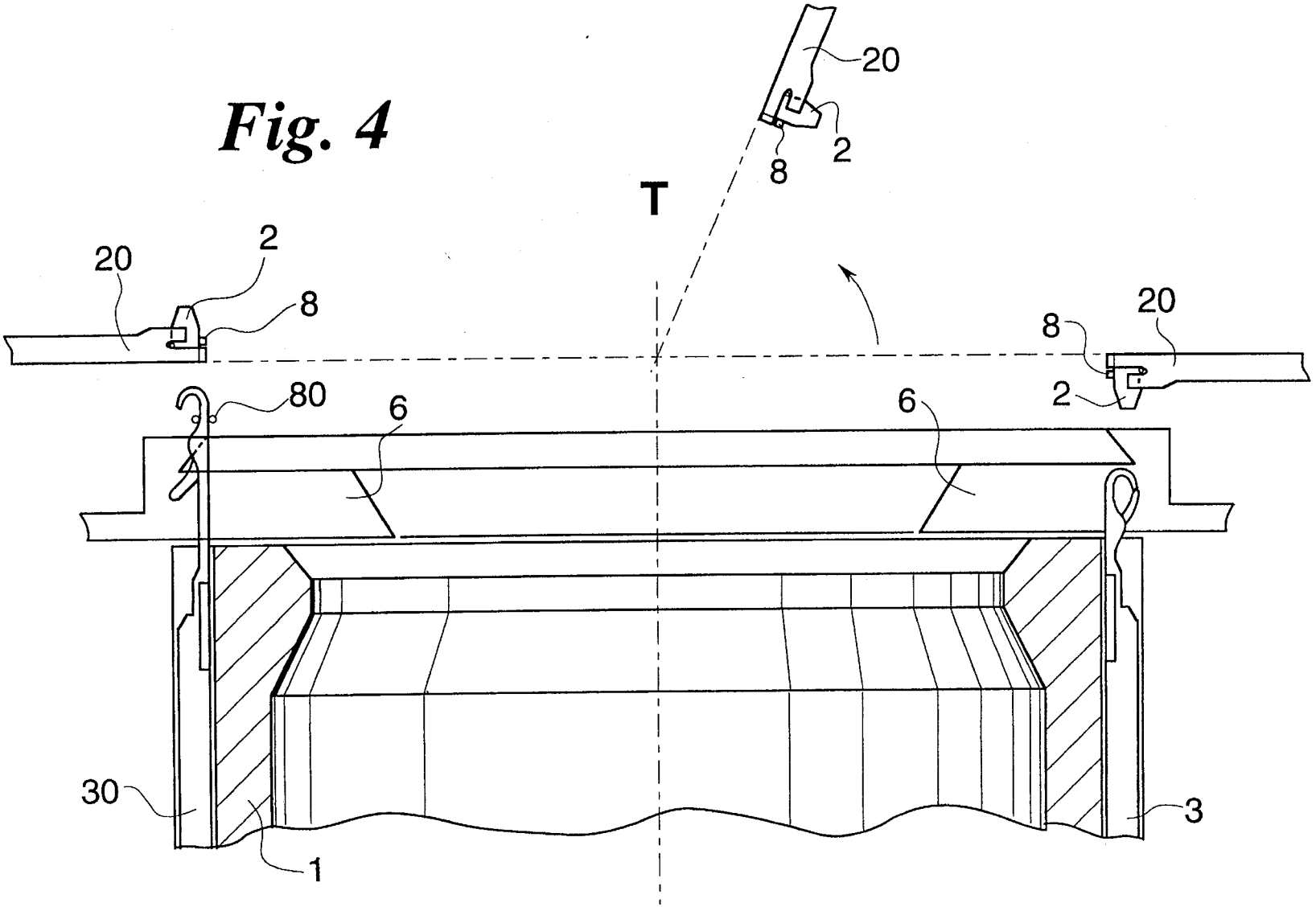
FIG. 4 is a schematic view in partial longitudinal section showing the needles cylinder of a machine provided with an apparatus according to the invention upon the step of overturning the oscillating sector for transferring the stitches of the first partial course onto the needles of the second partial course.

Moreover, with reference to FIGS. 33A–33H, according to an alternative embodiment of the described method, provision is made for operating—after transferring the stitches 8 of the first partial course x, as shown in FIGS. 34–39 and before transferring the article from the knitting station to the linking station—the insertion of the stitches 8 of the first partial course x into those 80 of the second partial course y. More particularly, after the interception of the stitches 8 by the needles 30 of the second partial course, provision is made for:

releasing the stitches 8 from the respective transfer means;

lifting the needles 30 of the second partial course so that each stitch 8 of the first partial course will result in retained position on the neck of the corresponding needle 30, and each stitch 80 of the second partial course will be disposed by the transfer means in the unloaded position, that is, below the free end of the open latch of the relevant needle 30;

withdrawing the transfer means;

lowering the needles 30 of the second partial course, with the sinkers 6 being open, down to the level of stitch formation, so as to insert each stitch 8 of the first partial course into the corresponding stitch 80 of the second partial course which is thus unloaded from the respective needle 30;

bringing the means for the removal and transfer of the stitches of the first partial course back into the respective initial position, through a 180°-overturning thereof in the direction opposite to the previous one, about the axis a—a, as shown in FIGS. 1B, 3C, of the cylinder and the tubular article 1;

disposing the transfer means in correspondence of the needles 30 of the second partial course y through a 180°-overturning with respect to the cylinder 1, about the axis of the latter;

lifting the needles 30 of the second partial course, with the sinkers 6 being closed, so that the corresponding stitches 8 of the first partial course will result retained by the sinkers 6 in a predetermined position with respect to their stem;

lifting further the needles 30 of the second partial course, with the sinkers 6 being open, until all the corresponding stitches 8 reach the operative level of the removal and transfer means and result seized by the same means;

lowering the needles 30 of the second partial course, so that the article will result released from the needles 30.

Advantageously, upon completion of the knitting of the article, provision is made for moving the plate away from the knitting head of the machine.

Figure 5:
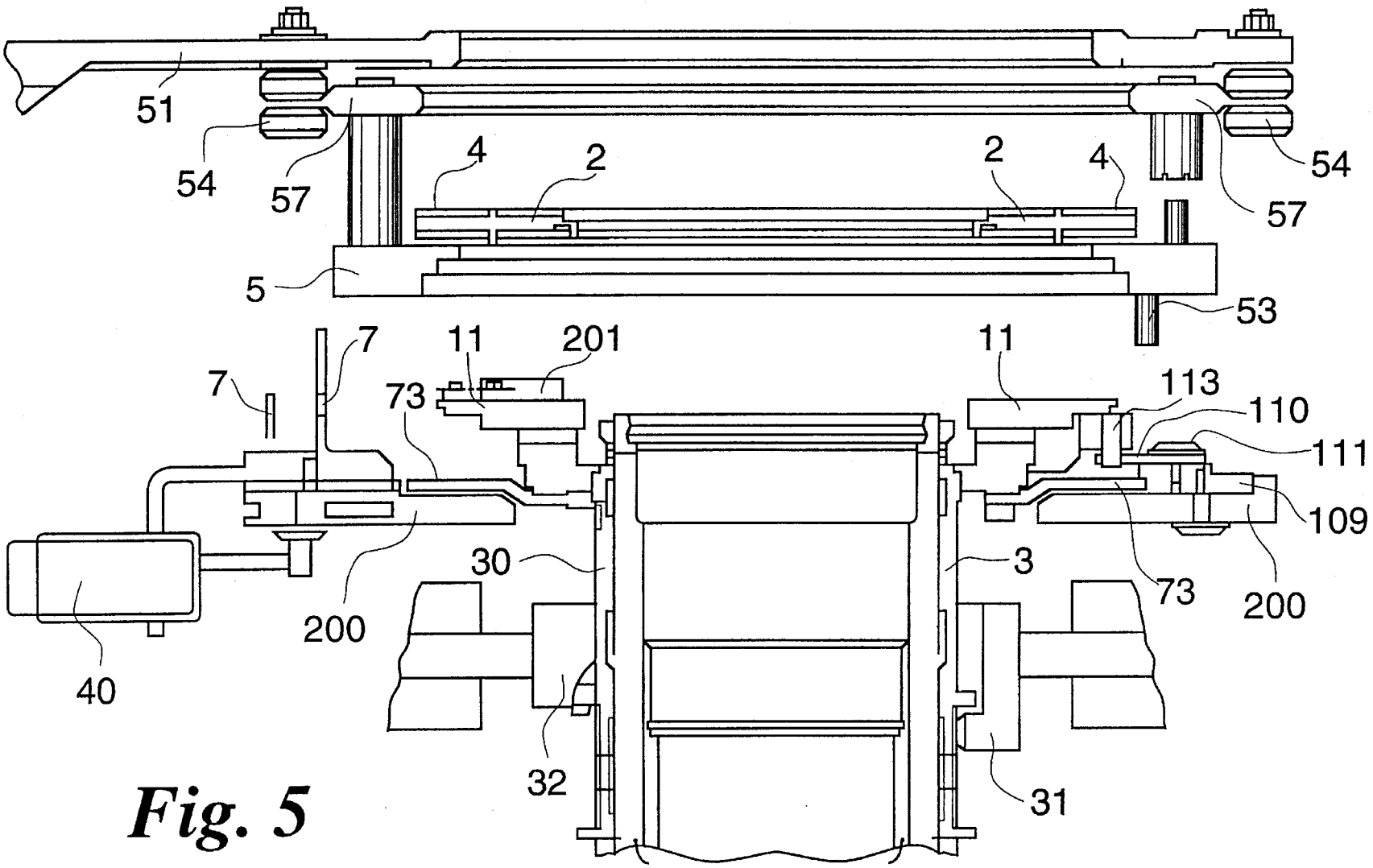
FIG. 5 is a view showing the means of FIG. 3C in partial longitudinal section, a machine with the apparatus according to the invention and with the means of FIG. 3C in which the oscillating sector is lifted with respect to the knitting head, the relevant driving means and the means for positioning the needles.

As far as the apparatus for implementing the above method is concerned, it comprises:

First cam means 31,32, as shown in FIG. 5, for operating the lifting and respectively the lowering of a predetermined number of needles 3,30 of a first and second partial courses of stitches 8,80. The cam means are in their operative condition when the knitting cams are in an inoperative condition, and vice versa.

Means for removing the stitches 8 of the first partial course x and overturning them through 180° about a diametral axis a—a, shown in FIG. 1B, of the cylinder 1 of the needles 3,30. This means for removing stitches includes a pair of spikes 2 for each stitch 8 and at least a corresponding opening and respective closing peg 20. The spikes 2 and closing pegs 20 are slidingly housed within corresponding radial slots of a semicircular sector 4. The sector 4 is rotatively mounted to perform an angular excursion of 180° in both directions about diametral axis a—a of the cylinder 1 of needles 3,30. The sector 4 overlies the sinkers 6 of the machine which makes the article and is supported by a horizontal crown 5 which is in turn solid to a horizontal arm 51 rotating about a vertical transfer axis b—b shown in FIGS. 1A, 3B. The crown is vertically movable between two positions. A lower, or first position, A is for the engagement of the crown 5 on the knitting head of the machine and on the linking station R means, and an upper position B for the disengagement of the crown 5 in order to allow the transfer thereof from one operative station to the other. The crown 5 is also able to rotate in a plane orthogonal to the axis of the cylinder 1, during the linking of the article toe. This is possible by means of a transmission made up of a toothed belt 50 and gears 65,66 or similar device connectable to a corresponding driving member 56. The crown 5 is also provided with a member engageable to and disengageable from the transmission so as to allow for a suitable movement of the stitches 8,80 to be united, during the linking operation, with respect to corresponding linking means.

Second cam means 7 for operating the bidirectional 180°-overturning of the semicircular sector 4 about diametral axis a—a of the cylinder 1.

Third cam means 201, as shown in FIG. 3A, for moving the spikes 2 and respective pegs 20 in the article-knitting station T.

Crown transfer means for operating the rotation of the arm 51 in a horizontal plane by a pneumatic cylinder 67, shown in FIG. 1B, whose stem has its free end connected to a lever 68 solid to the lower base of the column 52 which supports the arm 51. The column 52 consists of the stem of a column cylinder having axis b—b and allowing both the rotation of the arm 51 about the axis b—b of column 52 during the transfer of the article from the knitting station T to the linking station R, as well as the vertical translation thereof along the same axis b—b during the engagement/disengagement of the crown 5 on the knitting head of the machine or on the operative means of the linking station R.

Crown rotation means for causing the crown 5 to rotate solid with the cylinder 1 of the needles 3,30 upon the initial stage of the article linking, with a vertical pivot, shown in FIGS. 2A, 2B, 2D, 2E, 3D, 3E, 3F, 53 solid to the crown 5. The pivot 53 being angularly oscillating between two positions, one for engaging the crown 5 to an element 73 solid to the cylinder 1, and the other for engaging the crown 5 to a stationary plate 200 of the machine to cause it to stop at a predetermined angular position.

Sinker housing means for holding the sinkers housing 11 of the machine in a fixed and predetermined angular position. The sinker housing means having a sinker cam 110, shown in FIGS. 3D–3F, able to freely oscillating about a pivot 111 solid to a support 109, shown in FIG. 5, whose angular position with respect to the needles cylinder 1 can be varied. The support 109 is mounted on the fixed part 200 of the machine. The cam 110 is provided with two curvilinear grooves 112, shown in FIGS. 3D–3F, developing according to two corresponding arcs of circumference. Each of the grooves 112 are able to form a guiding element for a corresponding pin 113 fixed to the sinkers housing 11. In its initial stage of intervention, the pin 113 closer to the pivot 53 is inside a corresponding groove 112, that is, engaged with the cam 110. With the rotation of the crown 5 solid to the cylinder 1, the pivot 53 runs onto a side of cam 110 and causes the latter to rotate. This is cause for the disengagement of the first pin 113 already engaged with the cam 110 and the insertion of the other, or second pin, 113 into the other groove 112. Further rotating the crown 5 is cause for the pivot 53 to reverse the rotation of cam 10 thus allowing the insertion of the first pin 113 into the relevant groove 112 and thereby restoring the condition existing before the cam 110 was set in motion. In this way, during the rotation of the crown 5, at least one of the pins 113 results engaged with the cam 110, and the sinkers housing 11 results solid all the time with the support 109, that is, to the fixed part of the machine.

Fourth cam means 59, as shown in FIG. 2C, for driving the spikes 2 and relevant pegs 20 before carrying out the linking of the article toe.

Fifth cam means 58, as shown in FIG. 2C, for operating the opening of the pegs 20 upon the step of releasing the finished article.

A seamer-linker means 130, as shown in FIG. 2C, for the formation of the hook-up which links the pairs of corresponding stitches 8,80. The seamer-liner 130 is disposed at a preset distance from the article-knitting cylinder 1, that is, in a predetermined position of the linking station R.

Cutting means 95, 96, 97, as shown in FIG. 34C–35, 38–39A, for ultimately cutting the linking thread F and holding the end of the thread F1 fed by the supply reel.

According to the invention and with reference to FIGS. 1A–1D of the attached drawings, the cams 7 for overturning the sector 4 are activated by corresponding pneumatic cylinders 70 supported by the arm 51 bearing the crown 5. Connected to the stem of each cylinder 70 is a corresponding rod 71 with a counteracting spring 72 to the free end of which a cam 7 is fixed. A block 73 is provided for guiding the excursion of a second rod 74 which is connected to the cam 7 and allows the guided support thereof in cooperation with the rod 71.

Alternatively, with reference to FIG. 3B of the attached drawings, the cams 7 are activated by corresponding pneumatic cylinders 40 solid to a fixed part 200 of the machine.

Advantageously, according to the invention, the cams 7 exhibit a substantially helicoid profile.

Moreover, the sector 4 is provided with two rollers 41, shown in FIG. 3B, which are idly mounted on corresponding horizontal shafts 42, on either side of the axis of symmetry d—d of sector 4. The rollers 41 are intended to feel or contact the active profile of the cams 7 to cause the overturning of the sector 4.

According to an alternative embodiment, to allow for the rotation of the crown 5 during the closing of the article toe, crown driving means with a driving shaft along a vertical axis is provided, not shown for clarity in the attached drawings. The shaft draws its motion from the main drive of the knitting machine. The upper end of this main drive is provided with a sprocket intended to be engaged with a ring gear 66 connected solid to the crown 5. This allows the crown 5 to be rotated in the knitting station T in phase with the cylinder 1.

Advantageously, the crown 5 is supported by the arm 51 by means of three bearings or shaped rollers 54 which bear a circular "v" guide 57, parallel and coaxial to the crown 5. The guide 57 is disposed at a position overhanging the latter and suitably spaced apart by a plurality of columns 55.

Advantageously, each of the spikes 2 is provided with two heels 21, as shown in FIGS. 8B–9B, which project from either side and are vertically offset to allow for the reciprocating displacement thereof within the relevant slots of the sector 4. The displacement is by means of a corresponding driving cam 201 provided in the knitting station T, and of cams 58 and 59 provided in the linking station R.

In addition, each of the pegs 20 is advantageously provided with two heels 22, as shown in FIGS. 10B–11B, projecting from either side and vertically offset to allow the corresponding spikes 2 to be moved in the closing and opening direction, upon the hold and release, respectively, of the stitches 8,80 to be united.

Moreover, the height and width of the heels 21,22 are advantageously chosen according to the active profile of the corresponding driving cam.

The presence of the heels 21,22 allows the controlled longitudinal translation in both directions of the spikes 2 and relevant pegs 20 during the steps of removing the stitches 8 of the first partial course x, transferring the latter onto the needles 30 of the second partial course y, transferring the article from the knitting station T to the linking station R, predisposing the stitches 8,80 to the linked and releasing the finished article.

According to the invention, the spikes 2 have their head shaped in a wedge-like profile to ease the capture, and respectively, the release of the stitches 8,80.

Moreover, the spikes 2 have the tip of their head advantageously bent sideways and internally with respect to the sliding direction thereof, to allow them to be inserted into corresponding longitudinal cavities of the needles 3,30 and thus allowing the stitches 8,80 of the first and second partial courses x,y to be captured.

Figure 12A:
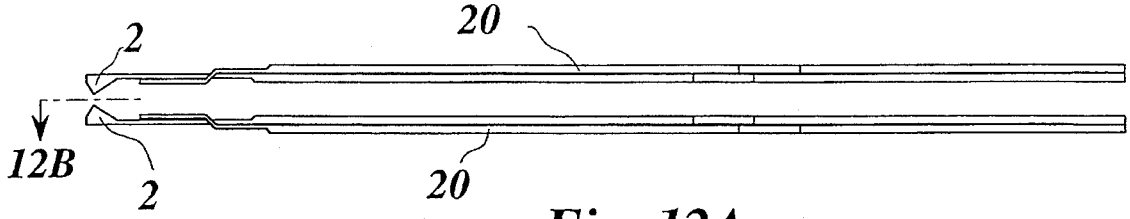
FIG. 12A is a plan view of the assembly of two spikes and corresponding pegs in opening condition.
Figure 12B:
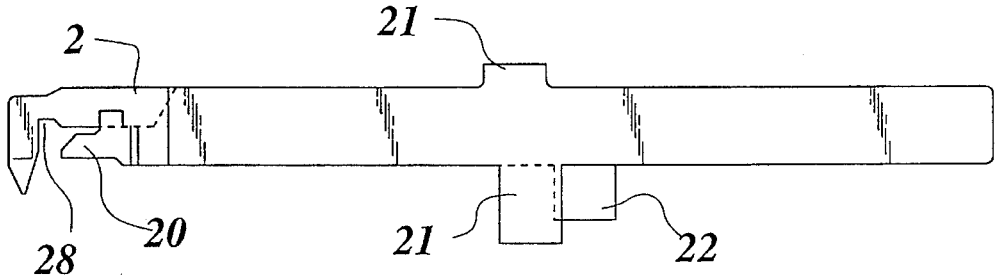
FIG. 12B is a section on line 12B—12B of FIG. 12A.
Figure 13A:
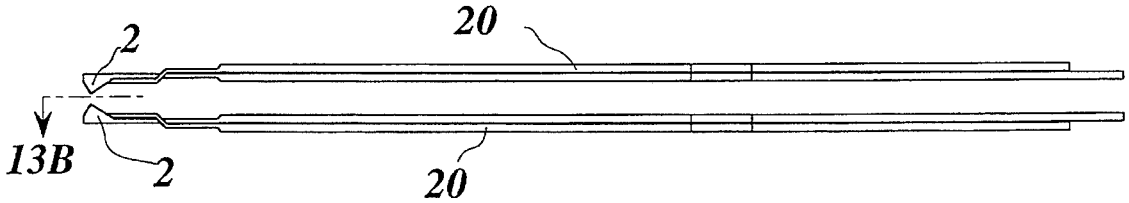
FIG. 13A is a plan view of the assembly of two spikes and corresponding pegs in closing condition.
Figure 13B:
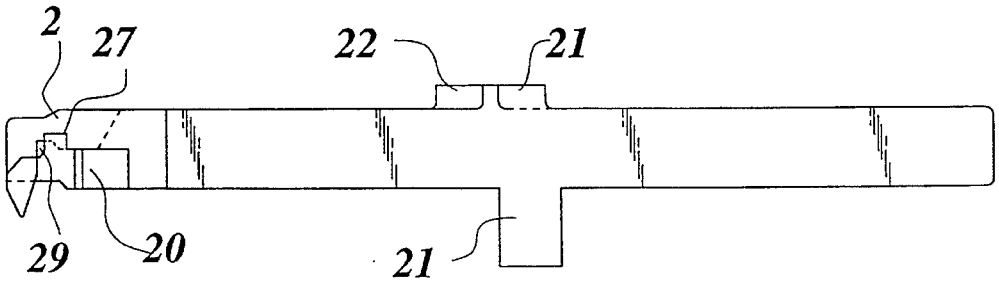
FIG. 13B is a section on line 13B—13B of FIG. 13A.
Figure 14:
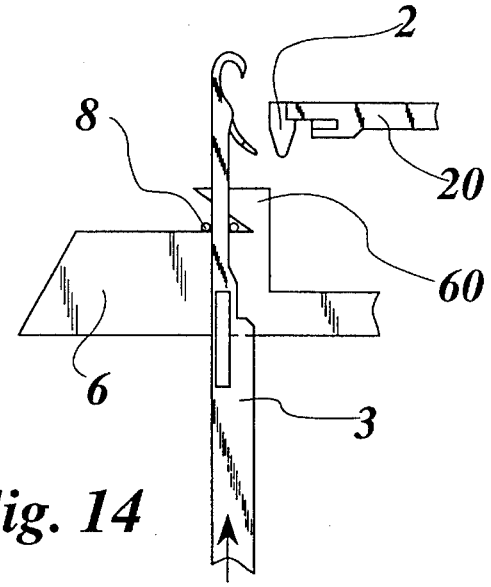
FIG. 14A shows a needle of the first partial course upon the initial stage of the cycle for the closing of the article toe.
Figure 15:
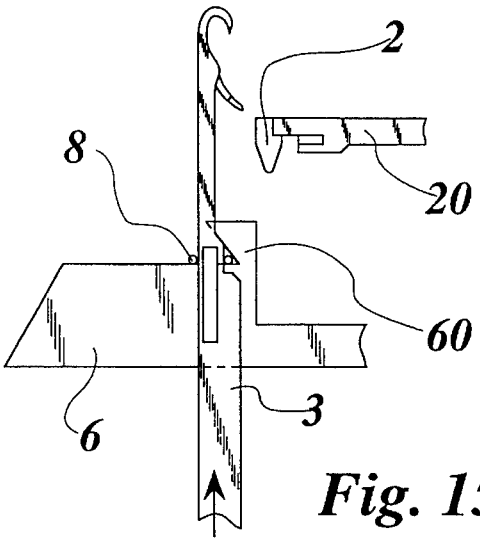
FIG. 15 shows the needle of FIG. 14 upon the lifting thereof, with the sinkers being closed.
Figure 16:
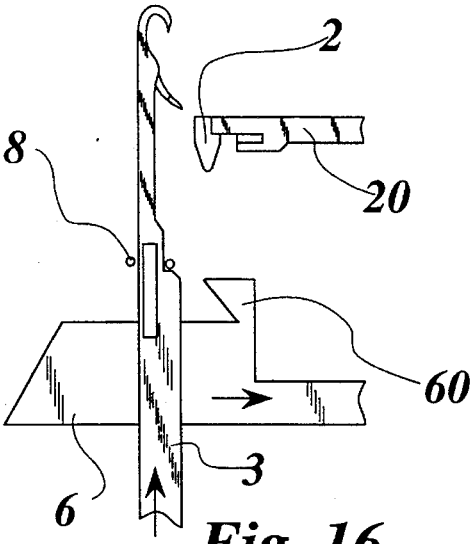
FIG. 16 shows the needle of FIG. 14 in an intermediate stage of its lifting travel, with the sinkers being open.
Figure 17:
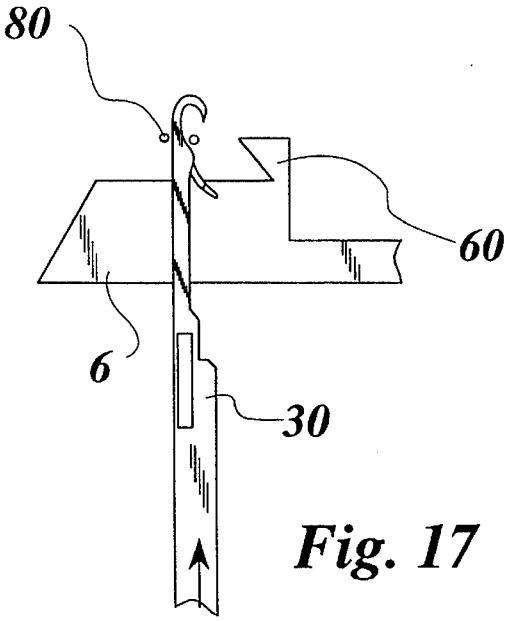
FIG. 17 shows in detail a needle of the second partial course in the final stage of its first lifting.
Figure 18:
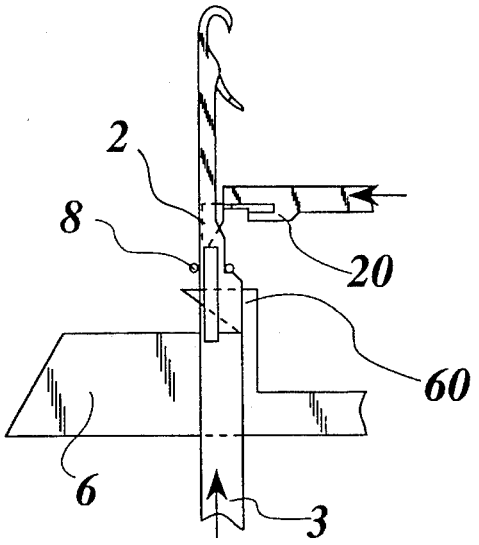
FIG. 18 illustrates the needle of FIG. 16, wherein one of the respective spikes is shown moving close to the corresponding stitch.
Figure 19:
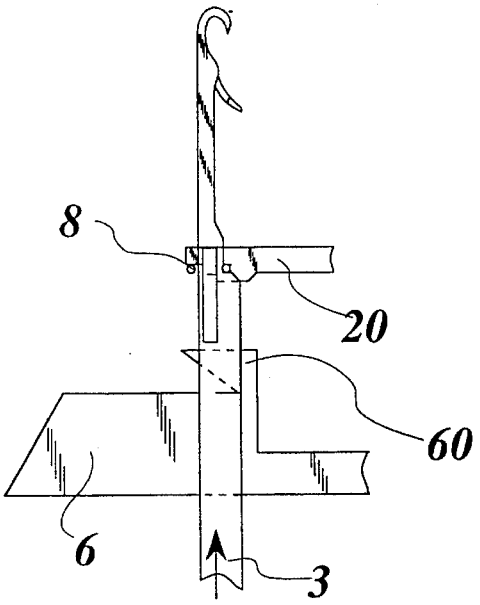
FIG. 19 shows the needle of FIG. 18, with the spike engaging the stitch.
Figure 20:
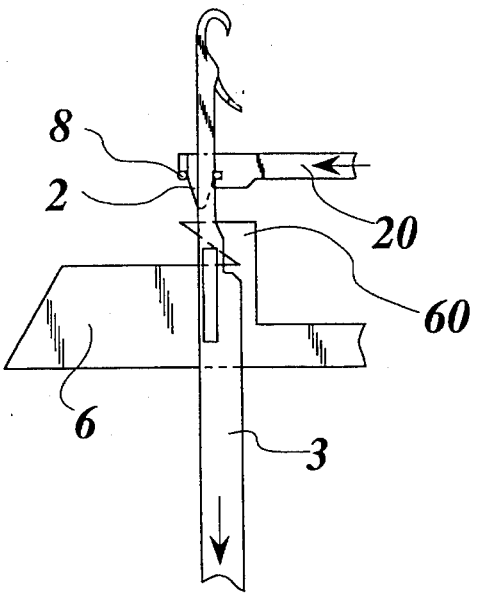
FIG. 20 illustrates the needle of FIG. 18, wherein the spike is shown picking up the stitch.
Figure 21:
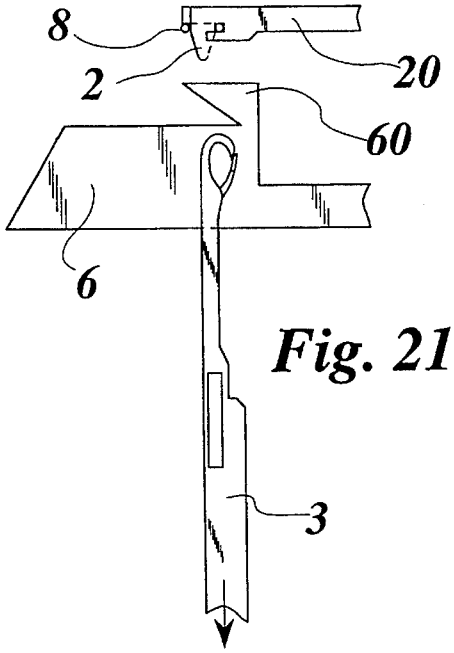
FIG. 21 shows the needle of FIG. 18 in lowered position.
Figure 22:
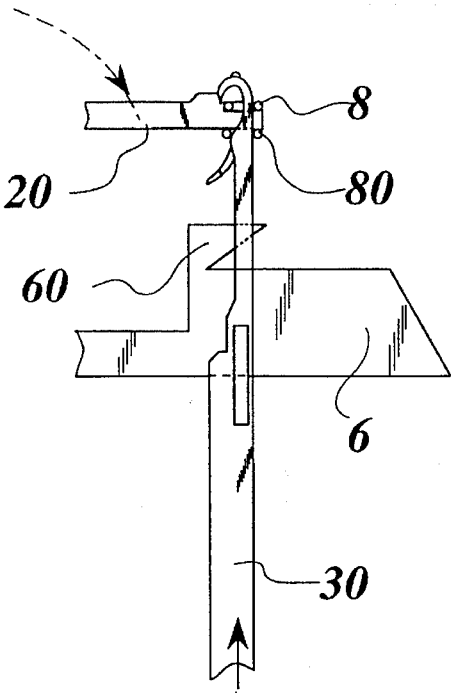
FIG. 22 shows in detail a needle of the second partial course, wherein one of a respective spike is shown while intercepting the corresponding transferred stitch of the first partial course.
Figure 23:
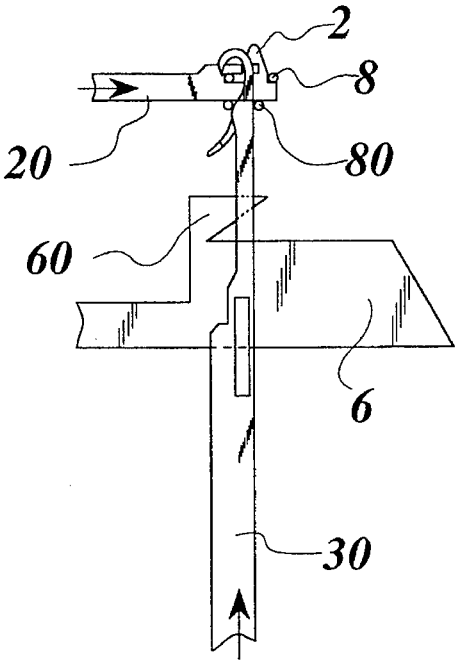
FIG. 23 shows the needle of FIG. 22, with the spike leaning the corresponding stitch on the needle neck prior to the opening of the respective peg.
Figure 24:
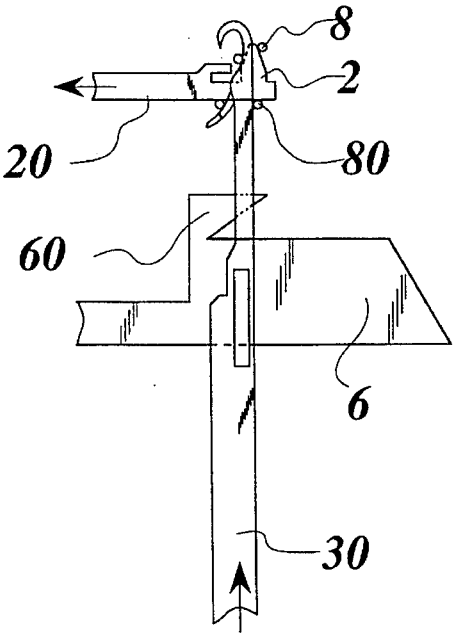
FIG. 24 shows the needle of FIG. 23 in the lifted position for releasing the corresponding stitch of the first partial course from the spike.
Figure 25:
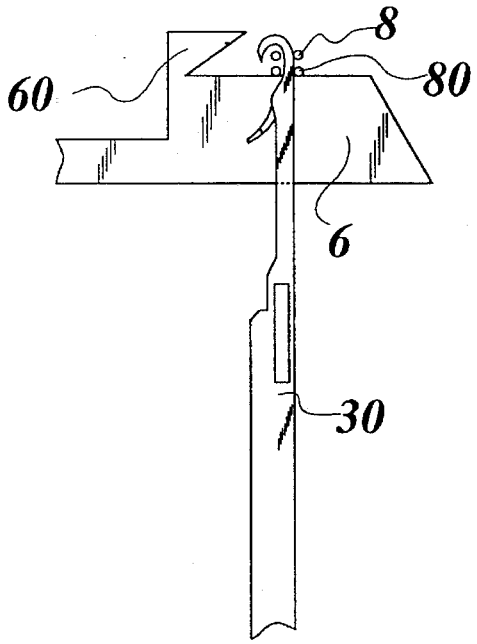
FIG. 25 shows the needle of FIG. 24 in lowered position beneath the sinker nib, With the corresponding stitches of the first and second partial courses in the retained position and with the relevant sinker open.
Figure 26:
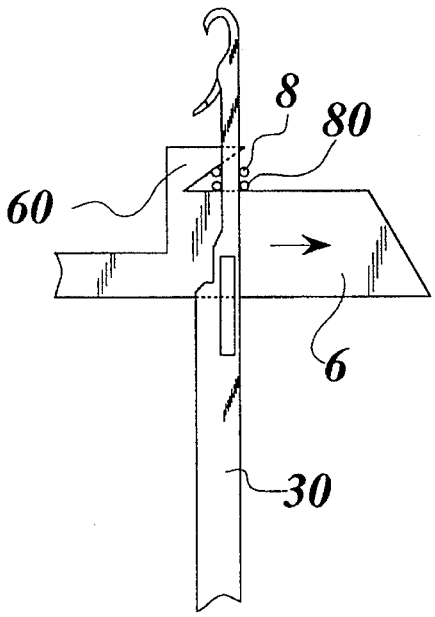
FIG. 26 shows the needle of FIG. 25 during the lifting thereof, with the sinker closed.
Figure 27:
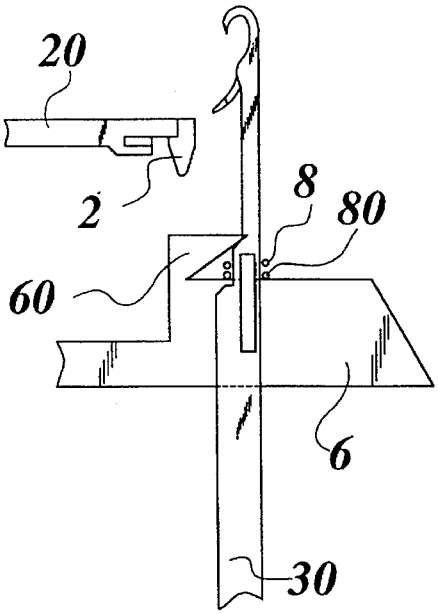
FIG. 27 shows the needle of FIG. 26 as it is lifted further up, with the sinkers closed.
Figure 28:
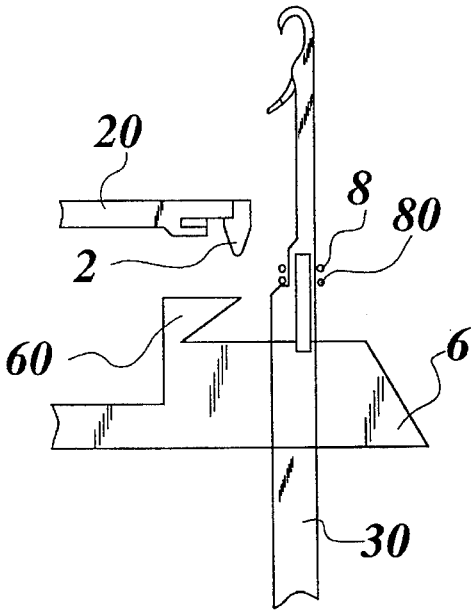
FIG. 28 shows the needle of FIG. 27 being lifted further up and With the relevant sinker open.
Figure 29:
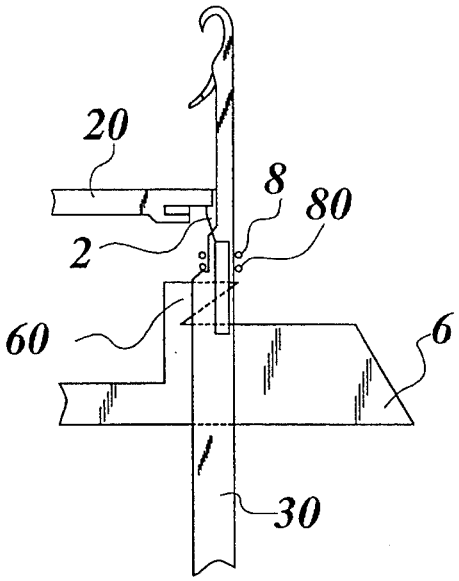
FIG. 29 shows the needle of FIG. 28 with the corresponding spike moving close to the stitches loaded on the needle stem.
Figure 30:
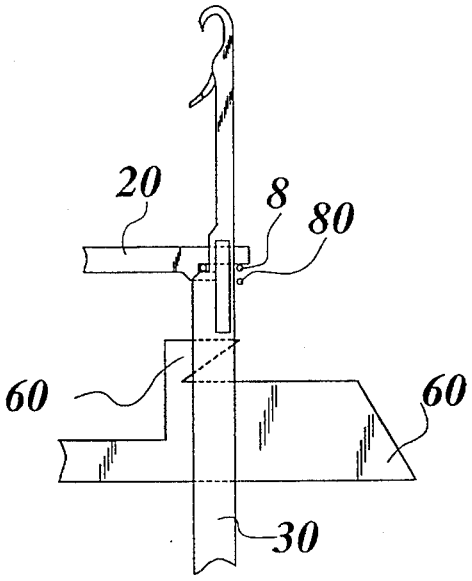
FIG. 30 shows the needle of FIG. 29 during its final lifting stage to allow the spike to remove the corresponding stitches.
Figure 31:
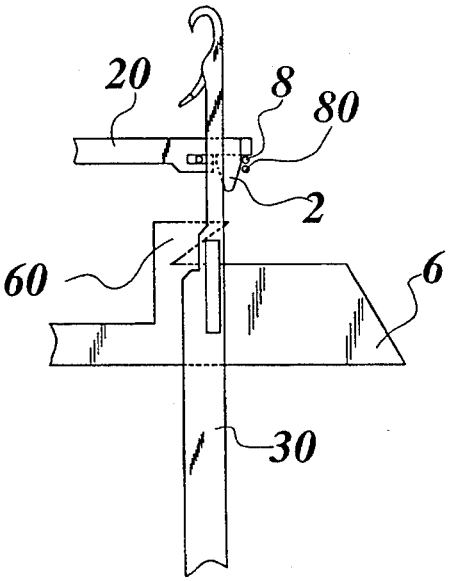
FIG. 31 shows the needle of FIG. 30 in its lowering stage.
Figure 32:
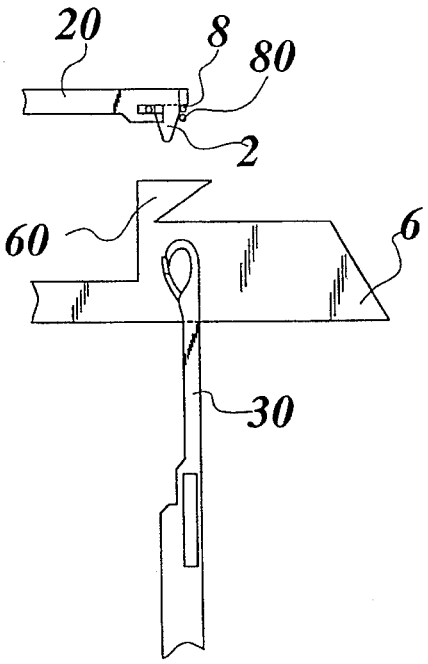
FIG. 32 shows the needle of FIG. 31 in its final lowering stage, with the corresponding stitches of the first and second partial courses being picked up by the spike.
Figure 33A:
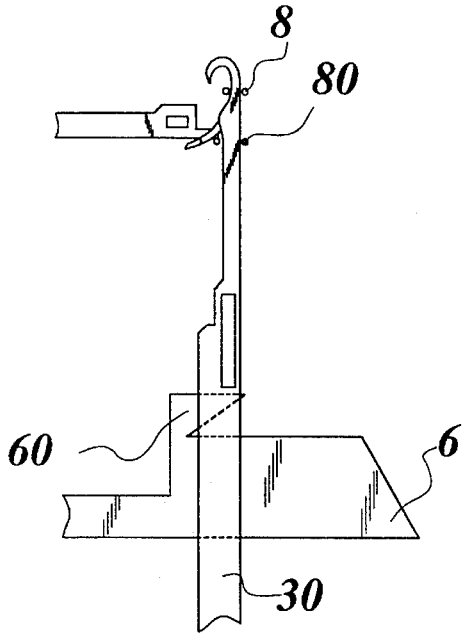
FIG. 33A shows the needle of FIG. 23 in the lifting stage, with the corresponding stitch of the first partial course in retained position and with the stitch of the second partial course being locked by the corresponding spike, according to an alternative embodiment of the present method.
Figure 33B:
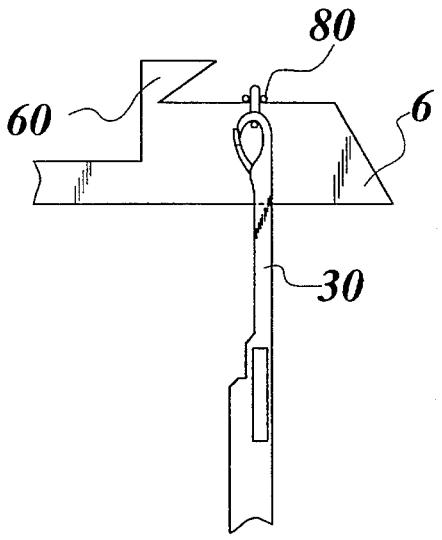
FIG. 33B shows the needle of FIG. 33A in its final lowering stage, with the corresponding stitch of the second partial course being unloaded.
Figure 33C:
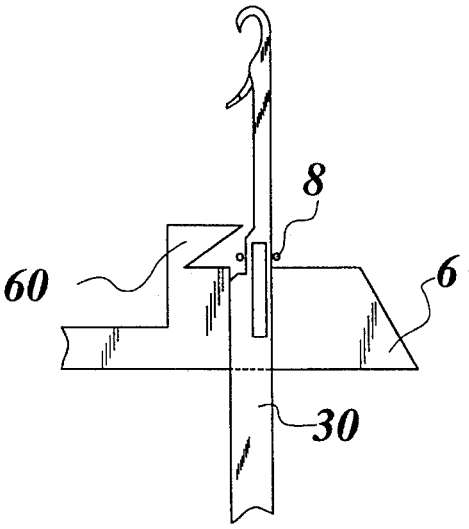
FIG. 33C shows the needle of FIG. 33B during the final lifting stage, with the closed sinkers which retain the corresponding stitch of the first partial course loaded on the needle stem.
Figure 33D:
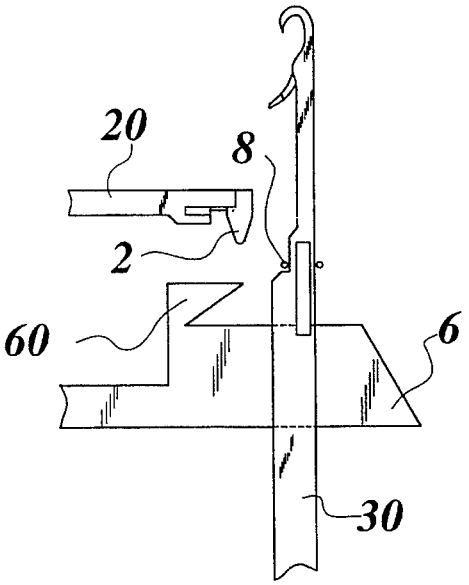
FIG. 33D shows the needle of FIG. 33C in a stage of further lifting, with the sinkers open and the corresponding spike approaching the stitch of the first partial course.
Figure 33E:
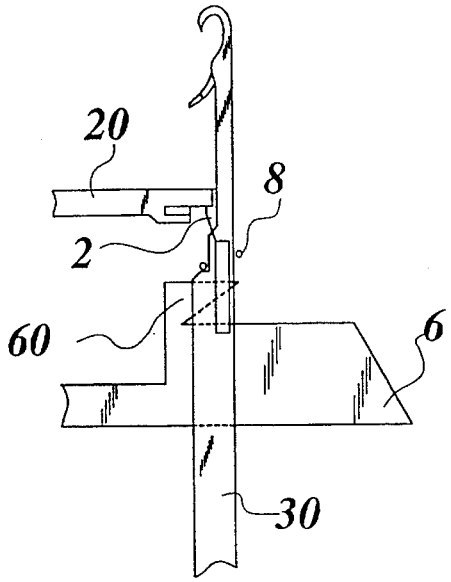
FIG. 33E shows the needle of FIG. 33D, with the spike moving closer thereto.
Figure 33F:
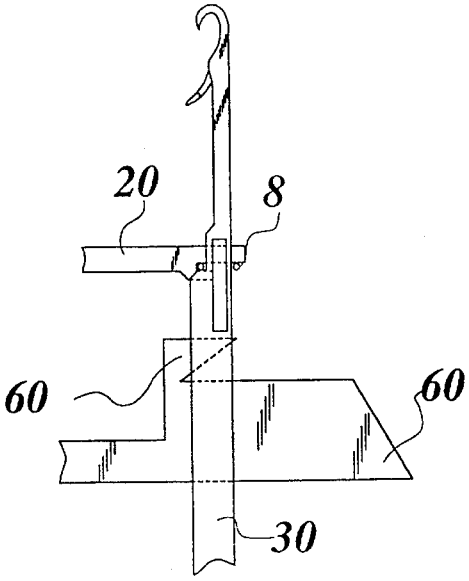
FIG. 33F shows the needle of FIG. 33E during the final lifting stage to allow the removal of the corresponding stitch of the first partial course by the respective spike.
Figure 33G:
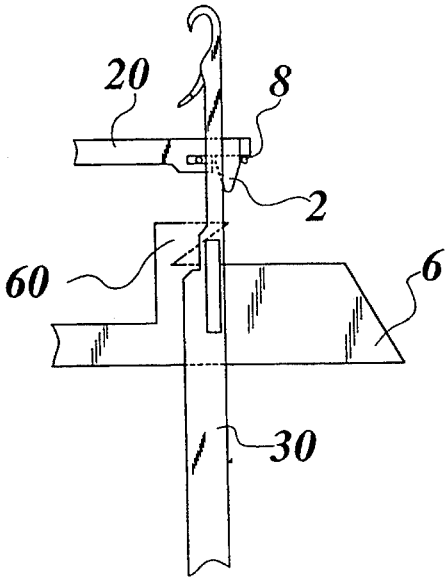
FIG. 33G shows the needle of FIG. 33F in its lowering stage.
Figure 33H:
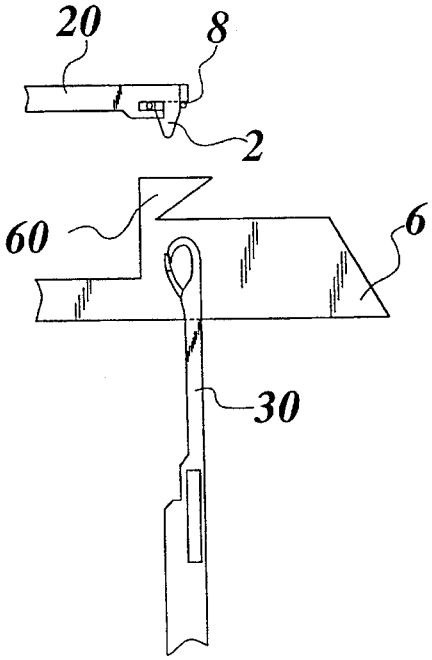
FIG. 33H shows the needle of FIG. 33G in its final lowering stage and the corresponding stitch of the first partial course being removed from the relevant spike.

Moreover, the outer face of the tip of each peg 20 is advantageously adjacent, that is, juxtaposed to the inner face of the respective spike 2, as shown in FIGS. 12B and 13B.

Similarly, each peg 20 is provided with a transverse appendix 27 apt to form a guiding element for the tip of the corresponding spike 2 and delimit, in cooperation with a corresponding recess 28 of the relevant spike 2, a seat or grasping means 29 for grasping the corresponding stitches 8,80 in closing condition.

In this way it is assured that each set of spikes 2 and respective pegs 20 is provided with the required rigidity.

According to the invention, the linker 130 comprises a framework intended to support:

- a needle bar 90 which supports the linking needle 9. The needle bar 90 is provided with a seat for the needle 9, a covering skid 24 which is kept in normally open position by a spring 19 received in a slot of the same bar 90 and whose travel is adjustable by a screw 18. The skid 24 is provided with a heel 34 engaged with a corresponding cam 25 which operates the closing thereof upon the formation of a hook-up chain stitch.
- A bar 26 has a free end on which a crochet 14 is fixed and cooperates with the needle 9 during the formation of the hook-up stitches.
- A feeler arm 15 is provided for moving the crochet bar 26 and which is operated by a cam 16 solid to a crankshaft 17. The shaft 17 is orthogonal to the needle bar 90 and connected thereto by a connecting rod 23 so as to make up a crank drive, that is, a crank-rod type mechanism for moving the bar 90 during the hook-up. This disposition is particularly suitable to give the part of the apparatus provided for the linking of the article, compactness, constructional simplicity and reliability.

Figure 39A:
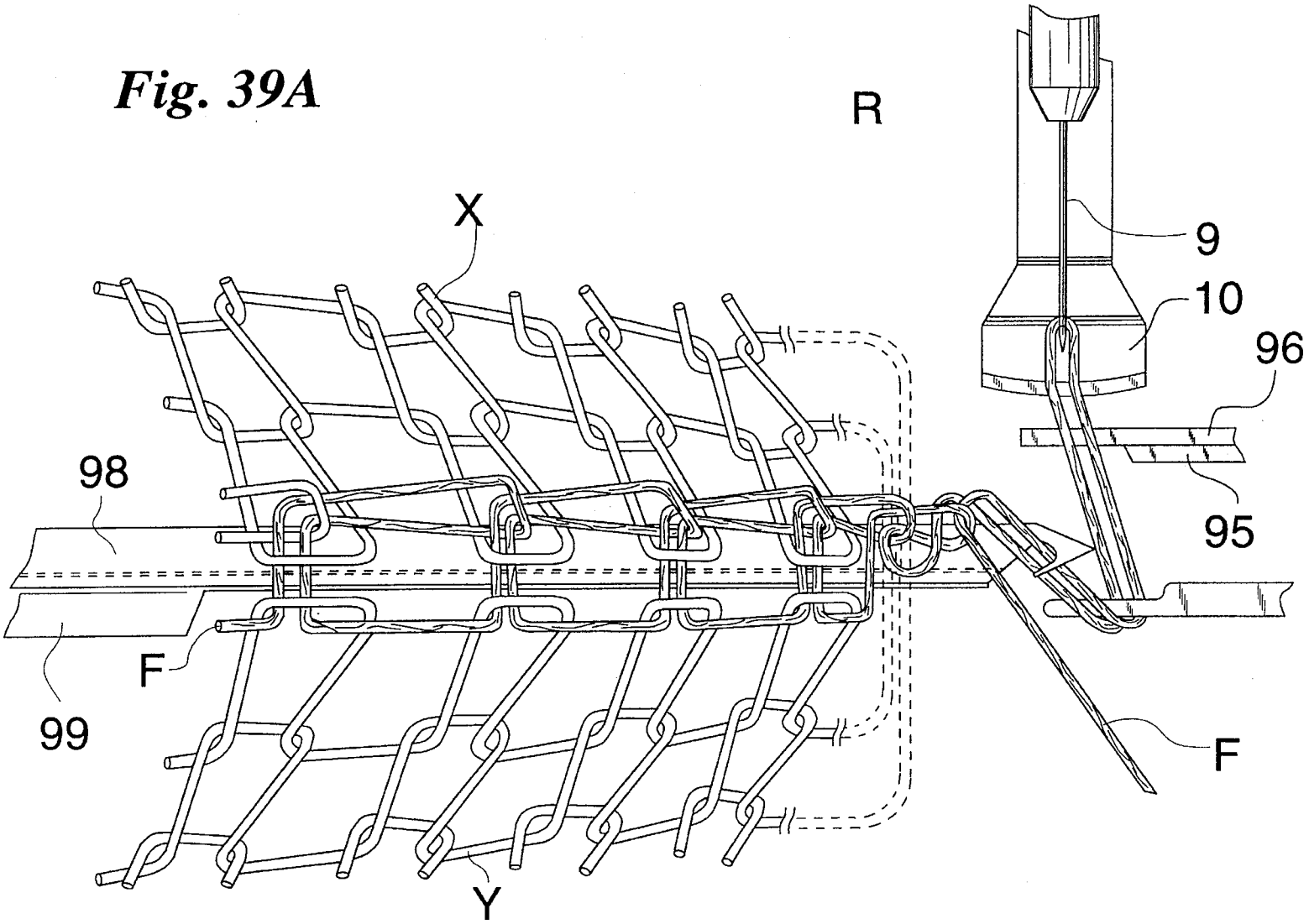
FIG. 39A shows the step of FIG. 38A, according to an alternative embodiment.
Figure 39B:
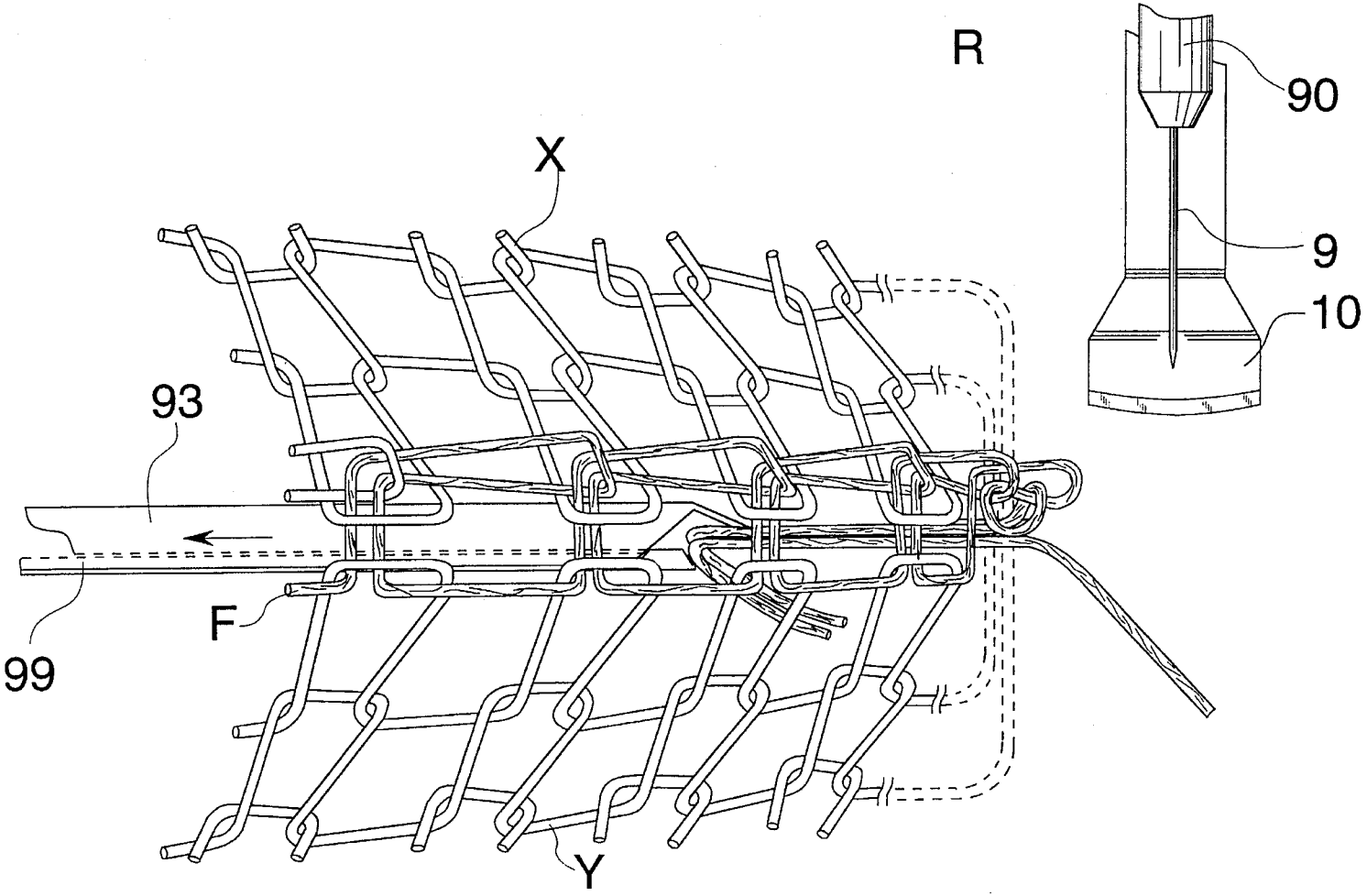
FIG. 39B shows the step of FIG. 38B, according to an alternative embodiment, subsequent to the step of FIG. 39A.
Figure 40:
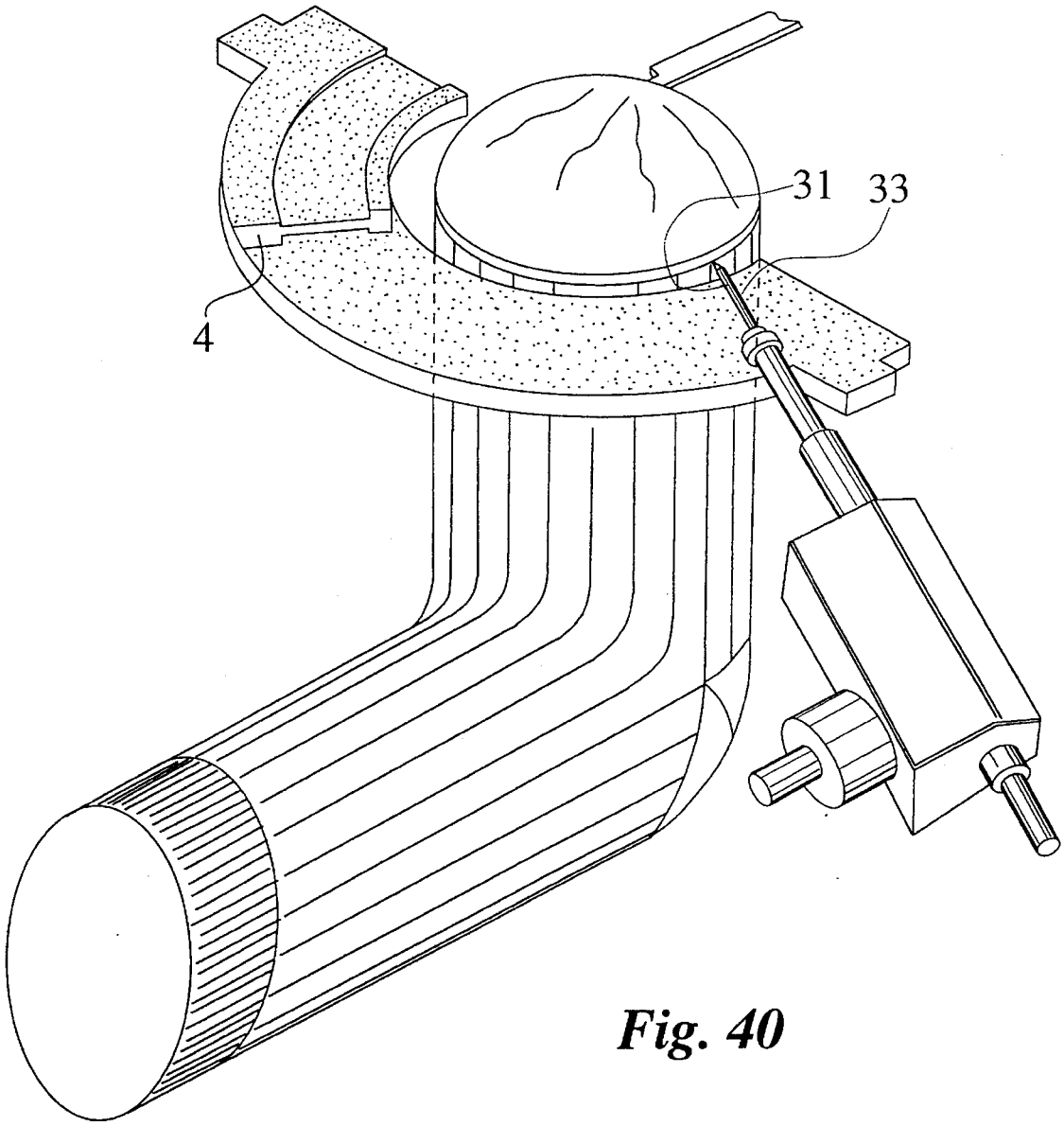
FIG. 40 shows schematically the step of engaging a portion of the article to ease the insertion of the means for the holding of the linking thread and the insertion of the same thread inside the article.
Figure 41A:
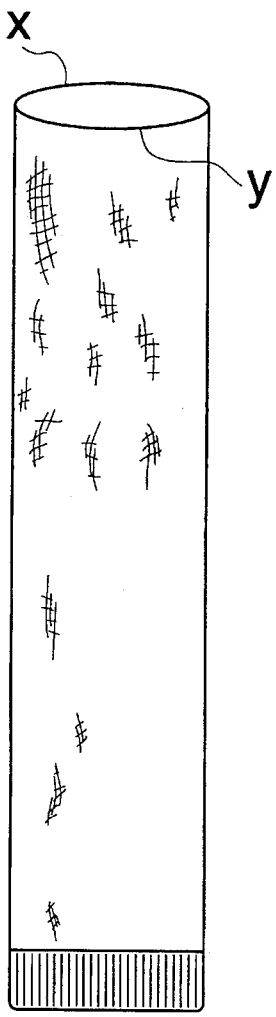
FIG. 41A shows a perspective view of a general tubular article with open toe.
Figure 41C:
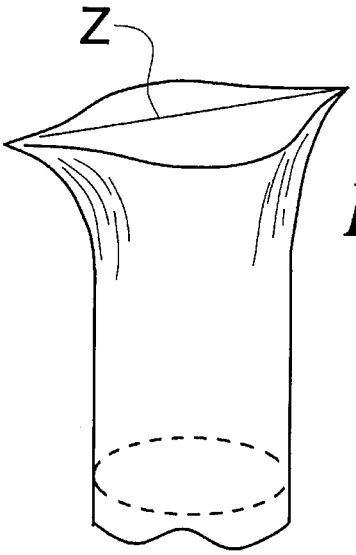
FIG. 41C shows schematically the article of FIG. 41A in the final toe-closing step.
Figure 41D:
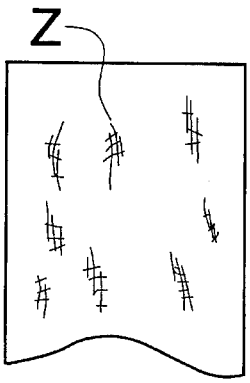
FIG. 41D shows a longitudinal section view of FIG. 41C.
Figure 41B:
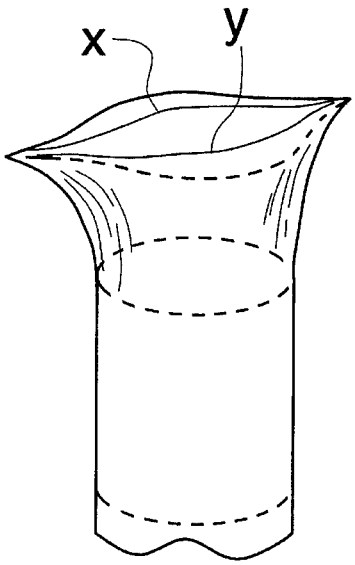
FIG. 41B shows schematically the article of FIG. 41A in the second-last toe-closing step; .
Figure 42A:
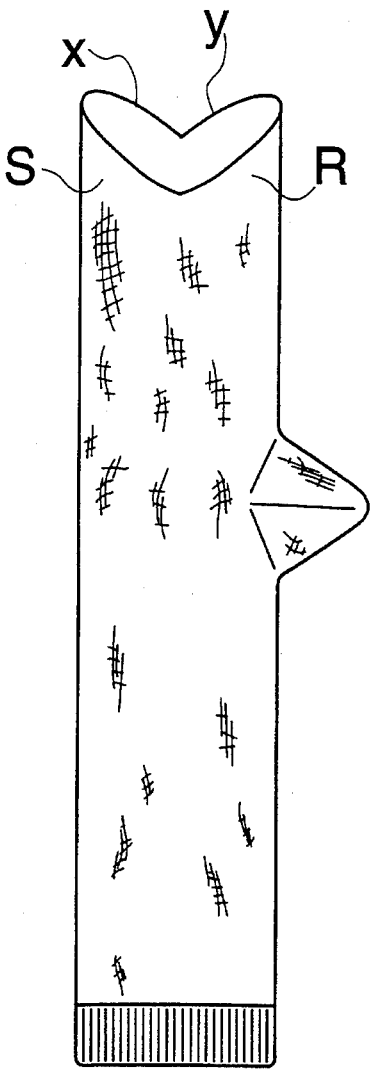
FIG. 42A shows a perspective view of a sock with a so-called "fish mouth" toe formed by two like and adjacent edge S,R.
Figure 42B:
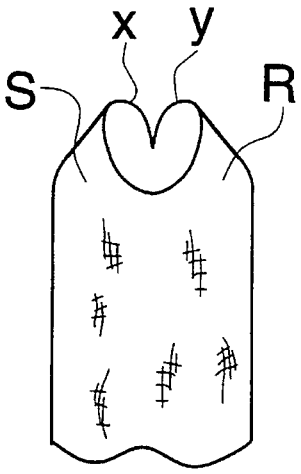
FIG. 42B shows schematically the sock of FIG. 42A in the second-last toe-closing step.
Figure 42D:
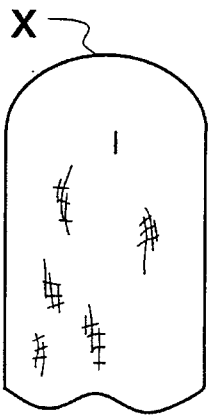
FIG. 42D shows a longitudinal section view of FIG. 42C.
Figure 42C:
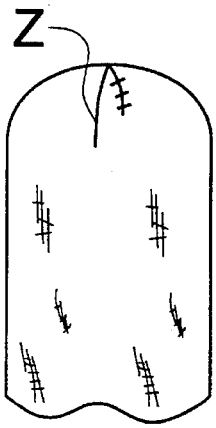
FIG. 42C shows schematically the sock of FIG. 42A in the final toe-closing step.

According to a first embodiment of the invention, reference being made to FIG. 39A of the attached drawings, the means 95 for cutting the linking thread F are disposed in proximity to the operative region of the linking needle 9 on the same side of the linker 130 with respect to the hook-up line.

Figure 34A:
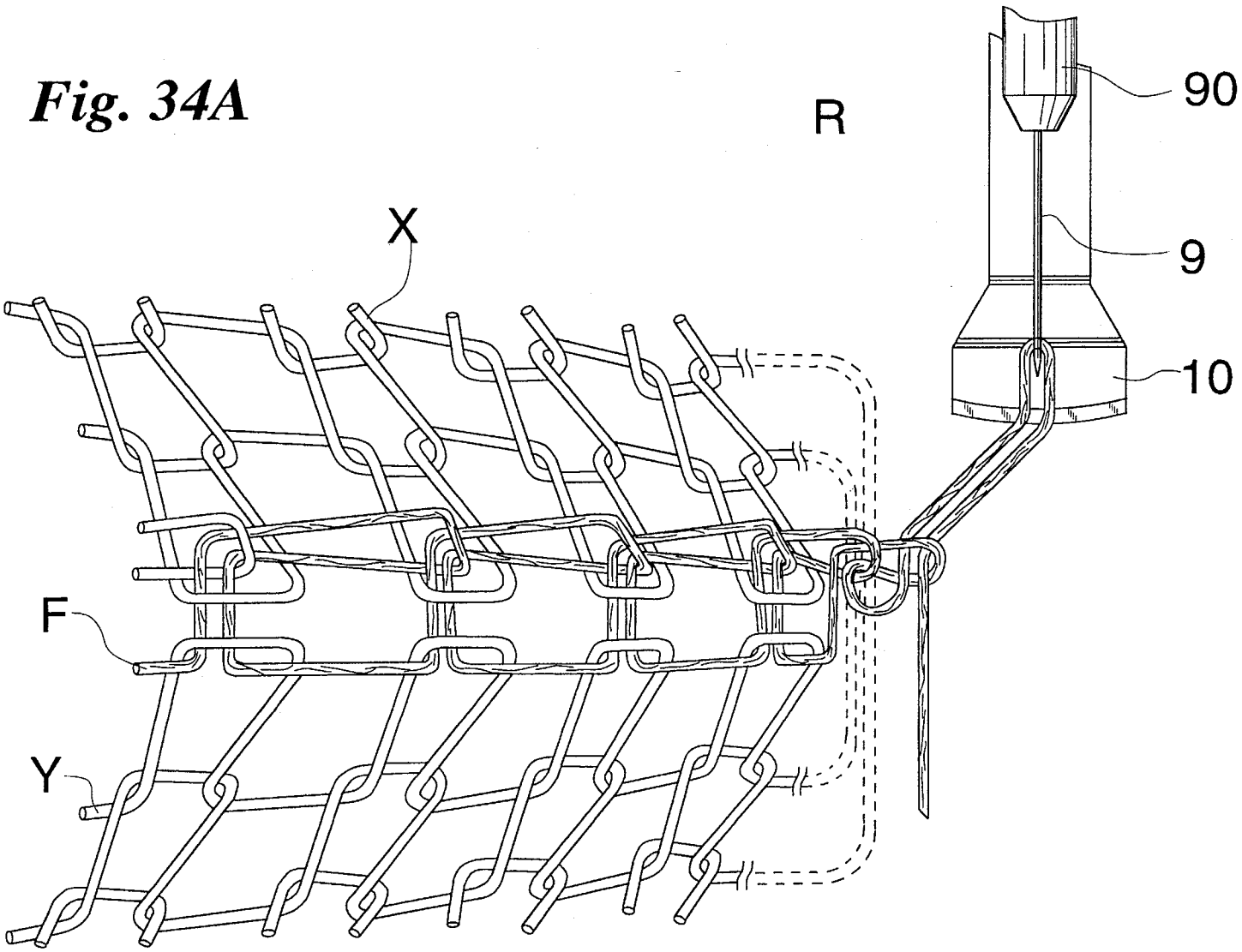
FIG. 34A shows in detail the formation of the chain closing knots upon completion of the linking of the article toe.
Figure 34B:
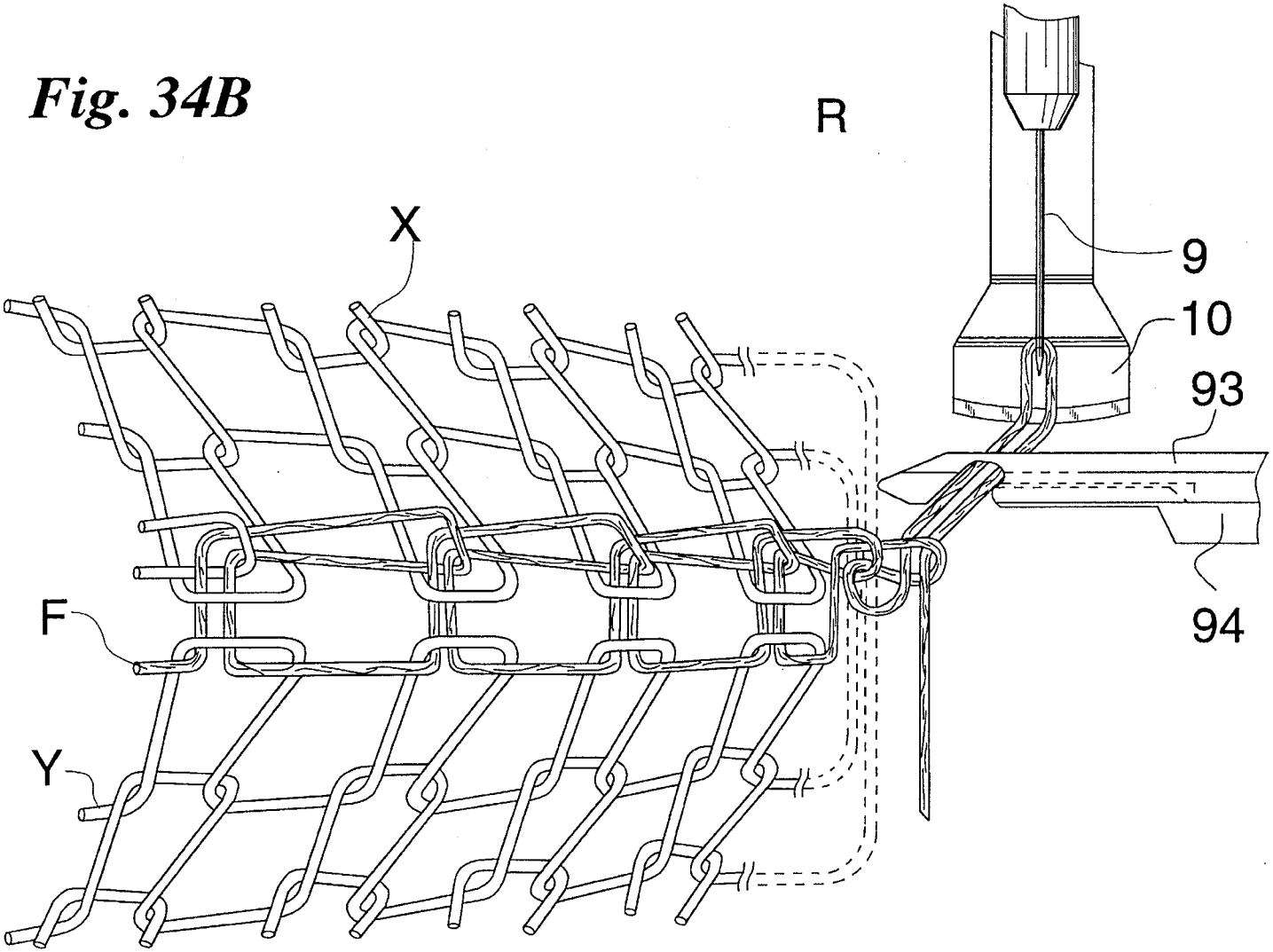
FIG. 34B shows in detail the step of removing the terminal portion of the linking thread by the means for the insertion thereof inside the article toe before cutting the same thread away.
Figure 34C:
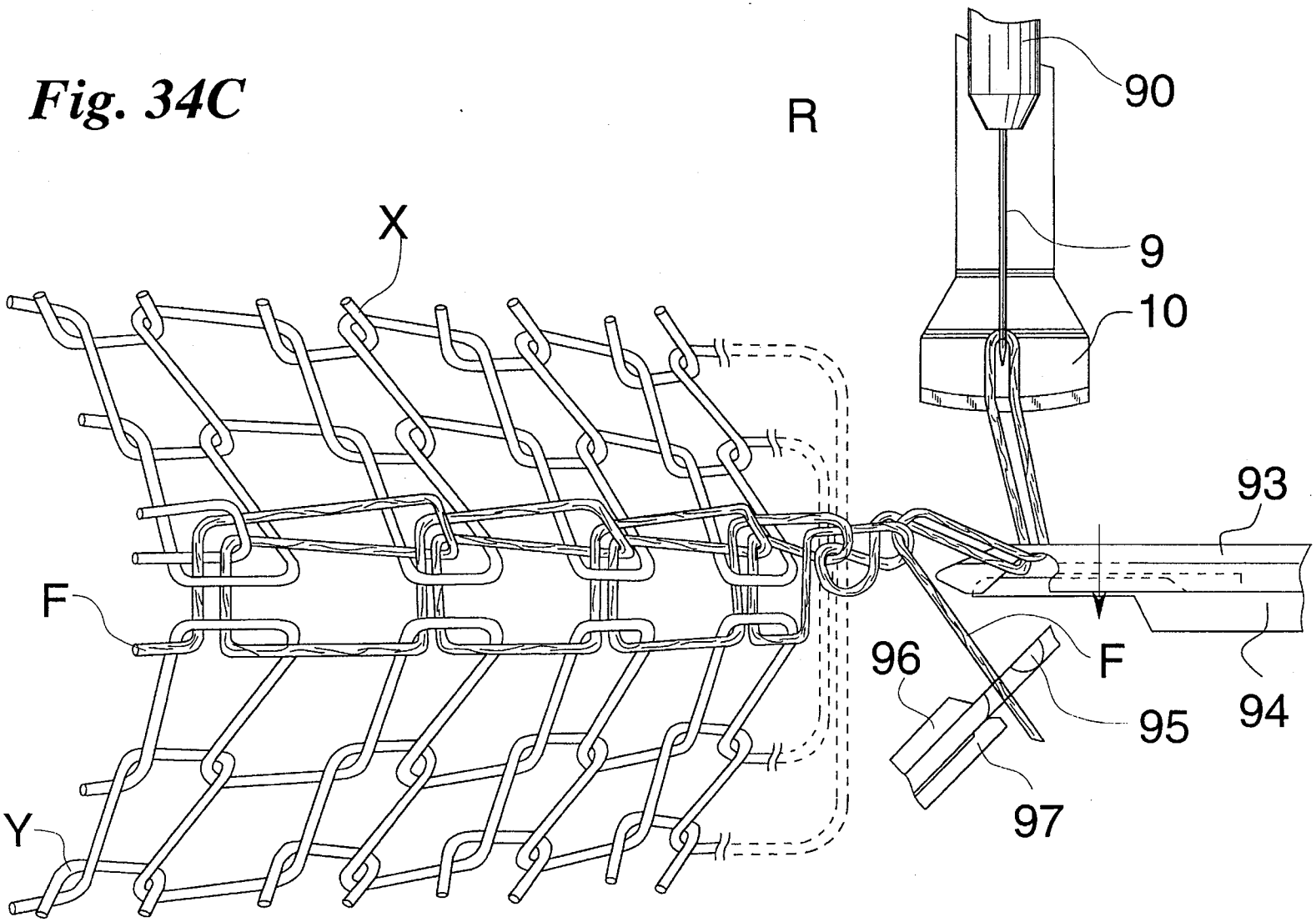
FIG. 34C shows in detail the positioning in operative condition of the cutting-thread thread means and of the driving means for the thread-inserting means.
Figure 34D:
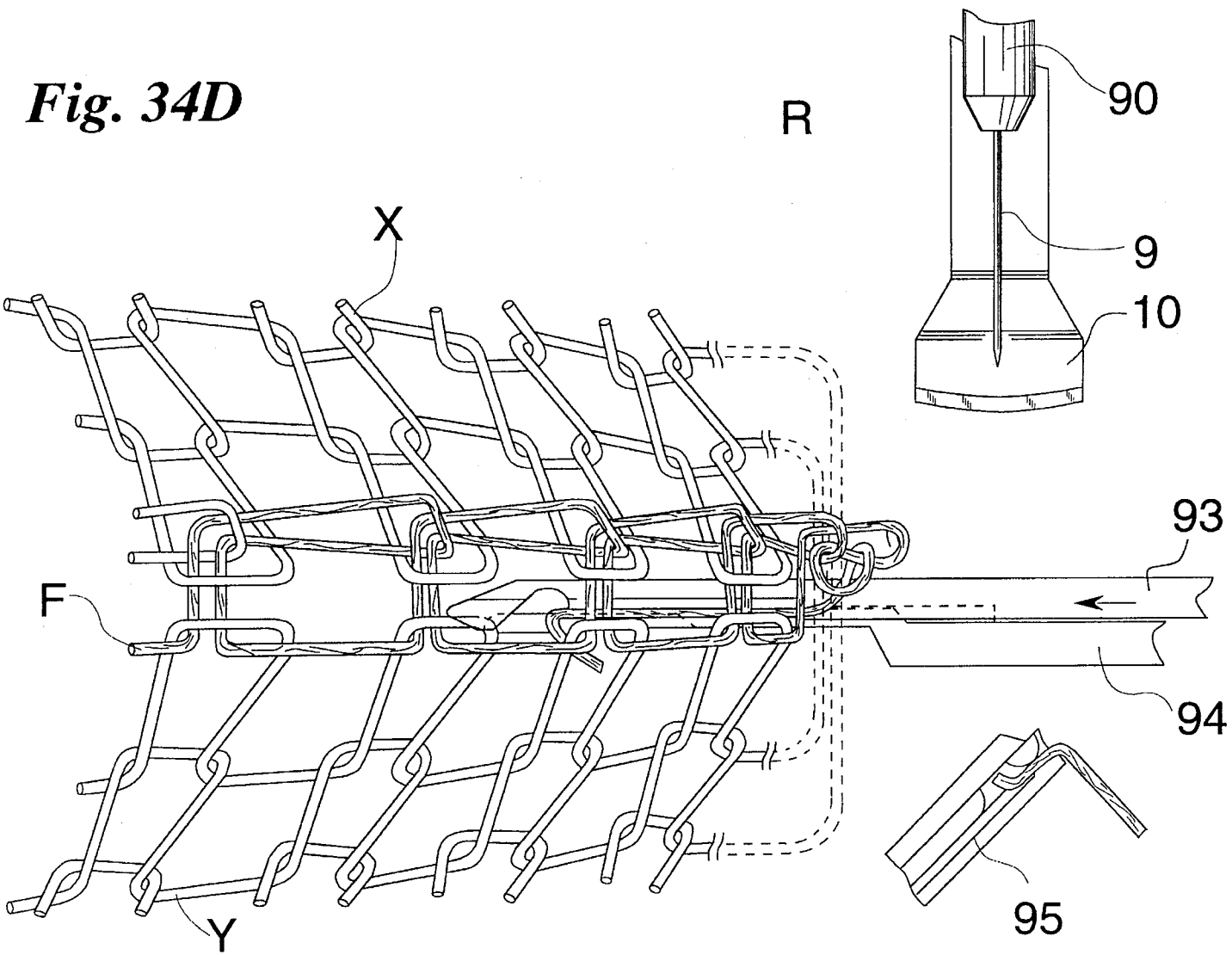
FIG. 34D shows in detail the step of inserting the terminal length of the linking thread inside the article and of cutting and removing the same thread.
Figure 35:
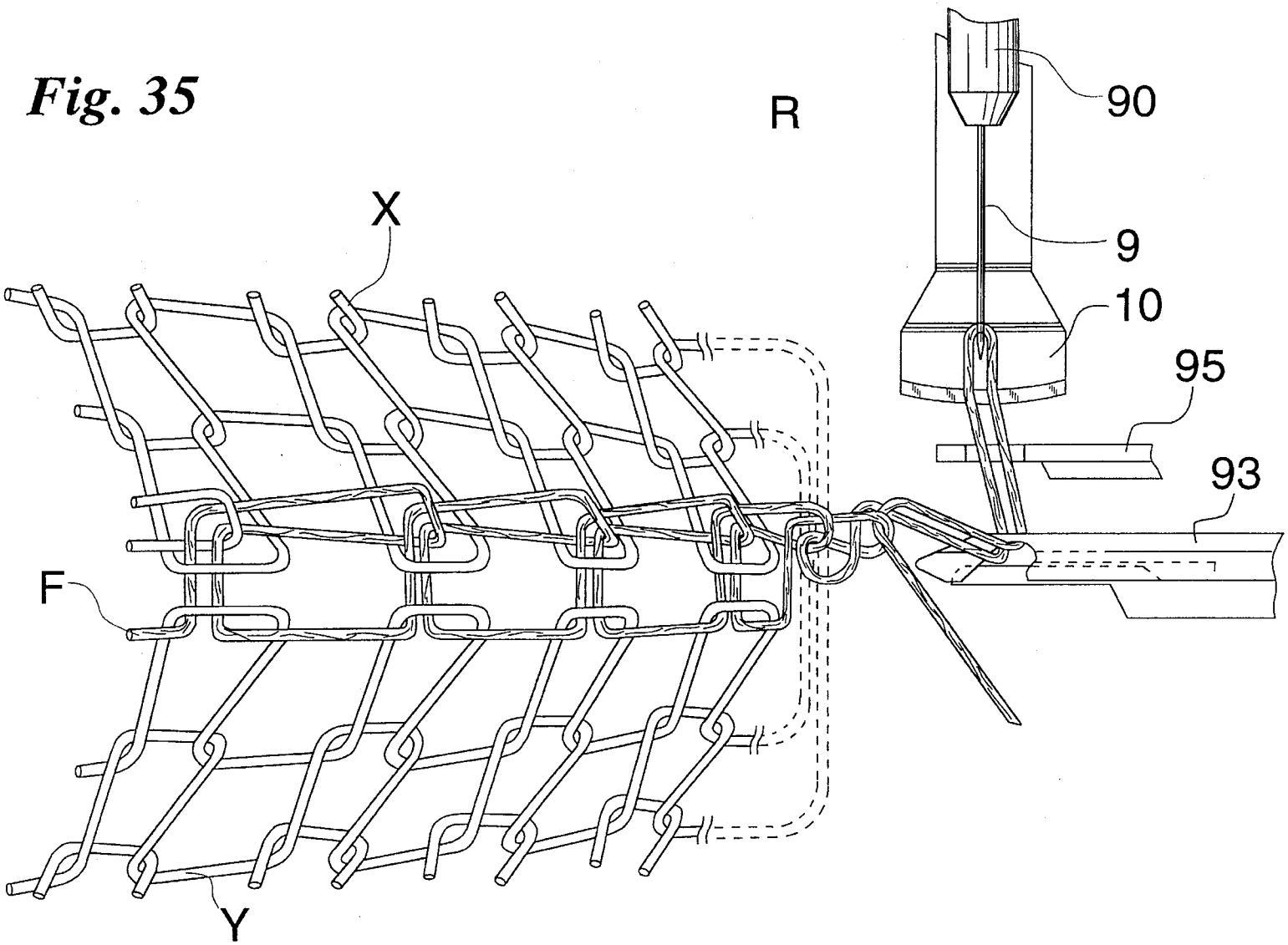
FIG. 35 shows in detail the step of FIG. 34C, according to an alternative embodiment.
Figure 36:
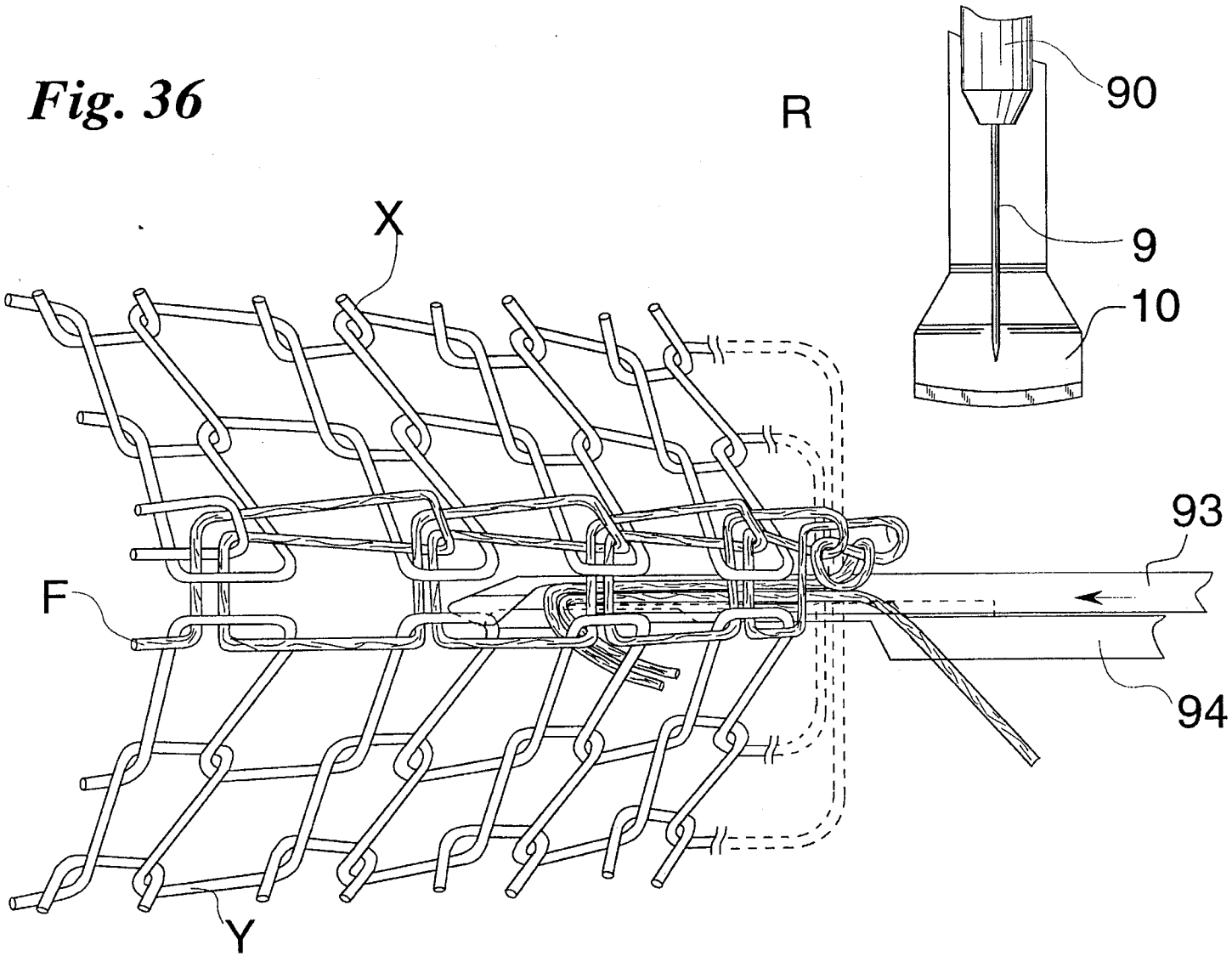
FIG. 36 shows in detail the step of FIG. 34D, according to an alternative embodiment, subsequent to the step of FIG. 35.
Figure 37:
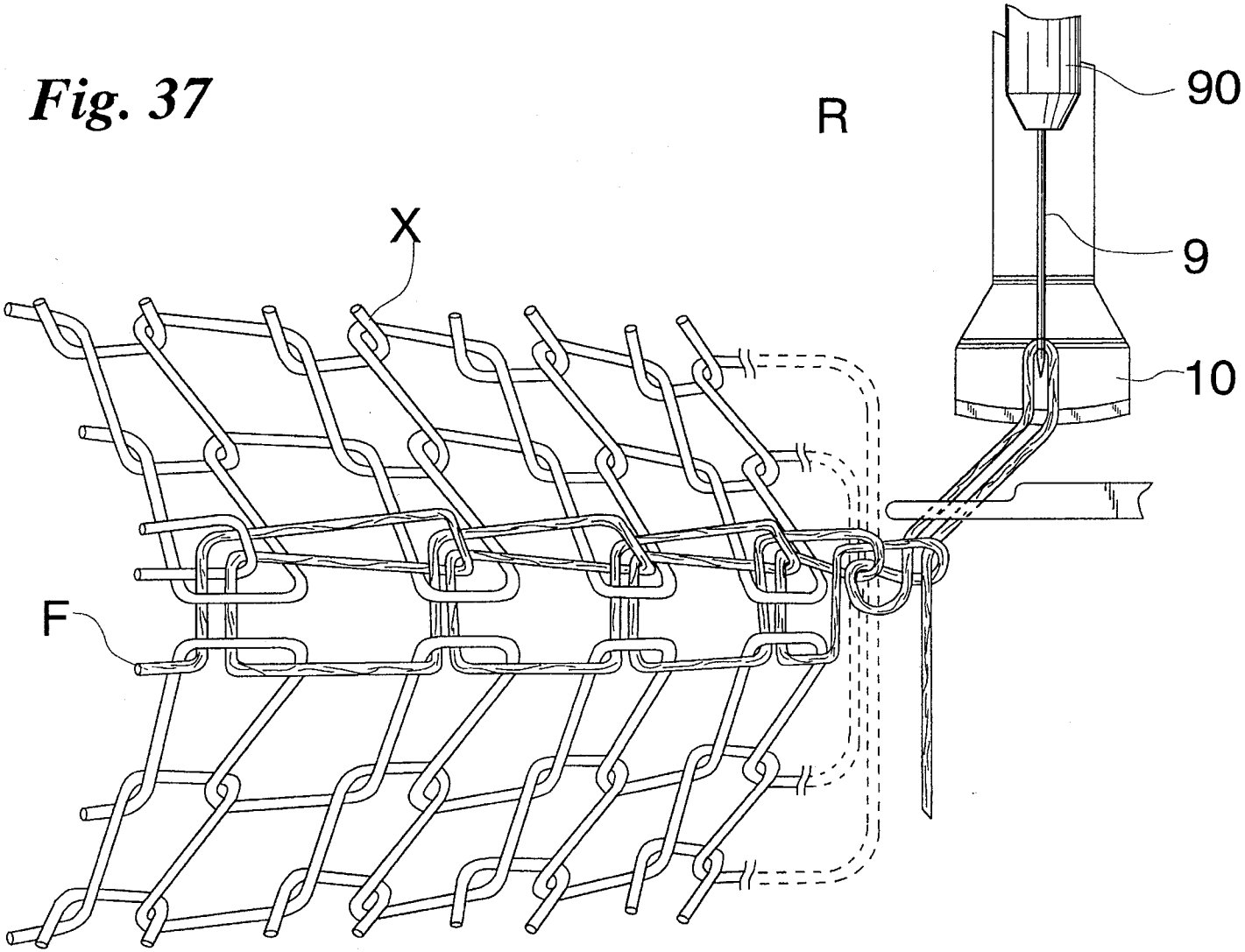
FIG. 37 shows in detail the step of predisposing the linking thread for the holding thereof, with the relevant operative means, according to an alternative embodiment.

Alternatively, and with reference to FIG. 34C of the attached drawings, the cutting means 95 are disposed on the opposite side of the linker 130 with respect to the hook-up line.

Advantageously, and with reference to FIG. 34B of the drawings, means are provided for inserting the tail of the linking thread F inside the article, after the formation of the closing knots for the, hook-up, by means of a needle 93 with skid 94, disposed in front of the closing knots and able to pick up the thread F, insert it deeply inside the article by a translation movement and leave it therein. At the end of such insertion, the thread F unthreads spontaneously out of the needle 93 because of the withdrawal thereof upon the opening of the skid 94.

Figure 38A:
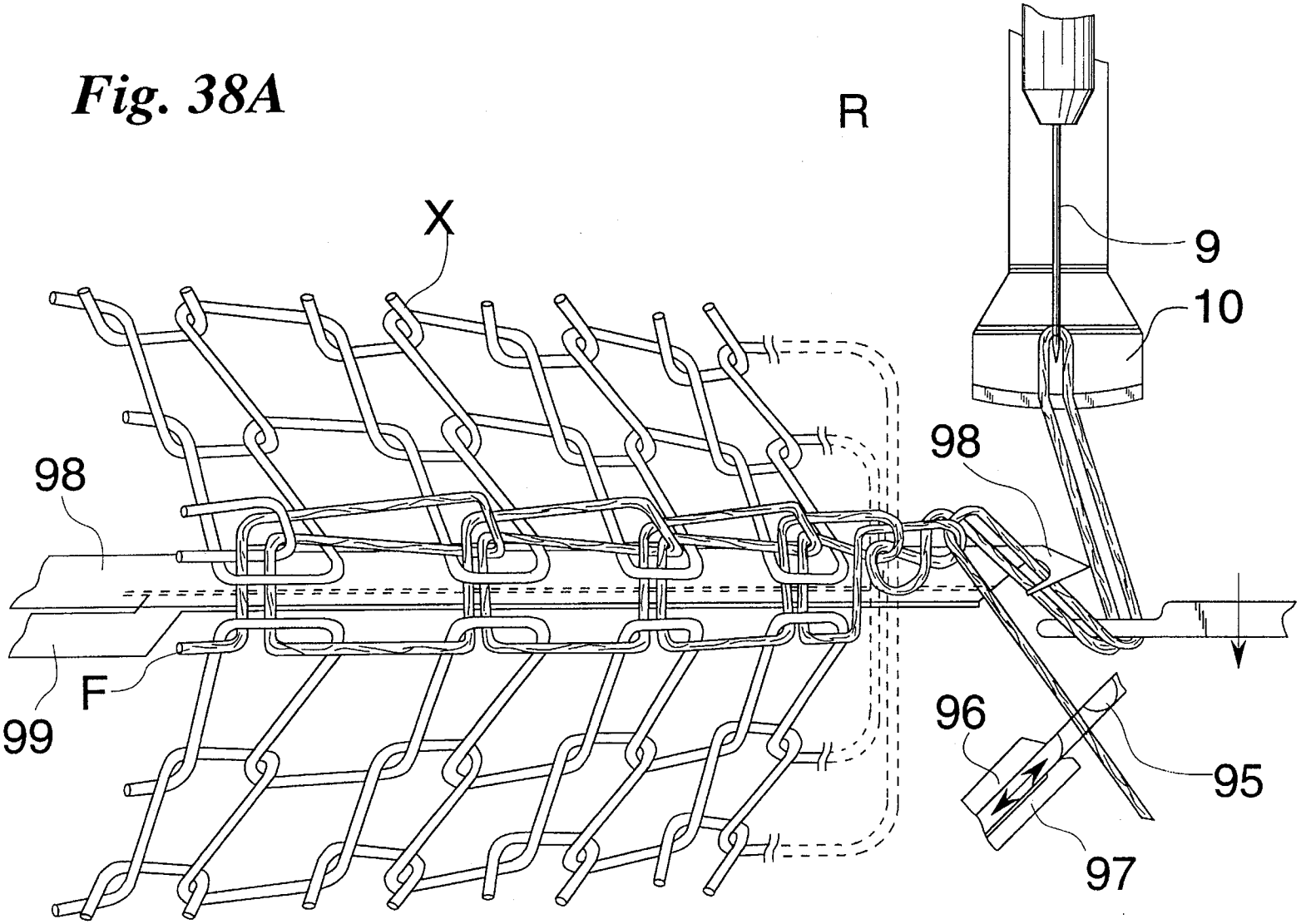
FIG. 38A shows in detail the step of positioning the means for cutting the linking thread and removing the thread terminal portion by the means provided for the insertion thereof inside the article, subsequent to the step of FIG. 37.
Figure 38B:
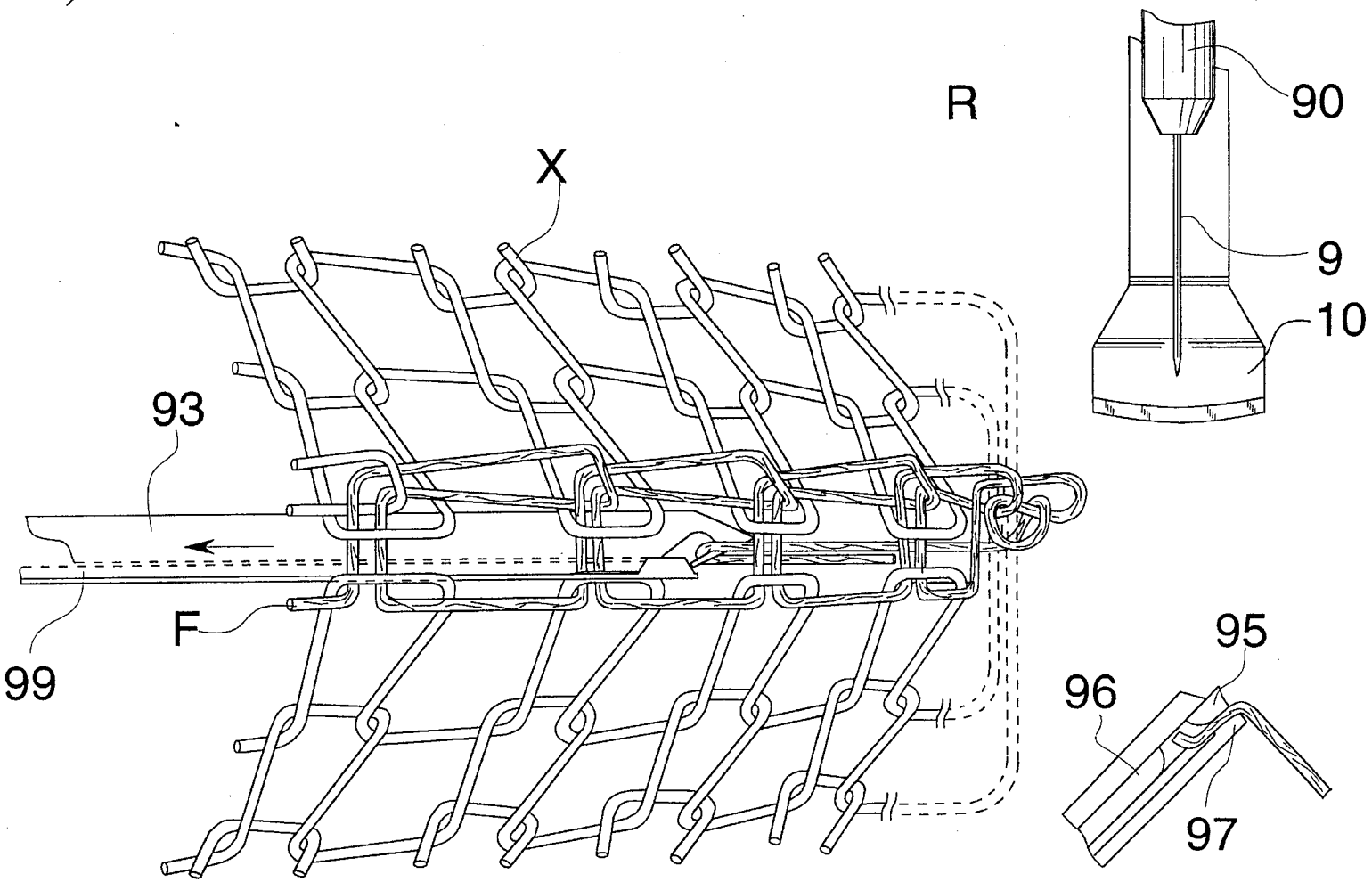
FIG. 38B shows in detail the step of cutting the linking thread and inserting the terminal portion thereof inside the article, subsequent to the step of FIG. 38.

Alternatively, and with reference to FIG. 38A of the drawings, a needle 8 with skid 99 is located on the opposite side of the linking needle 9 with respect to the closing knots. The thread F clears itself spontaneously out of the needle 98 owing to the withdrawal of the latter upon the closing of the respective skid 99.

Advantageously, means are provided for elastically tensioning the stitches of the article during the linking step by using a suction hose 92 located below the linking means and connected to the aspirator of the article-manufacturing machine. The same hose 92 may be used to convey the finished articles to the respective stocking stores.

According to the invention, it is possible to implement the method by using a cylinder 1 for needles 2,30 having either an even or odd number of needles.

Figure 43:
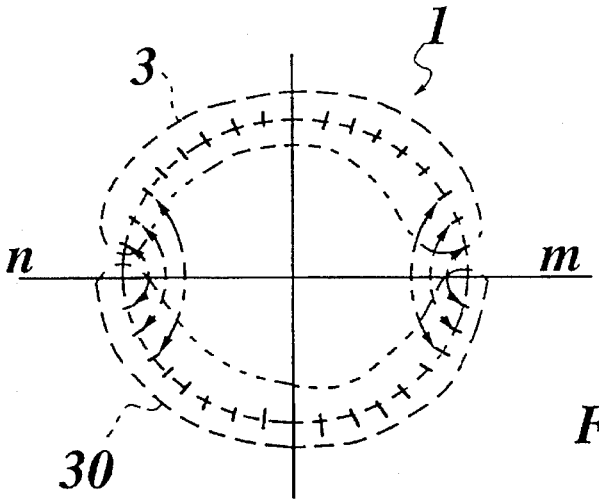
FIG. 43 shows schematically the subdivision into two partial courses of a knitting cylinder with an even number of needles.

In particular, with reference to FIG. 43 of the drawings, the axis a—a of rotation of sector 4 is made to pass through two diametrally opposite needles of cylinder 1. In this way the removed stitches of the first partial course will be in a number equal to that of the needles 3,30 of cylinder 1 minus two, and then divided by two. As a result the removed stitches are transferred onto as many needles 30 of the second partial course. However, upon completion of the hook-up, the two stitches 80 of the two needles 30 which are at the ends of the second partial course and have been excluded from the procedure for the transfer of the stitches 8 of the first partial course, are likewise linked.

Figure 44:
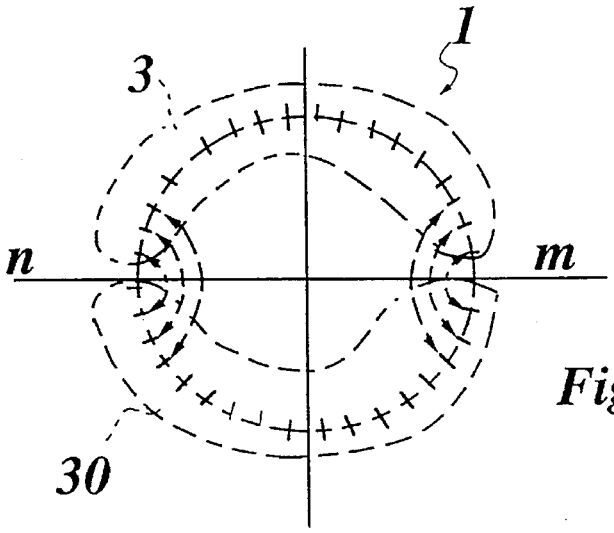
FIG. 44 shows schematically the subdivision into two partial courses of a knitting cylinder with an odd number of needles.

With reference to FIG. 44 of the drawings, provision is made for the axis a—a of rotation of sector 4 to pass between two diametrally opposite pairs of needles 3,30 of cylinder 1. In this way, the number of transferred stitches will result equal to half the total number of needles 3,30.

Figure 45:
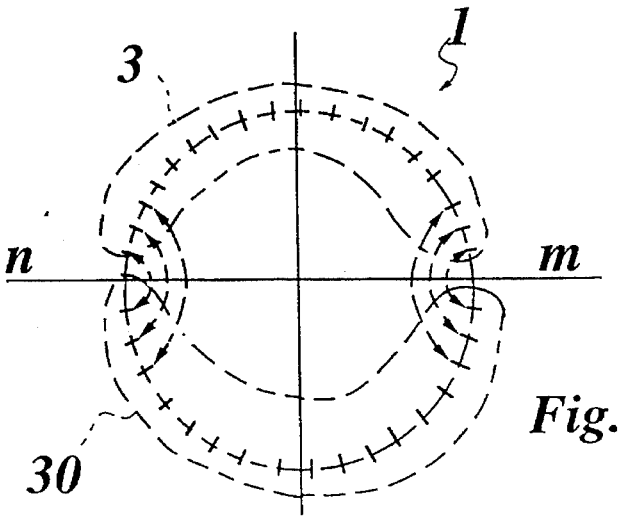
FIG. 45 shows schematically a further subdivision into two partial courses of a knitting cylinder.
Figure 46:
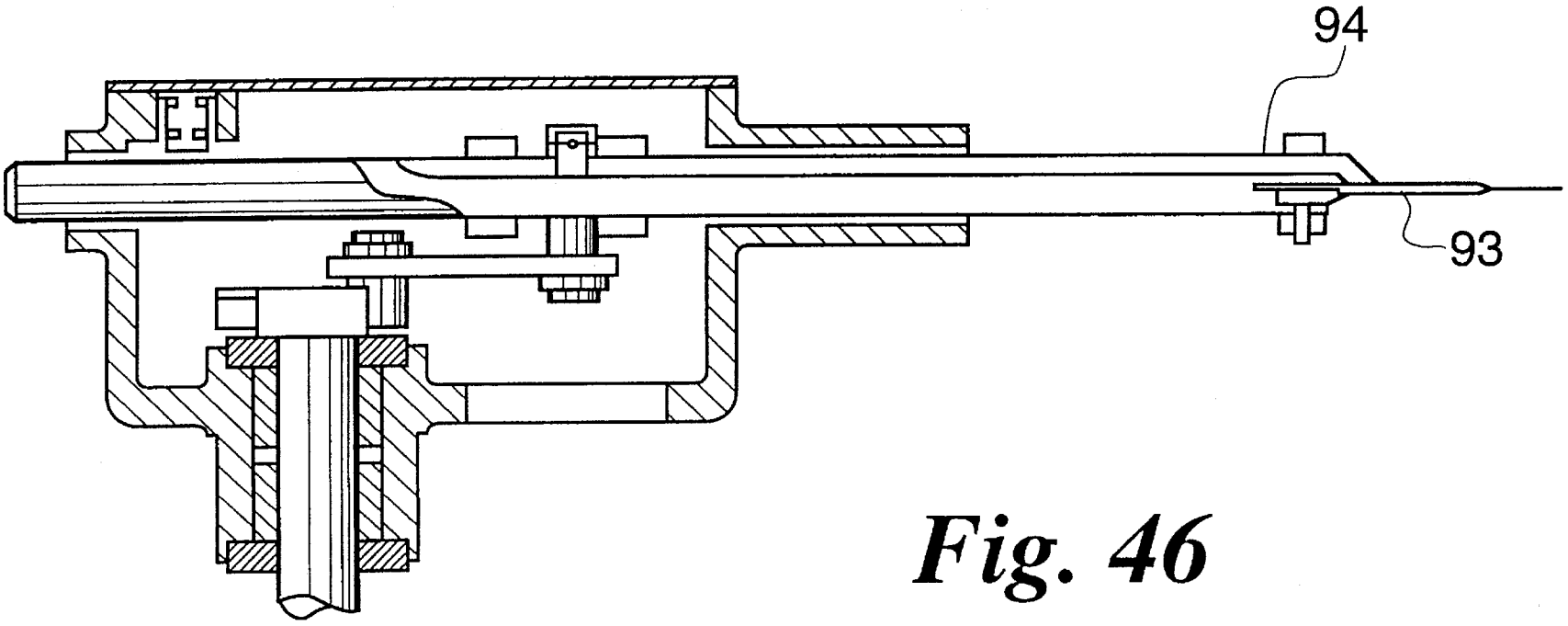
FIG. 46 shows in detail the means for inserting the terminal length of the linking thread inside the article.

With reference to FIG. 45 of the attached drawings, in case of an odd number of needles 3,30, the axis a—a of rotation of the sector 4 is made to pass in correspondence of a needle 30 of the second partial course and in correspondence of the center line of the needles 3,30 located at the end of the respective partial courses. In this case, the stitches to be transferred amount to the total number of needles minus one and then divided by two. The number of needles 30 of the second partial course is equal to the number of needles 3 of the first partial course plus one.

To move the plate 37, as shown in FIGS. 47–48, away from the knitting head of the machine, without altering the operating capability of the means intended for holding the knitting thread, provision is made for mounting the machine thread-guide unit 47,48 on a bracket 43 connected to the column 45 of the plate 41, with a pawl 46 for activating/deactivating the connection. In this way, the lifting of the column 45 is cause also for the lifting of the thread-guide unit 47,48 thereby allowing the actuation of the means for the removal and transfer of the stitches 8,80.

In the operation of the described apparatus as follows, reference is made to a preferred embodiment thereof, assuming the disposition of the needles 3,30 to be as in FIG. 44.

Upon completion of the knitting of the article and of the transfer of the stitches 8 of needles 3 of the first partial course x onto the needles 30 of the second partial course y, the cams 32 for driving the needles 30 operate the lowering of the latter down to a level below that of the nib 60 of sinkers 6, with the corresponding pairs of stitches 8,80 being disposed in a retained position. Afterwards, the sector 4 is brought to its initial position through an overturning thereof opposite to the position having transferred the stitches 8 of the first partial course. Thereafter, the cylinder 1 is rotated through 180° with respect to the sector 4 to bring the latter exactly in correspondence to the needles 30 of the second partial course. At this point, the cams 31 operate the lifting of the needles 30, with the sinkers 6 being closed, until the corresponding stitches 8,80 being retained by the sinkers 6 result in a predetermined position with respect to the stem of the respective needles 30, that is, in a position to allow for the subsequent removal thereof by the same spikes 2 which have transferred them. Afterwards, the needles 30 are lifted, with the sinkers 6 being open, up to move the pairs of stitches 8,80 to the level of the spikes 2 which, at this point, are made to advance to be closed by the relevant pegs 20, so as to capture the stitches 8,80. Then, the needles 30 are moved down so as to have the pairs of stitches 8,80 retained by the spikes 2 and the article released from the needles 3,30. Thereafter, the crown 5 is lifted together with the sector 4, with the article being retained by the spikes 2, by means of the cylinder 52. At this point, the suction hose 100 is lifted. Then, the actuation of cylinder 67 causes the rotation of the column 52 about the axis b—b and of crown 5 solid thereto, the latter being supported by the arm 51 which is rigidly connected to the same column 52. At the end of this rotation, the crown 5 is made to move in correspondence with the linking station R down to a level suitable for allowing the intervention of cams 59 to move the spikes 2 with relevant pegs 20 in closed condition. Afterwards, the spikes 2 are thus made to advance centripetally until the respective stitches 8,80 to be joined result angularly disposed equidistantly, and the distance between any two adjacent pairs of stitches 8,80 is equal to the linking shed, the latter being chosen according to the desired hook-up fineness. The thus disposed stitches to be joined 8,80 result ready for the linking operation which is carried out by the needle 9 supplied with the thread F, in association with the chain-guide 10 and crochet 14. During the linking, the crown 5 is driven into rotation by the transmission engaged to the toothed crown 66. Shed by shed, the needle 9 is inserted into a pair of corresponding stitches 8,80 thereby forming a plain chain hook-up stitch. After the execution of the last linking stitch, the needle 9, with the cooperation of the crochet 14 and chain-guide 10, makes two or more closing knots. Then, the thread F is captured by the needle 93, which has its skid open, and after the closing of the skid, the same needle 93 is made to advance inwardly of the article and the thread F finally cut. In this way, the tail of the hook-up thread F is inserted within the article by the further advancement of the needle 93. The withdrawal of the needle 93, with the skid 94 being open, allows it to spontaneously leave the tail of thread F. And this thread, once withdrawn out of the needle 93, results grasped by the article stitches and unable to come out thereof. Upon completion of this stage, the cam 58 is made to act upon the spikes 2 of sector 4 which leave the relevant stitches 8,80 already united, thereby allowing the finished article to be unloaded in its right-side out, that is, ready-to-use condition, through the hose 92.

Practically, all the construction details may vary in any equivalent way as far as the shape, dimensions, elements disposition, nature of the used materials are concerned, without nevertheless departing from the scope of the adopted solution idea and, thereby, remaining within the limits of the protection granted to the present patent for industrial invention.

What is claimed is:

1. A method for closing an end of a tubular knitted article, the method comprising the steps of:

knitting the tubular article in a circular knitting machine with a plurality of needles, said plurality of needles being divided into a first set and a second set, said first set of needles being positioned on one side of the tubular article and forming a first partial course of the tubular knitted article, said second set of tubular articles being positioned on another side of the tubular article and forming a second partial course of the tubular knitted article;

stopping said knitting when the tubular article is a desired length;

transferring the first partial course from said first set of needles to a transfer device in a first position adjacent said first set of needles;

rotating said transfer device about a diametrical axis of the tubular article to a second position to place the first partial course adjacent the second partial course;

transferring stitches from the first partial course on said transfer device to said second set of needles when said transfer device is in said second position;

rotating said transfer device back to said first position from said second position after said transferring of stitches from the first partial course to said second set of needles;

rotating said transfer device about a longitudinal axis of the tubular article from said first position to a third position adjacent said second set of needles after said rotating back to said first position;

transferring stitches of both the first and second partial courses from said second set of needles onto said transfer device;

moving said transferring device from said knitting machine to a linking station;

linking together said stitches of both the first and second partial courses on said transfer device at said linking station with a linking thread to close the tubular article.

2. A method in accordance with claim 1, wherein:

said rotating of said transfer device between said first and second positions is a rotation of 180 degrees;

said transferring of stitches from said transfer device to said second set of needles places said stitches onto said second set of needles in a retained position;

said second set of needles are lowered with sinkers of the knitting being open so as to move the retained stitches to below a nib of sinkers;

said sinkers are closed after the stitches are below the nib, and then said second set of needles are raised to cause the stitches to be moved into a predetermined position on said second set of needles;

said sinkers are opened after the stitches are in said predetermined position and then said second set of needles are raised further to place said stitches into a transfer position for said transferring of the stitches from said second set of needles to said transfer device;

said transferring of the stitches from said second set of needles to said transfer device includes lowering said second set of needles after the stitches are moved into said transfer position;

said moving of the tubular article is by rotation about an axis spaced from the tubular article and substantially parallel to said longitudinal axis of said tubular article;

the stitches are disposed at said linking station into an arc of circumference by driving the individual stitches on the transfer device in a centripetal direction with respect to the first and second partial courses;

said linking includes tying a knot in said linking thread, cutting said linking thread; the tubular article is then released from said transfer means.

3. A method in accordance with claim 1, wherein:

said moving of the tubular article from said knitting machine to said linking station is by a rotation about an axis of a needle cylinder of said knitting machine, said rotation is of a predetermined angular amplitude.

4. A method in accordance with claim 1, further comprising:

inserting a tail of said linking thread after said linking;

releasing the tubular article from said transfer means after said inserting of said waking thread.

5. A method in accordance with claim 1, further comprising:

moving a plate away from the knitting head of the knitting machine upon said stopping of said knitting;

providing suction on the tubular article during said knitting by a suction hose;

interrupting said suction and lifting said suction hose to a predetermined level during said moving the tubular article from said knitting machine to said linking station.

6. A method in accordance with claim 1, further comprising:

providing suction to the tubular article during said linking to cause elastic stretching of the tubular article.

7. A method in accordance with claim 1, wherein:

said linking step includes inserting a linking needle into the stitches in a direction angularly spaced to a common axis of the stitches.

8. A method in accordance with claim 1, wherein:

said linking thread is identical with thread used for said knitting of the article without solution of continuity.

9. A method in accordance with claim 1, wherein:

said linking thread is fed by a reel, and is different than a thread used in said knitting.

10. A method in accordance with claim 1, wherein:

said transfer device includes spines holding a stitch from said first and second partial courses and said linking step is carried out with said stitches being supported by said linking spines.

11. A method in accordance with claim 2, further comprising:

after said transfer of said stitches of said first partial course onto said second set of needles, moving said stitches of said first partial course through corresponding stitches of said second partial course and unloading the stitches of said second partial course from said second set of needles.

12. A method in accordance with claim 11, wherein:

the placing of said stitches into said retained position on said second set of needles and said moving of the stitches of said second partial course below a free end is performed by raising said second set of needles;

said moving of said stitches of said first partial course through stitches of said second partial course and said unloading of the stitches is performed by lowering of said second set of needles;

said rotating of said transfer device between said first and second positions is 180 degrees;

sinkers of said knitting machine are closed after the stitches of the second partial course are unloaded to retain the stitches of the first partial course, then said second set of needles are raised to cause the stitches to be moved into a predetermined position on said second set of needles;

said sinkers are opened after the stitches are in said predetermined position and then said second set of needles are raised further to place said stitches into a transfer position for said transferring of the stitches from said second set of needles to said transfer device;

said transferring of the stitches from said second set of needles to said transfer device includes lowering said second set of needles after the stitches are moved into said transfer position.

13. An apparatus for closing an end of a tubular knitted article, the apparatus comprising:

a knitting machine with a plurality of needles, said plurality of needles being divided into a first set and a second set, said first set of needles being positioned on one side of the tubular article and for forming a first partial course of the tubular knitted article, said second set of tubular articles being positioned on another side of the tubular article and for forming a second partial course of the tubular knitted article, said knitting machine including a cylinder holding said plurality of needles, and sinkers for holding stitches on said needles;

first cam means for lifting and lowering said plurality of needles when said knitting machine has finished knitting the tubular article, said first cam means being in an inoperative condition when said knitting machine is knitting;

a linking station spaced from said knitting machine said linking station closing the end of the tubular article;

transfer means for removing stitches from said first set of needles, said transfer means including a plurality of pairs of spikes, each of said pairs of spikes being positionable adjacent one of said needles of said first set of needles, said transfer means also including a closing peg with said each pair of spikes, said each pair of spikes with said closing peg forming grasping means for grasping a stitch, said transfer means also including a sector slidably housing said spikes and closing pegs in radial slots, said sector being rotatable about a diametrical axis of the tubular article, said sector being supported by a horizontal crown connected to an arm rotatable about a transfer axis substantially parallel to and spaced from a longitudinal axis of the tubular article to move said crown from said knitting machine to said linking station, said crown being movable in a direction along said transfer axis between a first position for engagement of said crown on a knitting head of said knitting machine and a second position for disengagement of said crown from said knitting machine, said crown being also rotatable in a plane orthogonal to said longitudinal axis of the tubular article when said crown is positioned at said linking machine by a transmission means engaged to a corresponding driving member, thereby allowing a suitable movement of the stitches to be united during closing with respect to said linking station;

second cam means for rotating said transfer means about said diametrical axis of the tubular article;

third cam means for moving said spikes and closing pegs in said transfer means;

crown transfer means for operating rotation of said arm through a pneumatic cylinder with a stem having a free end connected to a lever solid to a base of column supporting the arm, said column including a stem of a column cylinder aligned with said transfer axis for rotation of the arm about the transfer axis the column during transfer of the article from the knitting machine to the linking station, and said column cylinder being for translation movement along the transfer axis during engagement/disengagement of the crown on the knitting head of the knitting machine and on the linking station;

crown rotation means for causing said crown to rotate fixed with the cylinder holding the needles upon an initial article-linking stage, said crown rotation means including a pivot solid to the crown and angularly oscillatable between a first position for coupling the crown to an element solid to the cylinder, and a second position for coupling the crown to a stationary plate to cause the crown to stop at a predetermined angular position;

sinker housing means for holding said sinkers in fixed predetermined angular position, with a sinker cam able to freely oscillate about a pivot solid to a support, an angular position of said sinker cam with respect to the needles cylinder is variable and is mounted on a fixed part of the knitting machine, said sinker cam defining two curvilinear grooves according to two corresponding arcs of circumference, each of said grooves forming a guiding element for a corresponding pin solid to the sinker housing means;

fourth cam means for driving said spikes and closing pegs before dosing of the article;

fifth cam means for operating opening of the pegs for releasing the article;

a seamer-linker means positioned at said linking and for joining the stitches of said first and second partial course with a linking thread fed from a supply reel;

cutting means for cutting the linking thread and holding an end of the linking thread.

14. An apparatus in accordance with claim 13, wherein:

said second cam means includes pneumatic cylinders positioned on said arm to make the two said crown.

15. An apparatus in accordance with claim 13, wherein:

said first, second, third, forth and fifth cams are operatable by pneumatic cylinders fixed to a solid part of the knitting machine.

16. An apparatus in accordance with claim 13, wherein:

said first through fifth cams have a substantially helicoid profile.

17. An apparatus in accordance with claim 13, wherein:

said transfer means includes two rollers mounted on shafts positioned on opposite ends of said sector and positioned adjacent said second cam means.

18. An apparatus in accordance with claim 13, further comprising:

crown driving means for rotating said crown when said crown is positioned at said linking station, said crown driving means being engaged to a driving means of said knitting machine.

19. An apparatus in accordance with claim 13, wherein:

said crown is supported by the arm through a plurality of bearings which support a circular guide, said circular guide is substantially parallel to and coaxial with said crown, said circular guide is also disposed spaced from said crown.

20. An apparatus in accordance with claim 13, wherein:

each of said spikes is provided with two heels projecting from opposite sides of said each spike, said heels being positioned longitudinally offset to each other for reciprocating movement within respective said slots of said sector, by corresponding cams.

21. An apparatus in accordance with claim 13, wherein:

each of said closing pegs including heels projecting from opposite sides of said closing pegs, and be longitudinally offset to each other for reciprocating movement to open and close said corresponding spikes during capturing and releasing of stitches.

22. An apparatus in accordance with claim 13, wherein:

a height and width of said heels is preset according to a profile of said corresponding driving cams.

23. An apparatus in accordance with claim 13, wherein:

said spikes have a head with a wedge-like profile for capture and release of the stitches.

24. An apparatus in accordance with claim 13, wherein:

said spikes have a head with a tip extending substantially perpendicular to a slide direction of said spike for insertion of said tip within corresponding longitudinal cavities of a corresponding needle to capture stitches on said corresponding needle.

25. An apparatus in accordance with claim 13, wherein:

said seamer-linker means includes a frame, a needle bar connected to said frame, said needle bar having a skid seat, a covering skid to make the two said needle bar, a spring means received in a slot of said needle bar for biasing said skid seat in an open position, a travel distance of said spring means being adjustable by a screw, said covering skid also including a heel engageable with a corresponding skid cam which operates closing of the covering skid;

a linking needle connected to said needle bar;

a crochet-holder bar connected to said frame, a free end of said crochet-holder bar cooperating with said linking needle during closing of the tubular article;

feel or arm means for moving said crochet-holder bar and operated by a cam solid to a crank shaft, said crank shaft being orthogonal to said needle bar and connected to said needle bar by a connecting rod to form a crank drive moving the needle bar during the closing of the tubular article.

26. An apparatus in accordance with claim 13, wherein:

said cutting means is positioned adjacent said linking needle on a same side of said seamer-linker means with respect to the linking thread.

27. An apparatus in accordance with claim 13, wherein:

said cutting means is positioned adjacent the tip of said linking needle, on an opposite side of said seamer-linking means with respect to a hook-up line.

28. An apparatus in accordance with claim 13, further comprising:

means for inserting a tail of said linking thread inside the tubular article, said means for inserting including a skidded needle which is positioned in front of closing knots of said linking thread.

29. An apparatus in accordance with claim 28, wherein:

said skidded needle is located on an opposite side of said linking needle with respect to said closing knots.

30. An apparatus according to claim 13, further comprising:

stretching means for stretching the tubular article at said linking station, said stretching means including a hose disposed below the linking station and connected to an aspirator.

31. An apparatus in accordance with claim 13, wherein:

an outer face of a tip of each of said closing pegs is positioned in contact with an inner face of respective pair of said spikes.

32. An apparatus in accordance with claim 13, wherein:

each closing peg includes a transverse appendix forming a guiding element for a tip of a corresponding spike, said each peg also delimits in cooperation with a corresponding resents of said corresponding spike, a seat for one of said stitches.

33. An apparatus in accordance with claim 13, further comprising:

a thread guide unit on said knitting machine, and connected to said knitting machine by a bracket connectable to a column of a respective plate by means of a pawl.

* * * * *